US008834063B2

(12) United States Patent
Harakawa et al.

(10) Patent No.: US 8,834,063 B2
(45) Date of Patent: Sep. 16, 2014

(54) METHOD FOR REMOVING ASPHALT PAVEMENT AND SYSTEM FOR REMOVING ASPHALT PAVEMENT

(75) Inventors: Kenichi Harakawa, Chiba (JP); Hidetoshi Hayashida, Chiba (JP); Seiichi Takeuchi, Tokyo (JP); Koutaro Tohyama, Tokyo (JP); Shinsuke Wakabayashi, Tokyo (JP)

(73) Assignee: Green Arm Co., Ltd., Tokyo (JP)

( * ) Notice: Subject to any disclaimer, the term of this patent is extended or adjusted under 35 U.S.C. 154(b) by 1508 days.

(21) Appl. No.: 12/225,698

(22) PCT Filed: Mar. 28, 2007

(86) PCT No.: PCT/JP2007/000312

§ 371 (c)(1),
(2), (4) Date: Aug. 6, 2009

(87) PCT Pub. No.: WO2007/111025

PCT Pub. Date: Oct. 4, 2007

(65) Prior Publication Data

US 2009/0297268 A1 Dec. 3, 2009

(30) Foreign Application Priority Data

Mar. 29, 2006 (JP) ..... 2006-092423

(51) Int. Cl.

| | |
|---|---|
| ***E01C 7/06*** | (2006.01) |
| ***E01C 23/14*** | (2006.01) |
| ***E01C 23/09*** | (2006.01) |
| ***E01C 23/12*** | (2006.01) |

(52) U.S. Cl.

CPC ..... *E01C 23/12* (2013.01); *E01C 23/0933* (2013.01); *E01C 23/121* (2013.01); *E01C 23/14* (2013.01)

USPC ..... 404/77; 404/79; 404/95

(58) Field of Classification Search

USPC ..... 404/77, 79, 80, 95; 299/15, 36.1

See application file for complete search history.

(56) References Cited

U.S. PATENT DOCUMENTS 640,464 A * 1/1900 Gillett et al. ..... 313/3
910,922 A * 1/1909 Kerns ..... 299/15

(Continued)

FOREIGN PATENT DOCUMENTS

JP 01-198905 A 8/1989
JP 04-267091 A 9/1992

(Continued)

OTHER PUBLICATIONS

International Search Report mailed May 7, 2007.

*Primary Examiner* — Abigail A Risic

(74) *Attorney, Agent, or Firm* — Rader, Fishman & Grauer PLLC

(57) ABSTRACT

It is intended to allow an asphalt pavement to be peeled off efficiently with a relatively small amount of electric power without generating large vibration and noise, and handled in the form of a block. An electromagnetic induction coil 36 is positioned above an asphalt pavement 22 provided on a copper plate (12) to melt a lower surface of the asphalt pavement 22. Then, a wedge-shaped thermally-conductive peeling member 60 having a peeling layer formed on an upper surface thereof is inserted into a melted layer (74) of the lower surface of the asphalt pavement 22 to peel off the asphalt pavement 22 from the steel plate 12. This makes it possible to peel off the asphalt pavement 22 with a relatively small amount of electric power and handle the peeled asphalt pavement 22 in the form of a block.

17 Claims, 24 Drawing Sheets

(56) References Cited

U.S. PATENT DOCUMENTS

| | | | | | |
|---|---|---|---|---|---|
| 1,325,610 | A | * | 12/1919 | Bauer | 299/13 |
| 2,388,461 | A | * | 11/1945 | Baker | 299/36.1 |
| 2,673,395 | A | * | 3/1954 | Stolk | 30/140 |
| 2,706,321 | A | * | 4/1955 | Herr | 249/89 |
| 2,996,111 | A | * | 8/1961 | Mocerino et al. | 126/401 |
| 3,542,435 | A | * | 11/1970 | Herrmann | 299/36.1 |
| 3,592,509 | A | * | 7/1971 | Soderlund | 299/36.1 |
| 3,601,448 | A | * | 8/1971 | Stone | 299/14 |
| 3,807,886 | A | * | 4/1974 | Cutler | 404/77 |
| 3,822,956 | A | * | 7/1974 | Wirtgen | 404/95 |
| 4,584,044 | A | * | 4/1986 | Tokunaga et al. | 156/752 |
| 4,635,386 | A | * | 1/1987 | Kobayasi | 37/406 |
| 4,927,003 | A | * | 5/1990 | Swinderman et al. | 198/497 |
| 5,664,907 | A | * | 9/1997 | Betsinger | 404/90 |
| 5,961,730 | A | * | 10/1999 | Salmonsen et al. | 134/4 |
| 6,124,580 | A | * | 9/2000 | Nottmeier et al. | 219/635 |
| 6,401,637 | B1 | * | 6/2002 | Haller | 111/118 |
| 2002/0092847 | A1 | * | 7/2002 | Kiiski et al. | 219/619 |
| 2007/0122235 | A1 | | 5/2007 | Kasahara et al. | |

FOREIGN PATENT DOCUMENTS

| | | | |
|---|---|---|---|
| JP | 2000-303408 | A | 10/2000 |
| JP | 2007-146459 | A | 6/2007 |
| WO | WO-2006/059401 | A1 | 6/2008 |

* cited by examiner (A)

(B)

(A)

(B)

(C)

(D)

(E)

(E)

(F)

(G)

(H)

(I)

METHOD FOR REMOVING ASPHALT PAVEMENT AND SYSTEM FOR REMOVING ASPHALT PAVEMENT

TECHNICAL FIELD

The present invention relates to a method for peeling off asphalt pavement using a high-frequency electromagnetic induction coil.

BACKGROUND ART

As a method for peeling off asphalt pavement during a repair work of an asphalt-paved road, or the like, there have been known a manual chipping technique and a water-jet technique.

However, in cases where the chipping technique is applied to an asphalt pavement which is paved, for example, on a steel plate deck of a bridge or the like, the steel plate deck is liable to be scratched, and large vibration and noise are generated. Moreover, operation efficiency is extremely low. Thus, the application is limited to a small-scale repair work.

In cases where the water-jet technique is applied thereto, high-pressure water is jetted to a position around a boundary between the asphalt pavement and the steel plate deck to peel off the asphalt pavement, and thereby a bonding layer on an upper surface of the steel plate deck can also be removed. However, large vibration and noise are generated as with the chipping technique. Moreover, a large volume of water is used therein, which leads to a need for large-scale water-supply and wastewater-treatment equipment.

With a view to solving the above problems, it has been proposed a peeling technique, as disclosed in the following Patent Document 1. As shown in FIG. 13, in this technique, microwave generated from a microwave generator 200 is emitted from a microwave irradiator 202 to an asphalt road surface 204 to heat up and soften an asphalt layer 206. Then, the softened asphalt layer 206 is cut and peeled off using a push-cutting blade 208. This makes it possible to peel off the asphalt layer 206 without generating large vibration and noise.

However, the technique disclosed in the Patent Document 1 is designed to heat up and soften the entire asphalt layer 206, which leads to a need for a large amount of electric power. Moreover, the entirely softened asphalt layer 206 is hard to handle during removal thereof, and difficult to perform a loading operation. Moreover, during the loading operation, an additional operation, such as a cleanup operation, is required due to spilling and scattering of aggregates, sand and others in the asphalt layer 206.

As shown in FIG. 14, a hot peeling apparatus 210 disclosed in the following Patent Document 2 is designed to generate an alternating magnetic field from an electromagnetic induction coil 212 supplied with a high-frequency electric power, in such a manner that an eddy current is produced in a surface of a metal plate 214 to cause self-heating of the metal plate 214, so as to allow a film 216 on the metal plate 214 to be heated and peeled off.

However, a layer having a thickness of about 0.1 to 5.0 mm, such as the film 216, is warped upwardly and naturally peeled off by heating, whereas a thick layer, such as an asphalt pavement, is hardly peeled off only by heating. Even if an asphalt pavement is entirely softened by supplying a large amount of high-frequency electric power to the electromagnetic induction coil 212, the asphalt pavement after being peeled off is hard to handle as with the Patent Document 1, and the metal plate 214 is likely to be excessively heated to cause thermal degradation.

As shown in FIG. 15, in an induction heating apparatus 230 disclosed in the following Patent Document 3, when an alternating current is supplied to an electromagnetic induction coil 222 provided inside a manhole frame 220, an alternating magnetic flux is generated to pass through the inside of the manhole frame 220 via a flange 224 serving as a flux path member. An induction current generated by the alternating magnetic flux flows along the manhole frame 220, and thereby the manhole frame 220 is heated by Joule heat. Then, gussasphalt 228 is fluidized by the heat, so that a gap formed between an outer peripheral surface of the manhole frame 220 and an existing pavement 226 is filled with the gussasphalt 228.

However, even if the thermally fluidizable gussasphalt 228 is used as an asphalt pavement, and the asphalt pavement is entirely softened by heating using the hot peeling apparatus 210 as disclosed in the Patent Document 2, the asphalt pavement after being peeled off is hard to handle as with the Patent Document 1.

[Patent Document 1] JP 2000-303408A
[Patent Document 2] JP 04-267091A
[Patent Document 3] JP 01-198905A

DISCLOSURE OF THE INVENTION

Problem to be Solved by the Invention

In view of the above facts, it is an object of the present invention to allow an asphalt pavement to be peeled off efficiently with a relatively small amount of electric power without generating large vibration and noise, and handled in the form of a block.

Means for Solving the Problem

As set forth in the appended claim 1, the present invention provided an asphalt pavement removing method for allowing an asphalt pavement provided on a steel plate to be peeled off from the steel plate and removed in the form of an asphalt block having a given size. The asphalt pavement removing method comprises a softened-layer forming step of subjecting the steel plate to electromagnetic induction heating to form, in the asphalt pavement, a softened layer having a lower surface in contact with the steel plate, an extraction step of peeling off the softened layer formed in the softened-layer forming step, from the steel plate in contact with the softened layer, and fragmenting and extracting the asphalt pavement in the form of the asphalt block, and a moving step of moving the asphalt block extracted in the extraction step.

In the invention set forth in the appended claim 1, an asphalt pavement is provided on a steel plate.

In the softened-layer forming step, a softened layer having a lower surface in contact with the steel plate is formed in the asphalt pavement. The softened layer is formed by subjecting the steel plate to electromagnetic induction heating.

Then, in the extraction step, the softened layer formed in the asphalt pavement is peeled off from the steel plate in contact with the softened layer, and the asphalt pavement is fragmented and extracted in the form of an asphalt block.

Then, in the moving step, the asphalt block extracted in the extraction step is moved.

Through the above steps, the asphalt pavement provided on the steel plate is peeled off from the steel plate, and removed in the form of an asphalt block having a given size.

Thus, the softened layer formed in the asphalt pavement allows the asphalt pavement to be easily peeled off from the steel plate, and therefore the asphalt pavement can be fragmented without generating large vibration and noise as in the chipping technique.

The remaining portion of the asphalt pavement other than the softened layer is in a solid state. Thus, the asphalt pavement can be fragmented and extracted in the form of the asphalt block. This makes it possible to facilitate an asphalt-block extracting operation to achieve enhanced operation efficiency.

An object to be subjected to electromagnetic induction heating is the steel plate, and therefore the heating can be efficiently performed. In addition, an amount of heat to be applied can be set at a value for forming the softened layer only in the vicinity of the steel plate. Thus, the asphalt pavement can be fragmented and extracted in the form on the asphalt block, with a relatively small amount of electric power.

As set forth in the appended claim 2, preferably, a temperature of the softened layer is set at 55° C. or more.

In the invention set forth in appended claim 2, the temperature of the softened layer is set at 55° C. or more. This makes it possible to form, in the asphalt pavement, a softened layer having a viscosity suitable for allowing the asphalt pavement to be peeled off from the steel plate.

As set forth in the appended claim 3, preferably, the asphalt pavement removing method further includes a first-cut-line forming step of forming, in the asphalt pavement, one or more first cut lines which segment a width of the asphalt pavement into two or more segmental widths and each of which has a depth failing to reach the steel plate or an appendage provided on the steel plate, wherein the asphalt block is extracted as a plate-shaped rectangular block.

In the invention set forth in appended claim 3, through the first-cut-line forming step, the one or more first cut lines segmenting a width of the asphalt pavement into two or more segmental widths are formed in the asphalt pavement. Each of the one or more first cut lines is formed to have a depth failing to reach the steel plate or an appendage provided on the steel plate.

Further, the asphalt block is extracted as a plate-shaped rectangular block.

Thus, the asphalt block can be extracted as a plate-shaped rectangular block to allow an operation of loading a truck or other transportation means to be efficiently performed. Further, in an operation of clamping the asphalt block from respective sides of opposite side surfaces thereof by a clamping device, the clamping can be reliably performed.

In addition, each of the one or more first cut lines formed in the asphalt pavement has a depth failing to reach the steel plate or the appendage provided on the steel plate. This makes it possible to prevent the steel plate or the appendage provided on the steel plate from being scratched.

Even if each of the one or more first cut lines formed in the asphalt pavement has a depth failing to reach the steel plate or the appendage provided on the steel plate, the segmental asphalt pavement can be easily peeled off from the steel plate and fragmented, because a lower layer of the segmental asphalt pavement is formed as a softened layer and thereby reduced in strength.

As set forth in the appended claim 4, preferably, the asphalt pavement removing method further includes a second-cut-line forming step of forming, in the asphalt pavement, a plurality of second cut lines each of which intersects the one or more first cut lines, and has a depth failing to reach the steel plate or the appendage provided on the steel plate.

In the invention set forth in appended claim 4, through the second-cut-line forming step, the plurality of second cut lines each of which intersects the one or more first cut lines is formed in the segmental asphalt pavement. Each of the second cut lines is formed to have a depth failing to reach the steel plate or the appendage provided on the steel plate.

Thus, the asphalt block can be extracted as a plate-shaped rectangular block having a given size.

In addition, each of the second cut lines formed in the segmental asphalt pavement has a depth failing to reach the steel plate or the appendage provided on the steel plate. This makes it possible to prevent the steel plate or the appendage provided on the steel plate from being scratched.

Even if each of the second cut lines formed in the segmental asphalt pavement has a depth failing to reach the steel plate or the appendage provided on the steel plate, the segmental asphalt pavement can be easily peeled off from the steel plate and fragmented, because a lower layer of the segmental asphalt pavement is formed as a softened layer and thereby reduced in strength.

As set forth in the appended claim 5, preferably, the extraction step is the step of lifting up the segmental asphalt pavement, or pulling the segmental asphalt pavement in a trailing direction, while holding the segmental asphalt pavement by holding means, so as to fragment and extract the segmental asphalt pavement in the form of the asphalt block.

In the invention set forth in appended claim 5, through the extraction step, the segmental asphalt pavement is fragmented by lifting up the segmental asphalt pavement, or pulling the segmental asphalt pavement in a trailing direction, while holding the segmental asphalt pavement by holding means. Then, the segmental asphalt pavement is extracted in the form of the asphalt block.

Thus, the segmental asphalt pavement can be peeled off from the steel plate, and fragmented and extracted in the form of the plate-shaped rectangular block, in a simple manner.

As set forth in the appended claim 6, preferably, the extraction step is the step of bringing a presser member into contact with the segmental asphalt pavement while arranging the presser member to extend in a direction intersecting the one or more first cut lines, and bending the segmental asphalt pavement while holding the segmental asphalt pavement by holding means, so as to fragment and extract the segmental asphalt pavement in the form of the asphalt block.

In the invention set forth in appended claim 6, through the extraction step, the presser member is brought into contact with the segmental asphalt pavement while being arranged to extend in a direction intersecting the one or more first cut lines. Then, the segmental asphalt pavement is bent while being held by holding means, and fragmented and extracted in the form of the asphalt block.

Thus, the segmental asphalt pavement can be peeled off from the steel plate, and fragmented and extracted in the form of the plate-shaped rectangular block, in a simple manner.

In addition, a need for forming a cut line intersecting the one or more first cut lines can be eliminated. This makes it possible to prevent the steel plate or the appendage provided on the steel plate from being scratched due to an operation of forming the cut line intersecting the one or more first cut lines.

Further, the segmental asphalt pavement can be easily bent, because a lower layer of the segmental asphalt pavement is formed as a softened layer and thereby reduced in strength.

As set forth in the appended claim 7, preferably, the extraction step is the step of bending the segmental asphalt pavement while holding the segmental asphalt pavement by holding means, so as to fragment and extract the segmental asphalt pavement in the form of the asphalt block.

In the invention set forth in appended claim 7, through the extraction step, the segmental asphalt pavement is fragmented by bending the segmental asphalt pavement while holding the segmental asphalt pavement by holding means. Then, the segmental asphalt pavement is extracted in the form of the asphalt block.

Thus, the segmental asphalt pavement can be peeled off from the steel plate, and fragmented and extracted in the form of the plate-shaped rectangular block, in a simple manner.

In addition, the second cut lines formed in the segmental asphalt pavement allow the segmental asphalt pavement to be more easily bent.

As set forth in the appended claim 8, preferably, the holding means is an upper/lower-surface clamping device operable to clamp the segmental asphalt pavement from respective sides of upper and lower surfaces thereof, wherein the upper/lower-surface clamping device includes a peeling member adapted to be inserted between the steel plate and the softened layer or inserted into the softened layer.

In the invention set forth in appended claim 8, the holding means is an upper/lower-surface clamping device operable to clamp the segmental asphalt pavement from respective sides of upper and lower surfaces thereof. Further, the upper/lower-surface clamping device includes a peeling member adapted to be inserted between the steel plate and the softened layer or inserted into the softened layer.

This makes it possible to reliably hold the segmental asphalt pavement.

As set forth in the appended claim 9, the holding means may be a suction device operable to suckingly hold the segmental asphalt pavement.

In the invention set forth in appended claim 9, the suction device operable to suckingly hold the segmental asphalt pavement is employed as holding means, so that the segmental asphalt pavement can be held within a shorter period of time as compared with a clamping device. This makes it possible to increase a speed of the asphalt-pavement removing operation.

As set forth in the appended claim 10, the holding means may be a side-surface clamping device operable to clamp the segmental asphalt pavement from respective sides of opposite side surfaces thereof each defined by the second cut line.

In the invention set forth in appended claim 10, the side-surface clamping device operable to clamp the segmental asphalt pavement from respective sides of opposite side surfaces thereof each defined by the second cut line is employed as the holding means, so that the segmental asphalt pavement can be reliably held.

As set forth in the appended claim 11, the holding means may be a gripping device having a claw member adapted to grip a surface of the segmental asphalt pavement.

In the invention set forth in appended claim 11, the gripping device having a claw member adapted to grip a surface of the segmental asphalt pavement is employed as the holding means, so that so that the segmental asphalt pavement can be held within a shorter period of time as compared with a clamping device. This makes it possible to increase a speed of the asphalt-pavement removing operation.

As set forth in the appended claim 12, preferably, the asphalt pavement removing method further includes a measurement step of measuring a thickness of the asphalt pavement, wherein at least one of each of the one or more first cut lines and each of the second cut lines is formed based on a thickness of the asphalt pavement measured in the measurement step to have a depth less than the measured thickness of the asphalt pavement.

In the invention set forth in appended claim 12, a thickness of the asphalt pavement is measured in the measurement step. Then, at least one of each of the one or more first cut lines and each of the second cut lines is formed to have a depth less than the thickness of the asphalt pavement measured in the measurement step.

This makes it possible to form the cut lines without scratching the steel plate or the appendage provided on the steel plate.

As set forth in the appended claim 13, preferably, the asphalt pavement removing method further includes a transfer step of transferring the asphalt block extracted in the extraction step, to one or more of three positions on leading, lateral and trailing sides relative to a position where the asphalt block is extracted.

In the invention set forth in appended claim 13, the asphalt block extracted in the extraction step is transferred to one or more of three positions on leading, lateral and trailing sides relative to a position where the asphalt block is extracted.

Thus, the asphalt block extracted in the extraction step can be removed to one or more of three positions on leading, lateral and trailing sides relative to a position where the asphalt block is extracted.

When the asphalt block extracted in the extraction step is transferred to the position on the leading side relative to the position where the asphalt block is extracted, a truck or other transportation means to be loaded with the asphalt block can be transferred on the un-removed asphalt pavement without causing any trouble with traveling thereof. In addition, an operation of changing the truck or other transport means does not disturb the operation of extracting the asphalt pavement. This makes it possible to achieve enhanced operation efficiency and enhanced safety.

As set forth in the appended claim 14, the present invention provides an asphalt pavement removing system for allowing an asphalt pavement provided on a steel plate to be peeled off from the steel plate and removed in the form of an asphalt block having a given size. The asphalt pavement removing system comprises a softened-layer forming device operable to subject the steel plate to electromagnetic induction heating to form, in the asphalt pavement, a softened layer having a lower surface in contact with the steel plate, an extraction device operable to peel off the softened layer formed by the softened-layer forming device, from the steel plate in contact with the softened layer, and fragment and extract the asphalt pavement in the form of the asphalt block, and a transfer device operable to transfer the asphalt block extracted by the extraction device, to one or more of a plurality of positions on leading, lateral and trailing sides relative to a position where the asphalt block is extracted.

In the invention set forth in appended claim 14, the asphalt pavement removing system is provided with the softened-layer forming device, the extraction device and the transfer device, and adapted to peel off an asphalt pavement provided on a steel plate, from the steel plate and remove the peeled asphalt pavement in the form of an asphalt block having a given size.

The softened-layer forming device is operable to subject the steel plate to electromagnetic induction heating. Through this operation, a softened layer having a lower surface in contact with the steel plate is formed in the asphalt pavement The extraction device is operable to peel off the softened layer formed by the softened-layer forming device, from the steel plate in contact with the softened layer, and fragment and extract the asphalt pavement in the form of the asphalt block.

The transfer device is operable to transfer the asphalt block extracted by the extraction device, to one or more of a plurality of positions on leading, lateral and trailing sides relative to a position where the asphalt block is extracted.

Thus, the softened layer formed in the asphalt pavement allows the asphalt pavement to be easily peeled off from the steel plate, and therefore the asphalt pavement can be fragmented without generating large vibration and noise as in the chipping technique.

The remaining portion of the asphalt pavement other than the softened layer is in a solid state. Thus, the asphalt pavement can be fragmented and extracted in the form of the asphalt block. This makes it possible to facilitate an asphalt-block extracting operation to achieve enhanced operation efficiency.

An object to be subjected to electromagnetic induction heating is the steel plate, and therefore the heating can be efficiently performed. In addition, an amount of heat to be applied can be set at a value for forming the softened layer only in the vicinity of the steel plate. Thus, the asphalt pavement can be fragmented and extracted in the form on the asphalt block, with a relatively small amount of electric power.

As set forth in the appended claim 15, preferably, the asphalt pavement removing system further includes a first-cut-line forming device operable to form, in the asphalt pavement, one or more first cut lines which segment a width of the asphalt pavement into two or more segmental widths and each of which has a depth failing to reach the steel plate or an appendage provided on the steel plate, wherein the asphalt block is extracted as a plate-shaped rectangular block.

In the invention set forth in appended claim 15, the first-cut-line forming device is operable to form, in the asphalt pavement, the one or more first cut lines segmenting a width of the asphalt pavement widthwise into two or more partial widths. Each of the one or more first cut lines is formed to have a depth failing to reach the steel plate or an appendage provided on the steel plate.

Further, the asphalt block is extracted as a plate-shaped rectangular block.

Thus, the asphalt block can be extracted as a plate-shaped rectangular block to allow an operation of loading a truck or other transportation means to be efficiently performed. Further, in an operation of clamping the asphalt block from respective sides of opposite side surfaces thereof by a clamping device, the clamping can be reliably performed.

In addition, each of the one or more first cut lines formed in the asphalt pavement has a depth failing to reach the steel plate or the appendage provided on the steel plate. This makes it possible to prevent the steel plate or the appendage provided on the steel plate from being scratched.

Even if each of the one or more first cut lines formed in the asphalt pavement has a depth failing to reach the steel plate or the appendage provided on the steel plate, the segmental asphalt pavement can be easily peeled off from the steel plate and fragmented, because a lower layer of the segmental asphalt pavement is formed as a softened layer and thereby reduced in strength.

As set forth in the appended claim 16, preferably, the asphalt pavement removing system further includes a second-cut-line forming device operable to form, in the segmental asphalt pavement, a plurality of second cut lines each of which intersects the one or more first cut lines, and has a depth failing to reach the steel plate or the appendage provided on the steel plate.

In the invention set forth in appended claim 16, the second-cut-line forming device is operable to form, in the segmental asphalt pavement, the plurality of second cut lines each of which intersects the one or more first cut lines. Each of the second cut lines is formed to have a depth failing to reach the steel plate or the appendage provided on the steel plate.

Thus, the asphalt block can be extracted as a plate-shaped rectangular block having a given size.

In addition, each of the second cut lines formed in the segmental asphalt pavement has a depth failing to reach the steel plate or the appendage provided on the steel plate. This makes it possible to prevent the steel plate or the appendage provided on the steel plate from being scratched.

Even if each of the second cut lines formed in the segmental asphalt pavement has a depth failing to reach the steel plate or the appendage provided on the steel plate, the segmental asphalt pavement can be easily peeled off from the steel plate and fragmented, because a lower layer of the segmental asphalt pavement is formed as a softened layer and thereby reduced in strength.

As set forth in the appended claim 17, the asphalt pavement removing system further includes a measurement device operable to measure a thickness of the asphalt pavement, wherein at least one of each of the one or more first cut lines and each of the second cut lines is formed based on a thickness of the asphalt pavement measured by the measurement device to have a depth less than the measured thickness of the asphalt pavement.

In the invention set forth in appended claim 17, the measurement device is operable to measure a thickness of the asphalt pavement. Then, at least one of each of the one or more first cut lines and each of the second cut lines is formed to have a depth less than the thickness of the asphalt pavement measured by the measurement device.

This makes it possible to form the cut lines without scratching the steel plate or the appendage provided on the steel plate.

As set forth in the appended claim 18, the present invention provides an electromagnetic induction coil unit for use in an asphalt pavement removing system for allowing an asphalt pavement provided on a steel plate to be peeled off from the steel plate and removed in the form of an asphalt block having a given size, wherein the electromagnetic induction coil unit is operable to subject the steel plate to electromagnetic induction heating to form, in the asphalt pavement, a softened layer having a lower surface in contact with the steel plate. The electromagnetic induction coil unit comprises a first coil group consisting of a plurality of electromagnetic induction coils located on a leading side of a progress direction of the operation of the asphalt pavement removing system and arranged in side-by-side relation to each other in a direction intersecting the progress direction, a second coil group consisting of a plurality of electromagnetic induction coils located on a trailing side relative to the first group of electromagnetic induction coils in the progress direction and arranged in side-by-side relation to each other in a direction intersecting the progress direction, and a frame member adapted to allow the first and second coil groups to be fixed thereto, wherein the first coil group is disposed in the frame member in offset relation to the second coil group, in such a manner that a center of each of the electromagnetic induction coils in the first coil group is located between respective centers of adjacent ones of the electromagnetic induction coils in the second coil group.

In the invention set forth in appended claim 18, in a state after an asphalt pavement provided on a steel plate is peeled off from the steel plate, and removed in the form of an asphalt block having a given size by an asphalt pavement removing system, the electromagnetic induction coil unit is operable to subject the steel plate to electromagnetic induction heating to form, in the asphalt pavement, a softened layer having a lower surface in contact with the steel plate.

The electromagnetic induction coil unit comprises the first coil group consisting of a plurality of electromagnetic induction coils arranged in side-by-side relation to each other, the second coil group consisting of a plurality of electromagnetic induction coils arranged in side-by-side relation to each other, and the frame member adapted to allow the first and second coil groups to be fixed thereto.

The first coil group consists of a plurality of electromagnetic induction coils located on a leading side of a progress direction of the operation of the asphalt pavement removing system and arranged in side-by-side relation to each other in a direction intersecting the progress direction.

The second coil group consists of a plurality of electromagnetic induction coils located on an opposite side relative to the first coil group with respect to the progress direction and arranged in side-by-side relation to each other in a direction intersecting the progress direction, The first coil group is disposed in the frame member in offset relation to the second coil group, in such a manner that a center of each of the electromagnetic induction coils in the first coil group is located between respective centers of adjacent ones of the electromagnetic induction coils in the second coil group.

The electromagnetic induction coils in each of the first and second coil groups are arranged in side-by-side relation to each other. This makes it possible to heat the entire surface of a portion of the steel plate located directly below the electromagnetic induction coil unit.

During an operation of performing the electromagnetic induction heating while moving the electromagnetic induction coil unit in the progress direction of the operation of the asphalt pavement removing system, an eddy current is not sufficiently produced in a portion of the steel plate located directly below a center of an electromagnetic induction coil, and thereby heating at this portion goes down. However, when the first coil group is disposed in the frame member in offset relation to the second coil group, in such a manner that a center of each of the electromagnetic induction coils in the first coil group is located between respective centers of adjacent ones of the electromagnetic induction coils in the second coil group, portions of the steel plate which have not been able to be sufficiently heated by the electromagnetic induction coils in the first coil group can be subsequently heated by the electromagnetic induction coils in the second coil group located on the trailing side relative to the first coil group, so that the entire surface of the steel plate can be evenly heated.

As set forth in the appended claim 19, preferably, the number of the electromagnetic induction coils in the first coil group is two or more, and the number of the electromagnetic induction coils in the second coil group is greater than that of the electromagnetic induction coils in the first coil group by one.

In the invention set forth in appended claim 19, the number of the electromagnetic induction coils in the first coil group is two or more, and the number of the electromagnetic induction coils in the second coil group is greater than that of the electromagnetic induction coils in the first coil group by one.

In this case, the first coil group is disposed in the frame member in offset relation to the second coil group, in such a manner that a center of each of the electromagnetic induction coils in the first coil group is located between respective centers of adjacent ones of the electromagnetic induction coils in the first coil group. Thus, when the electromagnetic induction heating is performed while moving the electromagnetic induction coil unit in the progress direction of the operation of the asphalt pavement removing system, the entire surface of the steel plate can be evenly heated In addition, the number of the electromagnetic induction coils in the second coil group located on the trailing side of the progress direction is greater than that of the electromagnetic induction coils in the first coil group located on the leading side of the progress direction. This makes it possible to strongly heat a larger area of the steel plate until just before the asphalt pavement is peeled off from the steel plate.

As set forth in the appended claim 20, the present invention provides an asphalt pavement removing apparatus for allowing an asphalt pavement provided on a steel plate to be peeled off from the steel plate and removed in the form of an asphalt block having a given size. The asphalt pavement removing apparatus comprises a softened-layer forming device operable to subject the steel plate to electromagnetic induction heating to form in the asphalt pavement a softened layer having a lower surface in contact with the steel plate, an extraction device operable to peel off the softened layer formed by the softened-layer forming device, from the steel plate in contact with the softened layer, and fragment and extract the asphalt pavement in the form of the asphalt block, a transfer device operable to transfer the asphalt block extracted by the extraction device, to one or more of a plurality of positions on leading, lateral and trailing sides relative to a position where the asphalt block is extracted, and a movable body mounting thereon the softened-layer forming device, the extraction device and the transfer device.

In the invention set forth in appended claim 20, the softened-layer forming device, the extraction device and the transfer device are mounted on the movable body. These devices are operable to peel off an asphalt pavement provided on a steel plate, from the steel plate and remove the peeled asphalt pavement in the form of an asphalt block having a given size.

The softened-layer forming device is operable to subject the steel plate to electromagnetic induction heating. Through this operation, a softened layer having a lower surface in contact with the steel plate is formed in the asphalt pavement The extraction device is operable to peel off the softened layer formed by the softened-layer forming device, from the steel plate in contact with the softened layer, and fragment and extract the asphalt pavement in the form of the asphalt block.

The transfer device is operable to transfer the asphalt block extracted by the extraction device, to one or more of a plurality of positions on leading, lateral and trailing sides relative to a position where the asphalt block is extracted.

Thus, the softened layer formed in the asphalt pavement allows the asphalt pavement to be easily peeled off from the steel plate, and therefore the asphalt pavement can be fragmented without generating large vibration and noise as in the chipping technique.

The remaining portion of the asphalt pavement other than the softened layer is in a solid state. Thus, the asphalt pavement can be fragmented and extracted in the form of the asphalt block. This makes it possible to facilitate an asphalt-block extracting operation to achieve enhanced operation efficiency.

An object to be subjected to electromagnetic induction heating is the steel plate, and therefore the heating can be efficiently performed. In addition, an amount of heat to be applied can be set at a value for forming the softened layer only in the vicinity of the steel plate. Thus, the asphalt pavement can be fragmented and extracted in the form on the asphalt block, with a relatively small amount of electric power.

Further, the softened-layer forming device, the extraction device and the transfer device can be mounted on the movable body to quickly set these devices and initiate the asphalt-pavement removing operation.

As set forth in the appended claim 21, the present invention provides an asphalt pavement peeling method for peeling off an asphalt pavement provided on a steel plate. The asphalt pavement peeling method comprises a segmenting step of forming a cut line in the asphalt pavement to segment the asphalt pavement by a given width, a melting step of supplying a high-frequency electric power to an electromagnetic induction coil positioned above the segmental asphalt pavement, so as to heat the steel plate to melt a lower surface of the segmental asphalt pavement, and a peeling step of inserting, into a melted layer of the lower surface of the segmental asphalt pavement, a wedge-shaped thermally-conductive peeling member having a peeling layer formed on an upper surface thereof to prevent a melt in the lower surface of the segmental asphalt pavement from being bonded thereonto.

In the invention set forth in appended claim 21, a cut line is formed in the asphalt pavement provided on the steel plate to segment the asphalt pavement by a given width. Further, an electromagnetic induction coil is positioned above the segmental asphalt pavement.

When a high-frequency electric power is supplied to the electromagnetic induction coil, an eddy current based on the electromagnetic induction is produced in the steel plate to generate heat due to an electric resistance of the steel plate. Thus, a lower surface of the segmental asphalt pavement in contact with the heated steel plate is melted.

Then, the wedge-shaped peeling member is inserted into a melted layer of the lower surface of the segmental asphalt pavement to peel off the segmental asphalt pavement from the steel plate. The melted layer is locally heated for a relatively short period of time, and therefore the entire amount of heat is relatively small. Thus, when the melted layer comes into contact with the thermally-conductive peeling member, it will be cooled down to a temperature causing no re-bonding, within a relatively short period of time. The peeling member has the peeling layer formed on an upper surface thereof. Thus, when a temperature of a lower surface of the segmental asphalt pavement is lowered, the lower surface of the segmental asphalt pavement is not bonded onto the peeling member.

Thus, it is only necessary as a condition for starting a peeling operation to peel off a part of the asphalt pavement serving as a space for placing the peeling member on the steel plate, and a large force is not required for the subsequent peeling operation, because the peeling member is simply inserted into a lower layer of the segmental asphalt pavement melted by the electromagnetic induction coil. Thus, the segmental asphalt pavement can be peeled off without generating large vibration and noise as in the tipping technique.

An object to be subjected to electromagnetic induction heating is the steel plate, and therefore the heating can be efficiently performed. In addition, an amount of heat to be applied can be set at a value for forming the softened layer only in the vicinity of the steel plate. Thus, the segmental asphalt pavement can be peeled off with a relatively small amount of electric power.

In addition, the peeled asphalt pavement is not entirely softened, and the lower surface of the segmental asphalt pavement is also cooled down to a temperature causing no re-bonding, within a relatively short period of time, by coming into contact with the upper surface of the peeling member. Further, the peeling layer can prevent the segmental asphalt pavement from being bonded onto the peeling member. Thus, the peeled asphalt pavement can be handled in the form of a block to facilitate the asphalt-pavement removing operation and other operation to achieve enhanced operation efficiency.

As set forth in appended claim 22, preferably, the peeling layer comprises a fluororesin.

In the invention set forth in appended claim 22, in addition to the same effects as those of the invention set forth in the appended claim 21, the peeling member can be used for a relatively long period of time by taking advantage of wear resistance and heat resistance of the fluororesin employed in the peeling layer.

As set forth in appended claim 23, the peeling layer may comprise an oil.

In the invention set forth in appended claim 23, the same effects as those of the invention set forth in the appended claim 21 can be obtained in a low-cost and simple manner.

As set forth in appended claim 24, the present invention provides an asphalt pavement peeling method for peeling off an asphalt pavement provided on a steel plate. The asphalt pavement peeling method comprises a segmenting step of forming a cut line in the asphalt pavement to segment the asphalt pavement by a given width, a melting step of supplying a high-frequency electric power to an electromagnetic induction coil positioned above the segmental asphalt pavement, so as to heat the steel plate to melt a lower surface of the segmental asphalt pavement, a peeling step of inserting a wedge-shaped thermally-conductive peeling member into a melted layer of the lower surface of the segmental asphalt pavement, and a separating step of separating the peeled asphalt pavement bonded onto the peeling member, from the peeling member, using separating means provided in the peeling member.

In the invention set forth in appended claim 24, a cut line is formed in the asphalt pavement provided on the steel plate to segment the asphalt pavement by a given width. Further, an electromagnetic induction coil is positioned above the segmental asphalt pavement.

When a high-frequency electric power is supplied to the electromagnetic induction coil, an eddy current based on the electromagnetic induction is produced in the steel plate to generate heat due to an electric resistance of the steel plate. Thus, a lower surface of the segmental asphalt pavement in contact with the heated steel plate is melted.

Then, the wedge-shaped peeling member is inserted into a melted layer of the lower surface of the segmental asphalt pavement to peel off the segmental asphalt pavement from the steel plate. The melted layer is locally heated for a relatively short period of time, and therefore the entire amount of heat is relatively small. Thus, when the melted layer comes into contact with the thermally-conductive peeling member, it will be cooled down to a temperature causing no re-bonding, within a relatively short period of time. During this operation, the lower surface of the peeled asphalt pavement is bonded onto the peeling member.

Then, in a given location, the bonded asphalt pavement is separated from the peeling member by the separating means.

Thus, it is only necessary as a condition for starting a peeling operation to peel off a part of the asphalt pavement serving as a space for placing the peeling member on the steel plate, and a large force is not required for the subsequent peeling operation, because the peeling member is simply inserted into a lower layer of the segmental asphalt pavement melted by the electromagnetic induction coil. Thus, the segmental asphalt pavement can be peeled off without generating large vibration and noise as in the tipping technique.

An object to be subjected to electromagnetic induction heating is the steel plate, and therefore the heating can be efficiently performed. In addition, an amount of heat to be applied can be set at a value for forming the softened layer only in the vicinity of the steel plate. Thus, the segmental asphalt pavement can be peeled off with a relatively small amount of electric power.

In addition, the peeled asphalt pavement is not entirely softened, and the lower surface of the segmental asphalt pavement is also cooled down to a temperature causing no re-bonding, within a relatively short period of time, by coming into contact with the upper surface of the peeling member. Thus, the peeled asphalt pavement can be handled in the form of a block to facilitate the asphalt-pavement removing operation and other operation to achieve enhanced operation efficiency.

Further, the bonding of the peeled asphalt pavement onto the peeling member and the separation of the bonded asphalt pavement from the peeling member can be controlled to prevent drop-off of the peeled asphalt pavement from the peeling member during the asphalt-pavement removing operation and other operation.

As set forth in appended claim 25, preferably, the separating means is heating means operable to heat an upper surface of the peeling member.

In the invention set forth in appended claim 25, the upper surface of the peeling member is heated by the heating means to re-melt the lower surface of the peeled asphalt pavement bonded onto the peeling member. This makes it possible to lower a bonding force between the peeling member and the lower surface of the peeled asphalt pavement so as to separate the bonded asphalt pavement from the peeling member.

Thus, the same effects as those of the invention set forth in the appended claim 24 can be obtained using simple separating means.

As set forth in appended claim 26, the separating means may be push-out means provided on an upper surface of the peeling member.

In the invention set forth in appended claim 26, the peeled asphalt pavement bonded onto the peeling member can be pushed out by the push-out means provided on the upper surface of the peeling member to separate the bonded asphalt pavement from the peeling member. Thus, the same effects as those of the invention set forth in the appended claim 24 can be obtained without re-melting the lower surface of the peeled asphalt pavement.

Effect of the Invention

The present invention having the above features allows an asphalt pavement to be peeled off efficiently with a relatively small amount of electric power without generating large vibration and noise, and handled in the form of a block.

BEST MODE FOR CARRYING OUT THE INVENTION

An embodiment of the present invention will now be described.

Although the embodiment of the present invention will be shown as an example where the present invention is applied to an asphalt pavement provided on a steel plate deck of a bridge, the present invention is not limited thereto, but may be applied to any other structures where an asphalt pavement is provided on a steel plate capable of producing an eddy current using an electromagnetic induction coil. Further, although the embodiment of the present invention will show an asphalt pavement 22 formed by laminating a gussasphalt layer 14 and an asphalt concrete layer 16, the present invention may be applied to any other asphalt pavements with various structures each having a lower surface meltable by an electromagnetic induction coil. Although the embodiment of the present invention will show a steel plate having a thickness of 12 mm, the present invention may be applied to any other steel plates having various thicknesses.

First of all, a system configuration for implementing an asphalt pavement peeling method according to a first embodiment of the present invention will be described.

As shown in FIG. 1, a gussasphalt layer 14 having a thickness of 35 mm, and an asphalt concrete layer 16 having a thickness of 40 mm, which are made up of an asphalt pavement 22, are laminated on a steel plate 12 serving as an upper member of a steel plate deck of a bridge and having a thickness of 12 mm, in this order.

A 10-ton capacity dump truck 18 is driven onto the asphalt concrete layer 16. A forward traveling direction of the dump truck 18 corresponds to a peeling direction 20 of the asphalt pavement 22.

The present invention is intended to peel off the asphalt pavement 22 from the steel plate 12 and extract the peeled asphalt pavement 22 in the form of an asphalt block 24, wherein the peeling direction 20, and a horizontal direction orthogonal to the peeling direction, will hereinafter be referred to respectively as "longitudinal direction" and "lateral direction". Further, as shown in FIG. 7(C), a longitudinal length of the asphalt block 24, and a lateral length of the asphalt block 24, will hereinafter be referred to respectively as "asphalt block length $L_1$" and "asphalt block width $L_2$".

As shown in FIG. 7(A), a cut line 72 is pre-formed in the asphalt pavement 22 using a cutting blade (not shown) to segment the asphalt pavement 22 by a given asphalt block width $L_2$. Typically, one lane of a road has a width of about 3,500 mm. Thus, for example, the asphalt block width $L_2$ and the asphalt block length $L_1$ may be set, respectively, in the range of 1,000 to 1,800 mm and in the range of 600 to 1,200 mm, and the cut line 72 may be formed to segment the asphalt pavement 22 into two or three parts. FIG. 7(A) shows one example where the asphalt pavement 22 is segmented into three lanes 30A, 30B, 30C.

The cut line 72 to be formed using the cutting blade is not required to have a depth reaching the steel plate 12, but it may have a depth which is about 80% of a thickness of the asphalt pavement 22. This makes it possible to prevent the steel plate 12 from being scratched. The cutting blade may be any type as long as it can form the cut line 72 in the asphalt pavement 22. For example, a disc saw having rotary saw teeth, or a pressing/cutting blade adapted to cut into an asphalt pavement while melting asphalt, may be used.

As shown in FIG. 1, a coil unit 32 is placed on an upper surface of the asphalt concrete layer 16 at a position on the trailing side relative to the dump truck 18. As shown in a top plan view of the coil unit 32 in FIG. 2(B), three electromagnetic induction coils 36 are provided in a trailing region inside a box-shaped frame member 34 made of FRP, and arranged in side-by-side relation to each other at even intervals in the lateral direction, and two electromagnetic induction coils 36 are provided in a leading region inside the box-shaped frame member 34, and arranged in side-by-side relation to each other in the lateral direction while being offset relative to the arrangement of the trailing-side electromagnetic induction coils 36 by a distance approximately equal to one-half of a width of one of the trailing-side electromagnetic induction coils 36.

As shown in FIG. 2(A) which is a sectional view taken along the line A-A in FIG. 2(B), each of the electromagnetic induction coils 36 is fixed onto a bottom plate 34A of the frame member 34. The bottom plate 34A of the frame member 34 also serves as a cover member for the electromagnetic induction coils 36 to prevent damage of the electromagnetic induction coils 36 during use.

As another fixation technique, a holding member for five assemblies of a ferrite member 38 and the electromagnetic induction coil 36 may be provided on a lower surface of a horizontal plate bridged between opposed inner walls of the frame member 24 to allow the respective assemblies of the ferrite member 38 and the electromagnetic induction coil 36 to be fixed thereto.

The ferrite member 38 is placed on an upper surface of the electromagnetic induction coil 36 in a radial pattern relative to a center of the electromagnetic induction coil 36. Although the ferrite member in the first embodiment is formed and arranged to partially cover the upper surface of the electromagnetic induction coil 36, it may be formed and arranged to partially cover at least one of the upper surface, an inner peripheral surface and an outer peripheral surface of the electromagnetic induction coil 36, or may be formed and arranged to entirely cover at least one of the upper surface, the inner peripheral surface and the outer peripheral surface of the electromagnetic induction coil 36.

The frame member 34 has a board 40 formed to have a thickness approximately equal to that of the ferrite member 38 and provided at a vertically intermediate position thereof to extend approximately in a horizontal direction, as shown in a top plan view thereof in FIG. 3. The board 40 is formed with five groups of cutouts 41 for restricting a horizontal displacement of the respective ferrite members 38. Thus, in a state after each of the ferrite members 38 is fitted into a corresponding one of the groups of cutouts 41, it is never displaced from a predetermined position in a horizontal direction.

With a view to enhance heating efficiency of the electromagnetic induction coils 36, a lower surface of each of the electromagnetic induction coils 36 is disposed in adjacent relation to the upper surface of the asphalt concrete layer 16 as close as possible to reduce a distance between an upper surface of the steel plate 12 and the lower surface of the electromagnetic induction coil 36. In the first embodiment, a distance H between the upper surface of the steel plate 12 and the lower surface of the electromagnetic induction coil 36 is set at 100 mm. That is, a gap of 25 mm exists between the upper surface of the asphalt concrete layer 16 and the lower surface of the electromagnetic induction coil 36.

The frame member 34 has a detachable top plate 34B made of FRP. This makes it possible to prevent an operator or the like from touching the electromagnetic induction coils 36 when they are is in a high-temperature state, and promote heat release to an outside of the frame member 34. In addition, the top plate 34B can be detached to facilitate a maintenance operation for the electromagnetic induction coils 36.

Four wheels 44 are provided in respective four corners of the frame member 34. The coil unit 32 is adapted to allow a plurality of the coil units 32 to be connected to each other in the lateral direction.

Although FRP is used as a material of the frame member 34, the frame member 34 may be made of any other suitable material having thermal insulation properties and capable of ensuring sufficient stiffness as a box-shaped body to install the assemblies of the ferrite member 38 and the electromagnetic induction coil 36, such as a synthetic resin panel material. In the first embodiment, the stiffness of the frame member 34 is further increased using a plurality of reinforcements 43, 45. Preferably, the top plate 34B of the frame member 34B is made of a material having thermal insulation properties and high thermal conductivity. In FIG. 2(B), the top plate 34A, the board 40 and the reinforcements 43, 45 are omitted for convenience of explanation.

As shown in FIG. 1, a high-frequency power generating unit 46 for supplying a high-frequency power to the electromagnetic induction coils 36 via an electric cable 58, and a power generator 48 serving as a power source of the high-frequency power generating unit 46, are mounted on a loading platform of the dump truck 18.

A supporting column 50 is fixed to an rear end of the loading platform of the dump truck 18 to protrude downwardly, and a connection portion 52 provided in the vicinity of a lower end of the supporting column 50 is coupled to a connection portion 54 provided on a leading side of the coil unit 32, through a pulling wire 56.

A small turning-type backhoe 64 having an arm 62 and a ripper 60 attached to a distal end of the arm 62 to serve as a peeling member is driven onto the steel plate 12 at a position on the trailing side relative to the coil unit 32.

As shown in FIG. 4, the ripper 60 comprises a wedge-shaped thermally-conductive base member 66, and a sharp-pointed claw member 68 made of iron and attached onto an upper surface of the base member 66 in a replaceable manner. Further, a Teflon™ coating 70 is formed on an upper surface of the claw member 68. The ripper 60 is formed to have a lateral width less than the asphalt block width $L_2$. The wedge-shaped thermally-conductive base member 66 may be made of a material which allows heat of a lower surface of the asphalt pavement 22 in a melted state to be released through the base member 66, and has strength and durability necessary for an operation of peeling off the asphalt pavement 22. Preferably, the base member 66 is made of a steel material.

The Teflon™ coating 70 has wear resistance and heat resistance, and therefore can ensure long-term use of the ripper 60. Further, the claw member 68 is replaceable. Thus, even if a tip of the claw member 68 is rounded off due to a long-term peeling operation, or the Teflon™ coating 70 is peeled off, the claw member 68 can be replaced with new one. Alternatively, the claw member 68 may be detached to re-shape the tip or re-form a new Teflon™ coating 70, and reused.

An operation process for implementing the asphalt pavement peeling method according to the first embodiment will be described below.

In advance of start of the peeling operation, a part of the asphalt pavement serving as a space for placing the backhoe 64 and the ripper 60 on the steel plate 12 is peeled off and removed. In FIG. 7, the dump truck 18 and the coil unit 32 are omitted for convenience of explanation.

Firstly, as shown in FIG. 7(A), the cut line 22 is formed in the asphalt pavement 22 using the cutting blade to segment the asphalt pavement 22 by the asphalt block width $L_2$. As a result, the asphalt pavement 22 is segmented into three lanes 30A, 30B, 30C.

Then, the coil unit 32 is placed on each of two zones B, C of the segmental asphalt pavements 22 to be initially peeled off. In the first embodiment, two of the segmental asphalt pavements 22, specifically lanes 30A, 30B which are located on a leading side relative to the backhoe 64, are alternately peeled off. Thus, the coil unit 32 is provided in a member of two, wherein the two coil units 32 are connected to each other in the lateral direction, and pulled by the dump truck 18 provided in a number of one.

When a high-frequency power is supplied from the high-frequency power generating unit 46 to the electromagnetic induction coils 36 of each of the coil units 32 located above the respective zones B, C, via the electric cable 58, an eddy current based on electromagnetic induction is produced in the steel plate 12 at a position directly below the coil units 32 to generate heat due to an electric resistance of the steel plate 12.

Then, a lower surface of the gussasphalt layer 14 in contact with the heated steel plate 12 is melted to form a melted layer 74 therein. The high-frequency power to be supplied to the electromagnetic induction coils 36 is adjusted to allow the steel plate 12 to be heated up to a temperature causing melting of only the lower surface of the gussasphalt layer 14.

If the temperature of the steel plate 12 is less than a melting point of the lower surface of the gussasphalt layer 14, the lower surface of the gussasphalt layer 14 is not adequately peeled off. If the temperature of the steel plate 12 is excessively greater than a melting point of the lower surface of the gussasphalt layer 14, the segmental asphalt pavement 22 is entirely softened to preclude handling in the form of a block, and the steel plate is likely to be deformed.

Gussasphalt is generally melted at about 80° C. Thus, the high-frequency power is preferably supplied to the electromagnetic induction coils 36 to allow the steel plate 12 to be heated up to a temperature slightly greater than 80° C.

In conjunction with initiation of the heating, the dump truck 18 is moved in the forward traveling direction to pull each of the coil units 32 so as to gradually move the coil unit 32 in the peeling direction 20. A moving speed of the coil unit 32 is appropriately determined depending on a heating capability of the coil unit 32 and a desired speed of the peeling operation.

As shown in FIG. 2(A), the electromagnetic induction coils 36 are arranged in side-by-side relation to each other at even intervals in the lateral direction. Thus, a surface of the steel plate 12 corresponding to the zones B, C can be entirely heated.

An eddy current is not sufficiently produced in a portion of the steel plate 12 located directly below a center of the electromagnetic induction coil 36, and thereby heating at this portion goes down. In the first embodiment, the leading-side two electromagnetic induction coils 36 are arranged in side-by-side relation to each other in the lateral direction while being offset relative to the arrangement of the trailing-side electromagnetic induction coils 36 by a distance approximately equal to one-half of a width of one of the trailing-side electromagnetic induction coils 36. Thus, when the coil unit 32 is moved in the peeling direction 20, portions of the steel plate 12 which have not been able to be sufficiently heated by the leading-side two electromagnetic induction coils 36 can be subsequently heated by the trailing-side electromagnetic induction coils 36, so that the surface of the steel plate 12 corresponding to the zones B, C can be evenly heated.

In addition, the upper surface of each of the electromagnetic induction coils 36 is covered by the ferrite member 38. Thus, a magnetic circuit resistance around the electromagnetic induction coil 36 can be reduced to allow an eddy current to be efficiently produced in the steel plate 12.

Then, as shown in FIG. 5(A), immediately after melting the lower surface of the gussasphalt layer 14, the ripper 60 is inserted into the melted layer 74 of the lower surface of the gussasphalt layer 14 in the zone B to peel off the segmental asphalt pavement 22 from the steel plate 12.

Then, as shown in FIG. 5(B), when a pivot end is lifted upwardly, a non-lifted portion of the segmental asphalt pavement 22 exerts a force for returning the lifted portion of the segmental asphalt pavement 22 downwardly, based on its own weight and a bonding force with the steel plate 12, and thereby a shearing force is generated in a region of the lifted portion adjacent to the tip of the ripper 60 to create a crack extending upwardly from a lower surface of the region.

Then, as shown in FIG. 5(C), the ripper 60 is lifted upwardly in a horizontal posture until the lifted portion of the segmental asphalt pavement 22 is fully separated from the non-lifted portion of the segmental asphalt pavement 22. Through the above process, an asphalt block 24 is extracted from the lane 30A.

The melted layer 74 is locally heated for a relatively short period of time, and therefore the entire amount of heat is relatively small. Thus, when the melted layer 74 comes into contact with the thermally-conductive ripper 60, it will be is cooled down to a temperature causing no re-bonding (in gussasphalt, the temperature is generally about 70° C.), within a relatively short period of time. Further, the ripper 60 has the Teflon™ coating 70 formed on the upper surface thereof. Thus, when a temperature of a lower surface of the asphalt block 24 is lowered, the lower surface of the asphalt block 24 is not bonded onto the ripper 60.

Then, as shown in FIG. 6(D), the ripper 60 is further lifted upwardly while maintaining the tip of the ripper at a height position higher than that of the pivot end thereof to prevent drop-off of the asphalt block 24 from the ripper 60, and the arm 62 is turned about 10 to 30 degrees to reach a position directly above the lane 30C. Preferably, anti-drop-off means, such as a device adapted to clamp the asphalt block 24 from respective sides of upper and lower surfaces thereof, is provided in view of operation efficiency and safety.

Then, as shown FIGS. 6(E) and 7(B), the asphalt block 24 is slowly dropped onto and temporarily stored on an upper surface of the lane 30C. The temporarily-stored asphalt block 24 is loaded into a dump truck or other transportation means using a loading machine which is provided separately. This loading operation is continuously performed in conjunction with the peeling operation.

Then, as shown in FIG. 7(C), the ripper 60 is inserted into the melted layer 74 of a lower surface of the gussasphalt layer 14 in the zone C heated by the electromagnetic induction coils 36 located above the lane 30B, to peel off the segmental asphalt pavement 22 from the steel plate 12. Then, the aforementioned process in FIGS. 5(A) to 5(C) is repeated to alternately peel off the two segmental asphalt pavements 22 in the lanes 30A, 30B. Specifically, as shown in FIGS. 7(D) to 7(E), after the two segmental asphalt pavements 22 in the lanes 30A, 30B, are entirely peeled off, the remaining segmental asphalt pavement 22 in the lane 30C, is entirely peeled off while placing one coil unit 32 on the lane 30C, and pulling the coil unit 32 by the dump truck 18, in the same manner as that in the lanes 30A, 30B.

A function and effect of the asphalt pavement peeling method according to the first embodiment will be described below.

It is only necessary as a condition for starting the peeling operation to peel off and remove a part of the asphalt pavement 12 serving as a space for placing the backhoe 64 and the ripper 60 on the steel plate 12, as shown in FIG. 1, and a large force is not required for the subsequent peeling operation, because the ripper 60 is simply inserted into the lower layer of the gussasphalt layer 14 melted by the electromagnetic induction coils 36. Thus, the asphalt pavement 22 can be peeled off without generating large vibration and noise as in the tipping technique.

An object to be heated by the electromagnetic induction coils 36 is the steel plate 12, and therefore the heating can be efficiently performed. In addition, an amount of heat to be applied can be set at a value for melting only the lower surface of the gussasphalt layer 14. Thus, the asphalt pavement 22 can be peeled with a relatively small amount of electric power.

In addition, the peeled asphalt pavement 22 is not entirely softened, and the lower surface of the gussasphalt layer 14 is also cooled down to a temperature causing no re-bonding, within a relatively short period of time, by coming into contact with the upper surface of the ripper 60. Further, the Teflon™ coating 70 can prevent the lower surface of the gussasphalt layer 14 from being bonded onto the ripper 60 during temperature reduction of the lower surface. Thus, the peeled asphalt pavement 22 can be handled in the form of the asphalt block 24 to facilitate the asphalt-pavement removing operation and other operation to achieve enhanced operation efficiency.

In the first embodiment, the asphalt block 24 is temporarily stored on the upper surface of the asphalt pavement strip 30C. Alternatively, the asphalt block 24 may be temporarily stored in a position on the trailing side relative to the backhoe 64 by turning the arm 62 of the backhoe 64 180 degrees.

In the first embodiment, the Teflon™ coating 70 is employed as a peeling layer to be formed on the upper surface of the claw member 68. Alternatively, the peeling layer may be made of any other suitable material capable of preventing the lower surface of the gussasphalt layer 14 from being bonded onto the ripper 60, such as polyimide resin, polyphenylene sulfide (PPS), modified fluororesin, nylon, polyethylene, vinyl chloride, Teflon™ resin, or engineering plastic, e.g., Duracon™ or MC nylon, or may be a composite material sheet comprising the above resin and fiber, such as glass fiber, carbon fiber or aramid fiber.

The above resin has wear resistance and heat resistance, and therefor can ensure long-term use of the ripper 60. A melting temperature of gussasphalt is about 80° C. Thus, as to heat resistance, a material resistant to a temperature of up to about 120° C. may be used. It is more preferable to use Teflon™ excellent in wear resistance and heat resistance.

In cases where it is desired to give priority to forming the peeling layer in a simple manner, an oil, such as light oil or NEPPARAN™, may be used, and applied to the upper surface of the claw member 68. Alternatively, sand or the like may be spread onto the upper surface of the claw member 68. NEPPARAN is an anti-bonding agent against asphalt mixtures, and can exhibit higher debondability than that of light oil. NEPPARAN-W comprises a mineral resin, a surfactant and clean water, and NEPPARAN-ECO-W comprises a plant oil, a surfactant, a water-soluble solvent, an oil-soluble solvent and clean water.

The ripper 60 may be formed in a comb-like configuration to more reliably prevent bonding of the melted lower surface of the gussasphalt layer 14 onto the ripper 60.

A system configuration and an operation process for implementing an asphalt pavement peeling method according to a second embodiment of the present invention, and a function and effect thereof, will be described below.

The second embodiment is based on a system in which the Teflon™ coating 70 is not formed on the upper surface of the claw member 68 attached onto the upper surface of the base member 66 of the ripper 60 in the first embodiment. Thus, in the following description, the same element or component as that in the first embodiment is defined by the common reference numeral or code, and its description will be omitted on a case-by-case basis.

As shown in FIG. 8, a ripper 76 comprises a wedge-shaped thermally-conductive base member 66 made of a steel material, and a sharp-pointed claw member 68 made of iron and attached onto an upper surface of the base member 66 in a replaceable manner. The ripper 76 is formed to have a lateral width less than the asphalt block width $L_2$.

The claw member 68 is replaceable. Thus, even if a tip of the claw member 68 is rounded off due to a long-term peeling operation, the claw member 68 can be replaced with new one. Alternatively, the claw member 68 may be detached to reshape the tip, and reused.

Further, a heater 78 serving as separating means is incorporated into the base member 66. The heater 78 is adapted to instantaneously heat the claw member 68 in response to an electric power supplied from an electric double-layer capacitor.

In the second embodiment, an asphalt pavement 22 is peeled off from a steel plate 12, and extracted, according the process in FIGS. 5(A) to 5(C), in the same manner as that in the first embodiment. However, when a temperature of a lower surface of an asphalt block 24 is lowered in the state illustrated in FIG. 5(C), the lower surface of the asphalt block 24 is bonded onto the ripper 76.

This eliminates a risk that the asphalt block 24 drops off from the ripper 76 when an arm 62 is turned about 10 to 30 degrees to a position directly above a lane 30C, in the state illustrated in FIG. 6(D).

Then, in the state illustrated in FIG. 6(E), the claw member 68 is instantaneously heated by the heater 78 to reduce a bonding force between the lower surface of the asphalt block 24 and an upper surface of the claw member 68, and separate the asphalt block 24 from the ripper 76. Then, the asphalt block 24 is temporarily stored, for example, on a square timber or a sheet having a surface subjected to a treatment for preventing bonding of melted asphalt.

As above, the second embodiment can obtain approximately the same effects as those in the first embodiment. In addition, the bonding of the asphalt block 24 onto the ripper 76 and the separation of the asphalt block 24 from the ripper 76 can be controlled to prevent drop-off of the asphalt block 24 from the ripper 76 during the asphalt-pavement removing operation and other operation.

In the second embodiment, the claw member 68 is heated using the heater 78 to separate the asphalt block 24 from the ripper 76. Alternatively, any other suitable heating means capable of reducing the bonding force between the lower surface of the asphalt block 24 and the upper surface of the claw member 68 may be used. The electric double-layer capacitor used as a power source makes it possible to instantaneously heat the claw member 68 so as to quickly complete the separation.

Alternatively, the separation may be achieved by mechanically pushing out the asphalt block 24 using a piezoelectric device provided on the upper surface of the claw member 68, or a push-out mechanism comprising a hydraulic jack or an electric motor. The piezoelectric device is excellent in operational response and energy efficiency. If a push-out stroke is insufficient, the piezoelectric device may be used in a multiple structure.

A system configuration for implementing an asphalt pavement peeling method according to a third embodiment of the present invention will be described below.

The second embodiment is based on a system in which the same peeling member as the ripper 60 in the first embodiment is provided at a leading end of a self-propelled carriage 80. Thus, in the following description, the same element or component as that in the first embodiment is defined by the common reference numeral or code, and its description will be omitted on a case-by-case basis.

As shown in FIG. 9, a carriage 80 having a chevron-shaped low-gradient upper surface is driven onto a steel plate 12. As a traveling unit, the carriage 80 is provided with a Caterpillar™ 84 powered by electricity or an internal combustion engine. The Caterpillar™ 84 is made of rubber to sufficiently obtain a reaction force in a horizontal direction during an after-mentioned operation of inserting a ripper 82 into a melted layer 74.

The ripper 82 is provided at a leading end of the carriage 80. The ripper 82 comprises a base member 86, a claw member 88 and a Teflon™ coating 90 each made of the same material as that of the ripper 60 in the first embodiment, wherein a lateral width of the ripper 82 is set to be less than the asphalt block width $L_2$.

A tip of the ripper 82 can be moved in an upward-downward direction by stretching and retracting motions of a hydraulic cylinder 96. This allows the ripper 82 to be inserted into an adequate position of the melted layer 74. In addition, the tip of the ripper 82 can be set at a lifted position during a traveling operation other than a peeling operation, to prevent the ripper 82 from hindering traveling of the carriage 80.

The carriage 80 includes a belt conveyer 92 which is disposed to extend along the chevron-shaped upper surface thereof, and adapted to be moved in a direction indicated by the arrow 94 so as to transfer an asphalt block 24 in a rightward direction in FIG. 9.

An operation process for implementing the asphalt pavement peeling method according to the third embodiment will be described below.

In the third embodiment, one coil unit 32 is placed on a zone B of a segmental asphalt pavement 22 to be firstly peeled off, and pulled by one dump truck 18. That is, the peeling operation is performed on a strip-by-strip basis.

Firstly, as shown in FIG. 9, immediately after a lower surface of a gussasphalt layer 14 is melted in the same manner as that in the first embodiment, the carriage 80 is moved in the peeling direction 20 to insert the ripper 82 into the melted layer 74.

When the lower surface of the gussasphalt layer 14 comes into contact with an upper surface of the thermally-conductive ripper 82, it will be is cooled down to a temperature causing no re-bonding (in gussasphalt, the temperature is generally about 70° C.), within a relatively short period of time. Further, the ripper 60 has the Teflon™ coating 90 formed on the upper surface thereof. Thus, when a temperature of a lower surface of the gussasphalt layer 14 is lowered, the lower surface of the gussasphalt layer 14 is not bonded onto the ripper 82.

The peeled asphalt pavement 22 is moved obliquely upwardly along the gradient of the upper surface of the ripper 82. Thus, an upper surface of the peeled asphalt pavement 22 is bent in a region directly above the tip of the ripper 82 to create a crack at a position around the tip of the ripper 82.

Then, a lower end of a right edge of the peeled asphalt pavement 22 is placed on the belt conveyer 92, and thereby the peeled asphalt pavement 22 is pulled upwardly in a direction indicated by the arrow 98. As a result, the peeled asphalt pavement 22 is completely fragmented, and extracted as an asphalt block 24.

Then, the extracted asphalt blocks 24 are transferred in the rightward direction by the belt conveyer 92, and sequentially placed on the steel plate 12 at a position on a trailing side relative to the carriage 80. Each of the upper surface of the carriage 80 and the belt conveyer 92 has a gentle falling gradient, and therefore each of the extracted asphalt blocks 24 can be gently placed on the steel plate 12

A function and effect of the asphalt pavement peeling method according to the third embodiment will be described below.

The third embodiment can obtain approximately the same effects as those in the first embodiment. In addition, after peeling the segmental asphalt pavement 22, the asphalt blocks 22 are temporality stored on the steel plate 12 at the position on the trailing side relative to the carriage 80, as shown in FIG. 9. Thus, an operation of loading the asphalt blocks 24 into a dump truck or other transportation means can be performed after completion of the peeling operation. In the third embodiment, the carriage 80 may be provided for each of three asphalt pavement strips 30A, 30B, 30C to simultaneously perform the peeling operation therefor.

In the third embodiment, there is not any need for turning movements as in the backhoe 64. This makes it possible to perform a continuous peeling operation with higher efficiency as compared with the first embodiment so as to increase a speed of the peeling operation.

In the third embodiment, the peeled asphalt pavement 22 is fragmented by pulling it in the direction indicated by the arrow 98, using the belt conveyer 92. Alternatively, the peeled asphalt pavement 22 may be fragmented by lifting the tip of the ripper 82 upwardly, as shown in FIG. 10.

Each of the carriage 80 and the ripper 82 may be designed to variously change a lateral width thereof so as to cope with various asphalt block widths $L_2$.

The traveling of the carriage 80 based on the Caterpillar™ 84 may be manually manipulated using a control box provided in the carriage 80, or may be remotely manipulated. Further, the carriage 80 may be a wheelie type, wherein the carriage 80 may be pulled by the dump truck 18.

A system configuration for implementing an asphalt pavement peeling method according to a fourth embodiment of the present invention will be described below.

The fourth embodiment is based on a system in which the cutting blade, the coil unit 32 and the ripper 60 in the first embodiment are integrally provided in a single vehicle. Thus, in the following description, the same element or component as that in the first embodiment is defined by the common reference numeral or code, and its description will be omitted on a case-by-case basis.

As shown in FIG. 11, a van-type vehicle 100 is driven onto an asphalt concrete layer 16 of an asphalt pavement 22 provided on a steel plate 12. The vehicle 100 is equipped with a high-frequency power generating unit 46 and a power generator 48.

The vehicle 100 has a disc saw-type cutting blade 102 provided at a center thereof and adapted to form a cut line 72 in the asphalt pavement 22. The cutting blade 102 is provided in a lower portion of a vehicle body of the vehicle 100, and adapted to be moved in an upward-downward direction so as to adjust a depth of the cut line 72.

The vehicle 100 also has a coil unit 104 fixed to a lower surface of a chassis thereof at a position on a trailing side relative to the cutting blade 102. The coil unit 104 is the same as that the coil unit 32 in the first embodiment, except that the coil unit 104 is devoid of the wheels 44.

The vehicle 100 further has a cutting blade 106 provided at a rear end of the vehicle body to protrude downwardly in such a manner that a tip of the cutting blade 106 is located in adjacent relation to an upper surface of the asphalt concrete layer 16.

The vehicle 100 further has a support member 108 provided on an upper side of the rear end the vehicle body to protrude from the vehicle body in a trailing direction, and adapted to be moved in an upward-downward direction indicated by the arrows 112, 114. The support member 108 is also adapted to be stretched and retracted in a leading-trailing direction indicated by the arrows 116, 118 to allow a pin 110 provided at a trailing end of the support member 108 to be moved in the leading-trailing direction An upper end of an arm member 120 is rotatably connected to the trailing end of the support member 108 through the pin 110. The arm member 120 is adapted to be swingably moved in directions indicated by the arrows 122, 124 by a driving unit (not shown).

A ripper 126 is attached to a lower end of the arm member 120. The ripper 126 comprises a wedge-shaped thermally-conductive base member 128 made of a steel material, a claw member 68 made of iron and attached onto an upper surface of the base member 128, and a Teflon™ coating 70 formed on an upper surface of the claw member 68. The ripper 60 is formed to have a lateral width less than the asphalt block width $L_2$, as with the ripper 60 in the first embodiment. The ripper 126 is formed to have a lateral width less than the asphalt block width $L_2$. The claw member 68 is attached to the arm member 120 in such a manner that a tip thereof is oriented toward the vehicle body. Thus, according to the swing movement in the direction indicated by the allow 122, the ripper 126 can be inserted into a melted layer of a lower surface of a gussasphalt layer 14.

An operation process for implementing the asphalt pavement peeling method according to the fourth embodiment will be described below.

Firstly, as shown in FIG. 11, the cut line 72 is formed in the asphalt pavement 22 to segment the asphalt pavement 22 by the asphalt block width $L_2$.

Then, immediately after melting a lower surface of the gussasphalt layer 14 segmented by the asphalt block width $L_2$, in the same manner as that in the first embodiment, the arm is swingably moved in the direction indicated by the arrow 120 to insert the ripper 126 into the melted layer 74 so as to peel off the segmental asphalt pavement 22 from the steel plate 12. An adjustment of an insertion position in an upward-downward direction is performed by moving the support member 108 in the upward-downward direction.

Then, due to the insertion of the ripper 126, a crack is created to extend upwardly from a lower surface of the segmental asphalt pavement 22 at a position adjacent to the tip of the ripper 126. In this state, when the ripper 126 is lifted upwardly, an upper surface of the segmental asphalt pavement 22 comes into contact with and cut off by the cutting blade 10 at a position directly above the crack, so that the segmental asphalt pavement 22 can be extracted in the form of an asphalt block 24.

Then, the support member 108 is stretched in the direction indicated by the arrow 118 to move the ripper 126 in a training direction while maintaining the ripper 126 in a posture for lifting up the asphalt block 24. After the movement in the trailing direction, the arm 120 is swingably moved in the direction indicated by the arrow 124 to gently place the asphalt block 24 on the steel plate 12.

A function and effect of the asphalt pavement peeling method according to the fourth embodiment will be described below.

The fourth embodiment can obtain approximately the same effects as those in the first embodiment. In addition, all the devices or components can be integrated together, as shown in FIG. 11, to achieve excellent mobility.

In the second embodiment, the ripper 126 is designed to have the same structure as that of the ripper 60 in the first embodiment. Alternatively, the ripper 126 may be designed to have the same structure as that of the ripper 76 in the second embodiment.

In the first to fourth embodiments, each of the base members 66, 86, 128 of the rippers 60, 76, 82, 126 is formed as a thermally-conductive member. Each of the base members may be made of a material having higher thermal conductivity. Further, a cooling fin or a cooling fan may be provided on the side of a back surface of the ripper to quickly cool the melted lower surface of the asphalt block 24 so as to increase a speed of the peeling operation In the first to fourth embodiments, the claw member (68, 88) is made of iron. Alternatively, any other suitable material which has heat resistance, thermal conductivity, and hardness capable of preventing the tip of the claw member from being rounded, may be used.

In the first to fourth embodiments, the ripper (60, 76, 82, 126) is formed in a wedge shape. Alternatively, any other suitable shape having at least a sharp tip may be used. For example, as shown in FIG. 12, a ripper 130 having a cutting blade shape only in a tip portion although a body has an even thickness, may be used.

In order to facilitate the insertion of the ripper (60, 76, 82, 126) into the melted layer 74, the ripper may be designed to vibrate the tip of the claw member (68, 88). In this case, vibration in an upward-downward direction is likely to cause damage of the steel plate or generation of noise. Thus, the ripper is preferably designed to vibrate the tip in a horizontal direction.

An inclination of the upper surface of the ripper (60, 76, 82, 126) may be increased to facilitate creation of a crack in the segmental asphalt pavement 22 when the ripper is inserted into the melted layer 74. Further, in the operation of fragmenting the peeled asphalt pavement 22, a wedge-shaped cutting blade may be pressed from above, or a cut line may be preformed by the cutting blade.

Specifications (e.g., a sectional diameter of a conductor of the coil, a diameter of the coil and the number of turns in the coil) of the electromagnetic induction coil 36 may be determined depending on a thickness of a target asphalt pavement (a distance between the upper surface of the steel plate 12 and the lower surface of the electromagnetic induction coil 36) and a melting temperature of a lower surface of the target asphalt pavement.

A sectional diameter of a conductor of the coil, a diameter of the coil and/or the number of turns in the coil may be increased to provide enhanced heating capability of the electromagnetic induction coil 36 relative to the steel plate 12. Further, a litz wire may be used as the coil conductor, or a device for cooling the electromagnetic induction coil 36 may be provided, to provide enhanced heating capability.

A mechanism for adjusting an installation height of the electromagnetic induction coil 36 may be provided in the coil unit (32, 104). In this case, the installation height of the electromagnetic induction coil 36 can be changed to adjust the heating capability relative to the steel plate 12.

Some of the above embodiments have shown an example where the coil unit 32 is pulled by the dump truck 18. Alternatively, the coil unit 32 is pulled using any type of vehicle other than the dump truck. Further, the coil unit 32 may be designed as a self-propelled type, or the coil unit 32 may be attached to a lower surface of a chassis of the dump truck 18.

A device for reciprocatingly moving the electromagnetic induction coil 36 within the coil unit (32, 104) in the lateral direction on a periodic basis may be provided, and the number of electromagnetic induction coils 36 may be reduced. This makes it possible to cope with various asphalt block widths $L_2$ in an easy manner.

In FIG. 7, the two coil units 32 are connected to each other in the lateral direction to allow the two zones B, C of the segmental asphalt pavements 22 to be simultaneously heated. Alternatively, the two coil units 32 may be connected in offset relation to each other in the peeling direction 20 to pull the two coil units 32 by the dump truck 18 in such a manner as to move the coil unit 32 for the zone B in a leading manner relative to the coil unit 32 for the zone C. In this case, immediately after completion of the heating, the ripper (60, 76) can be inserted into the melted layer 74 in each of the lanes 30A, 30B at a more adequate timing. Alternatively, a combination of the dump truck 18 and the coil unit 32 may be arranged on each of the lanes 30A, 30B in such a manner as to pull the coil unit 32 by the corresponding dump truck 18.

In the first to fourth embodiments, the width of the ripper (60, 76, 82, 126) is set to be less than the asphalt block width $L_2$. Preferably, the width of the ripper is variable.

Although some of the above embodiments have shown an example where the ripper (60, 76) is attached to the distal end of the arm 62 of the backhoe 64, the present invention is not limited thereto, but may be applied to any other suitable type of vehicle having a turnable arm allowing the ripper (60, 76) to be attached thereto.

An asphalt pavement removing method, an asphalt pavement removing system and an electromagnetic induction coil unit, according to a fifth embodiment of the present invention, will be described below.

As shown in FIG. 16, in an asphalt pavement removing system 250, a gussasphalt layer 14 having a thickness of 35 mm and an asphalt concrete layer 16 having a thickness of 40 mm, which are made up of an asphalt pavement 22, are laminated on a steel plate 12 serving as an upper member of a steel plate deck of a bridge and having a thickness of 12 mm, in this order, to form an asphalt pavement 22, as with the first embodiment.

A 10-ton capacity dump truck 254 serving as a transportation vehicle is driven onto the asphalt concrete layer 16. Specifically, the dump truck 254 is arranged on a leading side relative to a position for extracting an after-mentioned asphalt block 256, in a forward traveling direction of the dump truck 254.

In the fifth embodiment, the forward traveling direction of the dump truck 254 corresponds to a progress direction 252 of an operation of the asphalt pavement removing system 250. Further, a horizontal direction orthogonal to the progress direction 252 will hereinafter be referred to as "road width direction". Further, as shown in FIG. 17(B), a length of an asphalt block 256 to be extracted as a plate-shaped rectangular block, in the progress direction 252, and a length of the asphalt block 256 in the road width direction, will hereinafter be referred to respectively as "asphalt block length $S_1$" and "asphalt block width $S_2$".

As shown in FIG. 17(A), a first cut line 258 parallel to the progress direction 252 is formed in the asphalt pavement 22 using a cutting blade 262 of a cut-line forming device as a first cut-line forming device to segment the asphalt pavement 22 by a given width (asphalt block width $S_2$).

As shown in FIG. 18(A), the cut-line forming device 260 is disposed on a leading side relative to a Caterpillar™-type traveling carriage 264 placed on the asphalt pavement 22 at a position on a training side relative to the dump truck 254

A rail member 268 is hung from a distal end of a support member 266 protruding from a front end of the traveling carriage 264. The rail member 268 is disposed to extend in the road width direction. Further, a movable member 270 is provided in such as manner as to be moved along the rail member 268.

An arm member 272 is disposed to penetrate through the movable member 270, and adapted to be selectively moved toward leading and trailing sides of the progress direction by a driving unit (not shown).

The cut-line forming device 260 and a measurement device 274 operable to measuring a thickness of the asphalt pavement 22 are fixed to opposite ends of the arm member 272, respectively. The measurement device 274 is disposed on the leading side of the progress direction 252, and the cut-line forming device 260 is disposed on the trailing side of the progress direction 252. That is, in conjunction with the movement of the arm member 272 toward the leading or trailing sides, the measurement device 274 and the cut-line forming device 260 are simultaneously moved toward the leading or trailing sides.

The measurement device 274 is adapted to be moved in an upward-downward direction so as to adjust a height position thereof.

The cut-line forming device 260 is adapted to be moved in an upward-downward direction so as to adjust a cut depth of the cutting blade 262 thereof.

In an operation of forming the first cut line 258 in the asphalt pavement 22, as shown in FIG. 18(A), the arm member 272 is firstly moved relative to the movable member 270 toward the trailing side of the progress direction 252 to allow the cut-line forming device 260 to reach a trailing most position relative to the movable member 270. During this operation, the cut-line forming device 260 is moved to an upper position where the cutting blade 262 is not in contact with the asphalt pavement 22. FIG. 18(A) shows a state after the first cut line 258 has already formed to a position directly below the cut-line forming device 260

Then, a distance (thickness of the asphalt pavement 22) to the steel plate 12, or an appendage provided on the steel plate, such as a splice plate 276, a bolt 278 joining the splice plate 276 to the steel plate, or a manhole, is measured by the measurement device 274.

Then, as shown in FIG. 18B, the cut-line forming device 260 is moved downwardly while rotating the cutting blade 262 thereof, so that the asphalt pavement 22 is cut by the cutting blade 262 to form the first cut line 258. In order to allow the first cut line 258 to have a depth which approximates to a distance to the steel plate 12 or the appendage provided on the steel plate 12 as close as possible and fails to reach the steel plate 12 or an appendage, the height position of the cut-line forming device 260 is adjusted based on a thickness of the asphalt pavement 22 measured by the measurement device 274.

Then, as shown in FIG. 18(C), the arm member 272 is moved relative to the movable member 270 toward the leading side of the given direction 252 while continuing the cutting of the asphalt pavement 22 by the cutting blade 262, to form the first cut line in a leading region of the asphalt pavement 22. During this operation, the height position of the cut-line forming device 260 is continuously adjusted based on a thickness of the asphalt pavement 22 measured by the measurement device 274, in such a manner as to allow the first cut line 258 formed using the cutting blade 262 to have a depth which approximates to a distance to the steel plate 12 or an appendage provided on the steel plate 12 as close as possible and fails to reach the steel plate 12 or the appendage.

Then, as shown in FIG. 18(D), the cut-line forming device 260 is moved to reach a leading most position relative to the movable member 270.

The measurement device 274 may be any type capable of sensing metal and measure a distance to the metal. An electromagnetic induction-type measurement device is suitable as the measurement device 274. In use of an electromagnetic wave-type measurement device, there is a concern about false measurement due to reflection of an electromagnetic wave at a position, such as a position of drainage pavement containing water, causing a rapid change in permittivity. In contrast, the electromagnetic induction-type measurement device based on sensing of metal can prevent such false measurement.

In the fifth embodiment, the depth of the first cut line 258 formed using the cutting blade 262 is set at a value which approximates to a distance to the steel plate 12 or an appendage provided on the steel plate 12 as close as possible and fails to reach the steel plate 12 or the appendage. As one aspect, the depth of the first cut line 258 may be set at a value which fails to reach the steel plate 12 or an appendage provided on the steel plate 12. However, an after-mentioned operation of fragmenting and extracting the segmental asphalt pavement 22 in the form of an asphalt block 256 is more facilitated by setting the depth of the first cut line 258 at a value which approximates to a distance to the steel plate 12 or an appendage provided on the steel plate 12 as close as possible.

As another aspect, the first cut line 258 may be formed to have a constant depth from an upper surface of the asphalt pavement 22. For example, in cases where the constant depth is set based on a position slightly shallower than a depth reaching a head of a bolt 278 located at the shallowest position, the first cut line 258 is preferably formed to leave the segmental asphalt pavement 22 by a thickness of about 20 mm from an upper surface of the steel plate 12.

The cut-line forming device 260 may be any type capable of forming the first cut line 258 in the asphalt pavement 22. For example, a pushing and cutting blade may be used as well as the cutting blade 262, such as a diamond cutter.

Typically, one lane of a road has a width of about 3,500 mm. Thus, for example, the asphalt block width $L_2$ and the asphalt block length $L_1$ may be set, respectively, in the range of 1,000 to 1,800 mm and in the range of 600 to 1,200 mm, and the first cut line 258 may be formed to segment the asphalt pavement 22 into two or three parts. FIG. 17(A) shows one example where the asphalt pavement 22 is segmented into three parts.

The number and arrangement of cut-line forming devices 260 may be determined depending on the number of first cut lines 258 (the number of division of the asphalt pavement 22 in the road width direction).

As shown in FIG. 16, the same coil unit 32 as that in the first embodiment is placed on an upper surface of the asphalt concrete layer 16 at a position on the trailing side relative the traveling carriage 264. In the fifth embodiment, the coil unit 32 serves as an electromagnetic induction coil unit as a softened-layer forming device. Specifically, in the asphalt pavement removing system 250, the coil unit 32 is operable to subject the steel plate 12 to electromagnetic induction heating so as to form, in the asphalt pavement 22, a softened layer having a lower in contact with the steel plate 12.

As shown in FIG. 2(B), the coil unit 32 comprises a first coil group consisting of two electromagnetic induction coils 36 arranged in side-by-side relation to each other, a second coil group consisting of three electromagnetic induction coils 36 arranged in side-by-side relation to each other, and a frame member 34 adapted to allow the first and second coil groups to be fixed thereto.

The electromagnetic induction coils 36 in the first coil group are disposed on the leading side of the progress direction 252 (in FIG. 2(B), the peeling direction 20) and arranged in side-by-side relation to each other in a direction intersecting the progress direction 252.

The electromagnetic induction coils 36 in the second coil group are disposed on the opposite side relative to the first coil group with respect to the progress direction 252 and arranged in side-by-side relation to each other in a direction intersecting the progress direction 252.

The first coil group is disposed in the frame member 34 in offset relation to the second coil group, in such a manner that a center of each of the electromagnetic induction coils 36 in the first coil group is located between respective centers of adjacent ones of electromagnetic induction coils 36 in the second coil groups.

As above, the electromagnetic induction coils 36 in each of the first and second coil groups are arranged in side-by-side relation to each other. This makes it possible to heat the entire surface of a portion of the steel plate 12 located directly below the coil unit 32.

An eddy current is not sufficiently produced in a portion of the steel plate 12 located directly below a center of an electromagnetic induction coil 36, and thereby heating at this portion goes down. In the fifth embodiment, the first coil group is disposed in the frame member 34 in offset relation to the second coil group, in such a manner that a center of each of the electromagnetic induction coils 36 in the first coil group is located between respective centers of adjacent ones of the electromagnetic induction coils 36 in the second coil group. Thus, when the heating is continuously performed while moving the coil unit 32 in the progress direction 252, portions of the steel plate 12 which have not been able to be sufficiently heated by the electromagnetic induction coils 36 in the first coil group can be subsequently heated by the electromagnetic induction coils 36 in the second coil group located on the trailing side relative to the first coil group, so that the entire surface of the steel plate 12 can be evenly heated.

In addition, the number of the electromagnetic induction coils 36 in the second coil group located on the trailing side of the progress direction 252 is greater than that of the electromagnetic induction coils 36 in the first coil group located on the leading side of the progress direction 252. This makes it possible to strongly heat a larger area of the steel plate 12 until just before the asphalt pavement 22 is peeled off from the steel plate 12.

With a view to enhance heating efficiency of the electromagnetic induction coils 36, a lower surface of each of the electromagnetic induction coils 36 is disposed in adjacent relation to the upper surface of the asphalt concrete layer 16 as close as possible to reduce a distance between the upper surface of the steel plate 12 or an appendage provided on the steel plate 12 and the lower surface of the electromagnetic induction coil 36. In the fifth embodiment, a distance H between the upper surface of the steel plate 12 and the lower surface of the electromagnetic induction coil 36 is set at 100 mm. That is, a gap of 25 mm exists between the upper surface of the asphalt concrete layer 16 and the lower surface of the electromagnetic induction coil 36.

As shown in FIG. 16, a high-frequency power generating unit 46 for supplying a high-frequency power to the electromagnetic induction coils 36 via an electric cable 58, and a power generator 48 serving as a power source of the high-frequency power generating unit 46, are mounted on a loading platform of the traveling carriage 264.

Two belt conveyers 280A, 280B serving as a transfer device are disposed above the traveling carriage 264 and on the respective leading and trailing sides of the progress direction 252, and arranged in side-by-side relation to each other. The belt conveyers 280A, 280B are operable to transfer an extracted asphalt block 256 in a direction from a rear end to a front end of the traveling carriage 264, and load the asphalt block 256 into a loading platform of the dump truck 254. That is, the belt conveyers 280A, 280B serving as the transfer device are disposed above the coil unit 32 and the cut-line forming device 260 to transfer an extracted asphalt block 256 to a position on the leading side relative to a position R where the asphalt block 256 is extracted.

An upper end of an actuator 282 having a lower end rotatably fixed to the front end of the traveling carriage 264 is rotatably fixed to an approximately center of a leading-side one 280A of the two belt conveyers 280A, 280B. According to stretching and retracting motions of the actuator 282, a leading portion of the belt conveyer 280A is moved in an upward-downward direction, and toward the leading and trailing sides of the progress direction to allow the asphalt block 256 to be transferred to a given position of the loading platform of the dump truck 254.

A supporting column 284 is fixed to an rear end of the loading platform of the dump truck 18 to protrude downwardly, and a connection portion 286 provided in the vicinity of a lower end of the supporting column 284 is coupled to a connection portion 54 provided on a leading side of the coil unit 32, through a pulling wire 56.

A small turning-type backhoe 64 having an arm 62, and an upper/lower-surface clamping device 292 attached to a distal end of the arm 62 to serve as the holding means, is driven onto the steel plate 12 at a position on the trailing side relative to the coil unit 32, wherein the upper/lower-surface clamping device 292 comprises a ripper 288 serving as a peeling member 60, and a clamping member 290. The clamping member 290 has a cutting blade 298 provided on a distal end thereof. A combination of the upper/lower-surface clamping device 292 and the backhoe 64 makes up an extraction device.

The ripper 288 comprises a wedge-shaped thermally-conductive base member 66, a sharp-pointed claw member 68 made of iron and attached onto an upper surface of the base member 66 in a replaceable manner, and a Teflon™ coating 70 formed on an upper surface of the claw member 68. A width of the ripper 60 in the road width direction is set to be less than the asphalt block width $L_2$.

An upper portion of a support plate 294 is rotatably fixed to a distal end of the arm 62 of the backhoe 64. The ripper 288 has a base end fixed to a lower portion of the support plate 294. The clamping member has a base end rotatably fixed to an approximately central portion of the support plate 294. An upper end of an actuator 296 rotatably fixed to an approximately central region of an upper surface of the clamping member 290 is rotatably fixed to the upper portion of the support plate 294.

The clamping member 290 can be opened and closed according to stretching and retracting motions of the actuator 296, in such a manner as to clamp upper and lower surfaces of an asphalt block 256 between the ripper 288 and the clamping member 290, and form a cut line in the asphalt pavement 22 by the cutting blade 298. That is, a combination of the actuator 296 and the clamping member 290 provided with the cutting blade 298 makes up a second-cut-line forming device.

As described above, the asphalt pavement removing system 250 illustrated in FIG. 16 comprises the cut-line forming device 260, the coil unit 32 serving as a softened-layer forming device, the extraction device made up of the upper/lower-surface clamping device 292 and the backhoe 64, the belt conveyers 280A, 280B serving as a transfer device, and the dump truck 254 serving as a transportation vehicle.

A process of removing the asphalt pavement 22 will be described below.

In advance of start of the removing operation, a part of the asphalt pavement 22 serving as a space for placing the backhoe 64 and the ripper 288 on the steel plate 12 is removed.

In the process of removing the asphalt pavement 22, as shown in FIG. 17(A), four first cut line 258 parallel to the progress direction 252 are firstly formed in the asphalt pavement 22 using the cutting blade 262 of the cut-line forming device 260 as a first cut-line forming device, to segment a width of the asphalt pavement 22 into three segmental widths (three asphalt block widths $S_2$). Thus, the asphalt pavement 22 is segmented into three lanes 300A, 300B, 300C (the lanes 300A, 300B, 300C are arranged in a left-to-right direction when viewed in the progress direction). If respective outer edges of the lanes 300A, 300C have already been cut off, it is not necessary to form the first cut lines 258 for defining the outer edges of the lanes 300A, 300C.

Each of the first cut lines 258 are formed through the process illustrated in FIG. 18. Specifically, a thickness of the asphalt pavement 22 is measured using the measurement device 274 (measurement step), and the first cut line 258 is formed to have a depth less than the measured thickness of the asphalt pavement 22. Thus, the first cut line 258 has a depth which approximates to a distance to the steel plate 12 or an appendage provided on the steel plate 12 as close as possible and fails to reach the steel plate 12 or an appendage.

Then, as shown in FIG. 17(A), the two coil units 32 connected to each other in the road width direction are placed on the segmental asphalt pavements 22 to be firstly fragmented. Both the coil units are pulled by the traveling carriage 264.

Then, when a high-frequency power is supplied from the high-frequency power generating unit 46 to the electromagnetic induction coils 36 of the coil units 32 via the electric cable 58, an eddy current based on electromagnetic induction is produced in a region of the steel plate 12 located directly below the coil units 32 to generate heat due to an electric resistance of the steel plate 12.

As a result, a softened layer 302 having a lower layer in contact with the steel plate 12 heated by the electromagnetic induction heating is formed in the gussasphalt layer 14 (softened-layer forming step).

A thickness of the softened layer 302 is appropriately determined depending properties and the thickness of the asphalt pavement 22, and the high-frequency power to be supplied to the electromagnetic induction coils 36 is adjusted to allow the softened layer 302 to have the determined thickness. Thus, the softened layer 302 may be formed only in the gussasphalt layer 14, or may be formed in both the gussasphalt layer 14 and the asphalt concrete layer 16. That is, the point is to form a softened layer 302 having a lower layer in contact with the steel plate 12.

The high-frequency power to be supplied to the electromagnetic induction coils 36 may be adjusted in such a manner that a temperature of a softened layer formed in the asphalt pavement 22 is set at 55° C. or more. This makes it possible to allow the softened layer 302 formed in the asphalt pavement 22 to have a viscosity suitable for peeling the asphalt pavement 22 from the steel plate 22, and a thickness of about 10 mm or more.

In a hot asphalt mixture using modified asphalt, and a hard asphalt mixture using gussasphalt, which are typical asphalt for roads, the hot asphalt mixture is melted at 80° C., and the hard asphalt mixture is melted at 96° C.

Thus, preferably, the high-frequency power to be supplied to the electromagnetic induction coils 36 may be adjusted in such a manner that a temperature of a softened layer formed in the asphalt pavement 22 may be set at 80° C. or more for the hot asphalt mixture, and at 96° C. or more for the hard asphalt mixture, so as to facilitate peel-off of the asphalt pavement 22 from the steel plate 12.

Even if the lower surface of the asphalt pavement 22 reaches a high temperature of 80° C. or more in the above manner, the softened layer 302 is formed to extend upwardly from the upper surface of the steel plate 12 by a thickness of about 16 mm or less, and therefore most of the asphalt pavement is in a solid state. Thus, the segmental asphalt pavements can be fragmented and extracted in the form of an asphalt block.

Then, as shown in FIG. 17(B), in a state after the softened layer 202 is formed in the gussasphalt layer 14, the traveling carriage 264 is moved forwardly to pull the coil units 32 so as to move the coil units 32 in the given direction by the asphalt block width $S_2$.

During this operation, the heating is continuously performed while moving the coil units 32 in the progress direction 252, so that portions of the steel plate 14 which have not been able to be sufficiently heated by the electromagnetic induction coils 36 in the leading-side first coil group can be subsequently heated by the electromagnetic induction coils 36 in the trailing-side second coil group. Thus, the entire surface of the steel plate 12 can be evenly heated to more reliably form the softened layer 302 in each of the segmental asphalt pavements 22.

Then, as shown in FIG. 19(A), immediately after the softened layer 302 is formed in the gussasphalt layer 14, the ripper 288 serving as a peeling member is inserted between the steel plate 302, and the softened layer formed in the gussasphalt layer 14 of the lane 300A. In this operation, the ripper 288 may be inserted into a region of the softened layer 302 adjacent to the upper surface of the steel plate 12.

In the fifth embodiment, the insertion of the ripper 288 is performed by moving the backhoe 64 forwardly or operating the arm 62. Alternatively, a mechanism for moving the ripper 288 in the leading-trailing direction may be provided in the upper/lower surface clamping device 292 to perform the insertion.

Then, as shown in FIG. 19(B), the actuator 296 is stretched to close the clamping member 290 so as to clamp the segmental asphalt pavement 22 from the side of upper and lower surfaces thereof, using the ripper 288 and the clamping member 290. Thus, the cutting blade 298 provided on the distal end of the clamping member 290 presses and cuts the segmental asphalt pavement to form a second cut line intersecting the first cut line 258 (second-cut-line forming step).

The second cut line is formed to have a depth which approximates to a distance to the steel plate 12 or an appendage provided on the steel plate 12 as close as possible and fails to reach the steel plate 12 or an appendage. As one aspect, the depth of the second cut line may be set at a value which fails to reach the steel plate 12 or an appendage provided on the steel plate 12. However, an after-mentioned operation of fragmenting and extracting the segmental asphalt pavement 22 in the form of an asphalt block 256 is more facilitated by setting the depth of the first cut line 258 at a value which approximates to a distance to the steel plate 12 or an appendage provided on the steel plate 12 as close as possible.

For example, the second cut line is preferably formed to extend up to a position slightly shallower than a depth reaching a head of a bolt 278 (see FIG. 18(A)) located at the shallowest position. Specifically, the second cut line is preferably formed to leave the segmental asphalt pavement 22 by a thickness of about 20 mm from the upper surface of the steel plate 12.

Then, as shown in FIG. 19(C), the upper/lower surface clamping device 292 holding the segmental asphalt pavement 22 is lifted upwardly. Thus, the softened layer 302 formed in the segmental asphalt pavement 22 is peeled off from the steel plate 12 in contact therewith, and the segmental asphalt pavement 22 is fragmented and extracted in the form of an asphalt block having a given size (extraction step). This state is shown in FIG. 17(B).

The segmental asphalt pavement 22 has the second cut line formed by the cutting blade 298 provided on the distal end of the clamping member 290. Thus, the extracted asphalt block 256 is formed as a plate-shaped rectangular block.

Then, as shown in FIG. 19(D), the asphalt block 256 is further lifted and moved upwardly, and unloaded onto the belt conveyer 280B provided above the traveling carriage 264 (moving step). This state is shown in FIG. 17(C).

Then, the asphalt block 256 unloaded onto the belt conveyer 280B in the moving step after being extracted in the extraction step is transferred in the direction from the rear end to the front end of the traveling carriage 264 by the belt conveyers 280A, 280B, and loaded into the loading platform of the dump truck 254 (transfer step). That is, an asphalt block 256 extracted in the extraction step is transferred to a position on the leading side relative to the position R where the asphalt block 256 is extracted.

As above, through the above process (the softened-layer forming step, the extraction step, the moving step and the transfer step), the segmental asphalt pavement 22 provided on the steel plate 12 in the lane 300A is peeled off from the steel plate 12, and removed in the form of the asphalt block 256 having a given size.

Then, in the same process (FIGS. 19(A) to 19(D)) as that of removing the asphalt block 256 from the segmental asphalt pavement in the lane 300A, an asphalt block 256 is removed from each of the remaining segmental asphalt pavements in the lanes 300B, 300C. The extraction step is performed plural times in each of the lanes 300A, 300B, 300C. Thus, a plurality of the second cut lines will be formed in each of the segmental asphalt pavements in the three lanes.

FIG. 17(D) shows a state when an asphalt block 256 fragmented and extracted from the segmental asphalt pavement in the lane 300B is unloaded onto the belt conveyer 280B, and FIG. 17(E) shows a state when an asphalt block 256 fragmented and extracted from the segmental asphalt pavement in the lane 300C is unloaded onto the belt conveyer 280B.

Then, the operations illustrated in FIGS. 17(A) to 17(E) are repeated to remove the entire asphalt pavement 22 provided on the steel plate 12.

A function and effect of the asphalt pavement removing method, the asphalt pavement removing system and the electromagnetic induction coil unit, according to the fifth embodiment, will be described below.

In the fifth embodiment, the softened layer 302 formed in the segmental asphalt pavement 22 by the coil unit 32 makes it easy to peel off the segmental asphalt pavement 22 from the steel plate 12. Thus, the segmental asphalt pavement 22 can be fragmented without generating large vibration and noise as in the chipping technique.

The remaining portion of the segmental asphalt pavement 22 other than the softened layer is in a solid state. Thus, the segmental asphalt pavement 22 can be fragmented and extracted in the form of the asphalt block 256. This makes it possible to facilitate the operation of extracting the asphalt block 256, to achieve enhanced operation efficiency.

In addition, the asphalt block 256 can be extracted as a plate-shaped rectangular block having a given size. This makes it possible to efficiently load the asphalt block 256 into the dump truck 254 or other transportation vehicle.

Each of the first and second cut lines is formed to have a depth failing to reach the steel plate 12 or an appendage provided on the steel plate 12. This makes it possible to prevent the steel plate 12 or the appendage provided on the steel plate 12 from being scratched.

An object to be heated by the coil unit 32 is the steel plate 12, and therefore the heating can be efficiently performed. In addition, an amount of heat to be applied can be set at a value for forming the softened layer 202 in the vicinity of the steel plate 12. Thus, the segmental asphalt pavement 22 can be fragmented and extracted in the form of the asphalt block with a relatively small amount of electric power.

The segmental asphalt pavement 22 is fragmented by clamping the segmental asphalt pavement 22 using the upper/lower-surface clamping device 292, and lifting the segmental asphalt pavement 22 upwardly. Thus, the segmental asphalt pavement 22 can be fragmented and extracted in the form of the asphalt block, i.e., the plate-shaped rectangular block, in a simple manner using a simple apparatus. Further, the upper/lower-surface clamping device adapted to clamp the segmental asphalt pavement 22 from the side of the upper and lower surfaces thereof allows the segmental asphalt pavement 22 to be reliably held.

Even if each of the first cut lines 258 and the second cut lines formed in the asphalt pavement has a depth failing to reach the steel plate 12 or an appendage provided on the steel plate 12, the segmental asphalt pavement 22 can be easily peeled off from the steel plate 12 and fragmented, because a lower layer of the segmental asphalt pavement 22 is formed as a softened layer and thereby reduced in strength.

The dump truck 254 can be arranged on the un-removed asphalt pavement to eliminate a concern about traveling thereof.

The dump truck 254 is positioned on the leading side relative to the position R where the segmental asphalt pavement is fragmented. Thus, an operation of changing the dump truck 254 does not disturb the operation of extracting the segmental asphalt pavement 22. This makes it possible to achieve enhanced operation efficiency and enhanced safety.

The cut-line forming device 260, the softened-layer forming device (coil unit 32), the extraction device (the upper/lower-surface clamping device 292 and the backhoe 64), the transport device (the belt conveyers 280A, 280B) and the transportation vehicle (the dump truck 254) are arranged in conformity to an operation sequence, so that the series of operations can be smoothly performed.

In the operation of moving the asphalt block 256 extracted by the upper/lower-surface clamping device 292, to the belt conveyer 280B, the asphalt block 256 is moved upwardly. Thus, in cases where a lifting machine of the backhoe or the like is used for this operation, a turning motion performed while holding the asphalt block 256 can be minimized. This makes it possible to achieve more enhanced operation efficiency and enhanced safety.

The fifth embodiment has shown an example where the segmental asphalt pavement 22 is fragmented by lifting the upper/lower-surface clamping device 292 upwardly while holding the segmental asphalt pavement 22. Alternatively, a technique as shown in FIG. 20 may be employed.

In FIG. 20, the upper/lower-surface clamping device 292 holding the segmental asphalt pavement 22 is pulled in a trailing direction. In this manner, the segmental asphalt pavement 22 is segmented and extracted in the form of the asphalt block 256.

In the fifth embodiment, the second cut lines to be formed in the segmental asphalt pavement 22 is formed by the cutting blade 298 provided on the distal end of the clamping member 290 of the upper/lower-surface clamping device 292. Alternatively, the second cut lines may be formed by a technique as shown in FIG. 21. In this case, an after-mentioned cut-line forming device 260 serves as the second cut-line forming device.

In FIG. 21, the second cut line is formed in the segmental asphalt pavement 22 by a cut-line forming device 260 which is provided on the trailing side relative to the traveling carriage 264 in such a manner to form a cut line intersecting the progress direction. In this case, a height position of the cut-line forming device 260 is adjusted based on a value measured by the measurement device 274 as shown in FIG. 18, in such a manner that the second cut line has a depth which approximates to a distance to the steel plate 12 or an appendage provided on the steel plate 12 as close as possible and fails to reach the steel plate 12 or an appendage.

An asphalt pavement removing method, an asphalt pavement removing system and an electromagnetic induction coil unit, according to a sixth embodiment of the present invention, and a function and effect thereof, will be described below.

The sixth embodiment is based on a system in which the cutting blade 298 provided on the distal end of the clamping member 290 in the fifth embodiment is substituted with a presser member, and the segmental asphalt pavement 22 is bent and fragmented. Thus, in the following description, the same element or component as that in the fifth embodiment is defined by the common reference numeral or code, and its description will be omitted on a case-by-case basis.

As shown in FIG. 22(A), a presser member 304 is provided on a distal end of a clamping member 290 of an upper/lower-surface clamping device 292. The presser member 304 is an iron plate having a wedge-shaped cross-section, and arranged to extend along the road width direction of the clamping member 290.

The sixth embodiment is different from the fifth embodiment in the process of extracting the segmental asphalt pavement 22 as shown in FIG. 19. As shown in FIG. 22(A), immediately after a softened layer 302 is formed in a segmental asphalt pavement 22 (softened-layer forming step) in the same manner as that in the fifth embodiment, a ripper 288 is inserted between a steel plate 12 and a lower surface of a gussasphalt layer 14 of a lane A. In this operation, the ripper 288 may be inserted into a region of the softened layer 302 adjacent to an upper surface of the steel plate 12.

Then, as shown in FIG. 22(B), an actuator 296 is stretched to close the clamping member 290 so as to clamp the segmental asphalt pavement 22 from the side of upper and lower surfaces thereof, using a ripper 288 and the clamping member 290. Thus, the wedge-shaped presser member 304 is brought into contact with the segmental asphalt pavement 22 in such a manner that a tip edge thereof intersects first cut lines 258 at a given lengthwise position of the segmental asphalt pavement 22.

Then, an upper/lower surface clamping device 292 holding the segmental asphalt pavement 22 is lifted upwardly in such a manner as to bend the segmental asphalt pavement 22 around the tip edge of the wedge-shaped presser member 304. As a result, the segmental asphalt pavement 22 is fragmented and extracted as an asphalt block 256, as shown in FIG. 22(C) (extraction step).

Specifically, a folding line is formed in a given position of the asphalt block 256 (the segmental asphalt pavement 22?) by the presser member 304 provided on the distal end of the clamping member 290. Thus, the extracted asphalt block 256 is formed as a plate-shaped rectangular block.

Then, as shown in FIG. 22(D), the asphalt block 256 is further lifted upwardly, and unloaded onto a belt conveyer 280B provided above a traveling carriage 264 (moving step).

In this manner, the sixth embodiment can obtain substantially the same effects as those in the fifth embodiment.

The segmental asphalt pavement 22 is bendingly lifted while being clamped by the upper/lower-surface clamping device 292. Thus, the segmental asphalt pavement 22 can be peeled off from the steel plate 12, and fragmented and extracted in the form of the asphalt block 256, in a simple manner using a simple apparatus.

In addition, the need for forming the second cut lines in the segmental asphalt pavement can be eliminated. This makes it possible to prevent the steel plate 12 or an appendage provided on the steel plate 12 from being scratched due to the cut-line forming operation.

The segmental asphalt pavement 22 can be easily bent, because the lower layer thereof is reduced in strength due to the softened layer formed therein.

The sixth embodiment has shown an example where the member made of iron and formed to have a wedge-shaped cross-section is used as the pressure member 304. Alternatively, any other suitable member having a hardness and configuration capable of forming a folding line in the segmental asphalt pavement 22 may be used. Further, the presser member may be formed in a configuration capable of being brought into contact with only a part of the entire length of the segmental asphalt pavement 22 in the road width direction at a given position thereof, instead of a configuration capable of being brought into contact with the entire length of the segmental asphalt pavement 22 in the road width direction.

Each of the first cut line 528 and the second cut line to be formed in the asphalt pavement 22 in the fifth and sixth embodiments may be formed using an assembly of a plurality of cutting blades 306A, 306B, 306C which are superimposed on each other in such a manner that a diameter of the assembly gradually decreases in an outward direction, as shown in FIG. 23. In this case, a wedge-shaped cut line can be formed. This makes it possible to facilitate the formation of the cut line and the fragmentation of the segmental asphalt pavement 22 (i.e., the segmental asphalt pavement 22 can be easily fragmented by lifting it upwardly or by pulling it in the trailing direction).

The sixth embodiment has shown an example where the segmental asphalt pavement 22 is bent around the tip edge of the wedge-shaped presser member 304. Alternatively, without using the presser member 304, the segmental asphalt pavement 22 may be bent under a condition that the second cut line has already been formed at a given lengthwise position to extend in a direction intersecting the first cut lines 258. In this case, the segmental asphalt pavement 22 can be more easily bent.

The second cut line is formed to have a depth which approximates to a distance to the steel plate 12 or an appendage provided on the steel plate 12 as close as possible and fails to reach the steel plate 12 or an appendage. Preferably, in view of facilitating the bending of the segmental asphalt pavement 22, the depth of the second cut line is set at a value greater than one-half of a thickness of the asphalt pavement 22.

FIG. 24 shows a state when the segmental asphalt pavement 22 is lifted upwardly while being clamped by the upper/lower-surface clamping device 292, to fragment the segmental asphalt pavement 22, after forming the wedge-shaped second cut line 318 by the technique illustrated in FIG. 23.

In this manner, the segmental asphalt pavement 22 can be peeled from the steel plate 12, and fragmented and extracted in the form of a plate-shaped rectangular block in a simple manner using a simple apparatus.

The depth of the second cut line formed in the segmental asphalt pavement 22 is set at a value failing to reach the steel plate 12 or the appendage provided on the steel plate 12. This makes it possible to prevent the steel plate 12 or the appendage provided on the steel plate 12 from being scratched.

The fifth and sixth embodiments have shown an example where the upper/lower-surface clamping device 292 is employed as the holding means. Alternatively, a suction device 308 and a gripping device 310, as shown in FIGS. 25 and 26, may be used.

The suction device 308 illustrated in FIG. 25 is adapted to suck an upper surface of the segmental asphalt pavement 22 formed with the second cut lines to hold the segmental asphalt pavement 22. Then, the suction device 308 is moved upwardly to lift the segmental asphalt pavement 22 upwardly so as to fragment and extract the segmental asphalt pavement 22 in the form of the asphalt block 256.

This makes it possible to hold the segmental asphalt pavement 22 within a shorter period of time as compared with a clamping device. Thus, a speed of an asphalt-pavement removing operation can be increased.

The gripping device 310 illustrated in FIG. 26 is provided with a claw member 314, and adapted to grip the surface of the segmental asphalt pavement 22 formed with the second cut lines by the claw member 314. Then, the gripping device 310 is moved upwardly to lift the segmental asphalt pavement 22 upwardly so as to fragment and extract the segmental asphalt pavement 22 in the form of the asphalt block 256.

This makes it possible to hold the segmental asphalt pavement within a shorter period of time as compared with a clamping device. Thus, a speed of the asphalt-pavement removing operation can be increased.

In cases where the second cut lines are formed in the segmental asphalt pavement 22, as shown in the fifth embodiment and FIG. 24, a side-surface clamping device 312 as shown in FIG. 27 may be employed as the holding means.

The side-surface clamping device 312 is adapted to clamp the segmental asphalt pavement 22 formed with the second cut lines 320, from the side of opposed side surfaces of the segmental asphalt pavement 22, by a clamping claw 316. Then, the side-surface clamping device 312 is moved upwardly to lift the segmental asphalt pavement 22 upwardly so as to fragment and extract the segmental asphalt pavement 22 in the form of the asphalt block 256.

In the fifth and sixth embodiments, the extracted asphalt block 256 is a rectangular block. Thus, in the operation of clamping the segmental asphalt pavement 22 formed with the second cut lines 320, from the side of opposed side surfaces of the segmental asphalt pavement 22 by the side-surface clamping device 312, the segmental asphalt pavement 22 can be reliably clamped.

The seconds cut lines 320 in FIGS. 25 to 27 may be formed in the same manner as that based on the cutting blade 298 provided on the distal end of the clamping member 290 of the upper/lower-surface clamping device 292 or the cut-line forming device 260 illustrated in FIGS. 21 and 23.

FIGS. 25 to 27 show one example where in a state after the second cut lines 320 in segmental asphalt pavement 22, the segmental asphalt pavement 22 held by the suction device 308, the gripping device 310 or the side-surface clamping device 312, is lifted upwardly to fragment the segmental asphalt pavement 22. Alternatively, the segmental asphalt pavement 22 held by the suction device 308, the gripping device 310 or the side-surface clamping device 312, may be pulled in the trailing direction, or bent, to obtain the same functions/effects as those in the fifth and sixth embodiments. When the segmental asphalt pavement 22 is fragmented using one of the suction device 308, the gripping device 310 or the side-surface clamping device 312, a lower surface of the segmental asphalt pavement 22 (melted layer 302) is preferably melted.

The fifth and sixth embodiments have shown an example where the two coil units connected to each other in the road width direction is placed on the segmental asphalt pavements 22. Alternatively, two or more coil units may be connected to each other, or all the target segmental asphalt pavements may be covered by one coil unit. Further, one coil unit having a length in the road width direction less than that of the target segmental asphalt pavements may be reciprocatingly moved in the road width direction.

Specifications (e.g., a sectional diameter of a conductor of the coil, a diameter of the coil and the number of turns in the coil) and a configuration of the electromagnetic induction coil 36, and an arrangement and the number of the electromagnetic induction coils 36, may be determined depending on a distance between the upper surface of the steel plate 12 and the lower surface of the electromagnetic induction coil 36, and a heating capability required for forming the softened layer in the asphalt pavement.

The heating of the steel plate 12 using the coil unit 32 may be intermittently performed as in the fifth and sixth embodiment, or may be continuously performed while moving the coil unit 32 in the progress direction 252.

In the case of performing the heating while moving the coil unit 32 in the progress direction 252, portions of the steel plate 12 which have not been able to be sufficiently heated by the leading-side electromagnetic induction coils 36 in the first coil group can be subsequently heated by the trailing-side electromagnetic induction coils 36 in the second coil group, so that the entire surface of the steel plate 12 can be evenly heated.

The coil unit 32 in the first to sixth embodiments, the number of the electromagnetic induction coils 36 in the first coil group is two, and the number of the electromagnetic induction coils 36 in the second coil group is three. As long as the first coil group is disposed in the frame member 34 in offset relation to the second coil group, in such a manner that a center of each of the electromagnetic induction coils 36 in the first coil group is located between respective centers of adjacent ones of the electromagnetic induction coils 36 in the second coil group, the electromagnetic induction coil 36 may be disposed in any number to obtain the same effects as those in the first to sixth embodiments.

Preferably, the number of the electromagnetic induction coils in the first coil group is two or more, and the number of the electromagnetic induction coils in the second coil group is greater than that of the electromagnetic induction coils in the first coil group by one.

The first to sixth embodiments have shown an example where the dump truck 254 is employed as a transportation vehicle. Alternatively, any other suitable type of vehicle capable of taking in and transferring the asphalt blocks 256. The asphalt block 256 may be transferred to one or more of three positions on leading, lateral and trailing sides relative to the position R where the segmental asphalt block 22 is extracted.

The fifth and sixth embodiments have shown an example where the belt conveyers 280A, 280B are employed as a transfer device. Alternatively, any other suitable transfer device capable of transferring the extracted asphalt block 256 to a loading platform of the dump truck 254 may be used. Alternatively, without using any transfer device, the extracted asphalt block 256 may be temporarily stored around the backhoe 256, and then removed separately.

Although the fifth and sixth embodiments have shown an example where the upper/lower-surface clamping device 292, the suction device 308, the gripping device 310 or the side-surface clamping device 312 serving as the holding means, is provided on the distal end of the arm 62 of the backhoe 308, the extraction device is not limited thereto, but the holding means may be combined with any other suitable apparatus equipped with a turnable arm capable of allowing the holding means to be attached thereto.

The fifth embodiment has shown an example where the first cut lines 258 are formed, and then the softened layer 302 is formed, whereafter the second cut lines are formed. Alternatively, the operation sequence may be changed. For example, the operation sequence may be configured such that the first cut lines 258 are formed, and then the second cut lines are formed, whereafter the softened layer 303 is formed in the segmental asphalt pavement 22, or the softened layer 303 is formed in the segmental asphalt pavement 22, and then the first cut lines 258 are formed, whereafter the second cut lines are formed.

In the fifth and sixth embodiments, the Teflon™ coating 70 serving as the peeling layer is formed on the upper surface of the claw member 68 of the ripper 288. Alternatively, any other suitable material capable of preventing bonding of the lower surface of the softened asphalt pavement onto the upper surface of the claw member 68 may be used. If there is not any risk of bonding of the lower surface of the softened asphalt pavement onto the upper surface of the claw member 68, it is not necessary to form the peeling layer on the upper surface of the claw member 68.

In cases where there is the risk of bonding of the lower surface of the softened asphalt pavement onto the upper surface of the claw member 68, an oil, such as light oil or NEPPARAN™, may be applied to the upper surface of the claw member 68, or sand or the like may be spread onto the upper surface of the claw member 68, instead of the Teflon™ coating 70. Alternatively, as shown in the second embodiment, the heater 78 or the piezoelectric device serving as the separation means may be incorporated into the base member 66 or provided on the upper surface of the claw member 68.

Further, the ripper 288 is formed in a wedge shape. Alternatively, the ripper 288 may have any other suitable shape having a sharp-pointed portion at least at a tip thereof.

In order to facilitate the insertion of the ripper 288 between the steel plate 12 and the lower surface of the gussasphalt layer 14, the ripper 288 may be designed to vibrate the tip of the claw member 68. In this case, vibration in an upward-downward direction is likely to cause damage of the steel plate or generation of noise. Thus, the ripper is preferably designed to vibrate the tip in a horizontal direction.

In the fifth and sixth embodiments, a width of each of the ripper 288 and the clamping member 290 in the road width direction is set to be less than the asphalt block width $S_2$. Preferably, the width is variable.

The ripper 288 may be formed in a comb-like configuration to more reliably prevent the soften layer 302 formed in the segmental asphalt pavement 22 from being bonded onto the ripper 288.

An asphalt-pavement removing apparatus (not shown) having a single movable body mounting thereto the cut-line forming device, the softened-layer forming device, the extraction device and the transfer device, as shown in the fifth and sixth embodiments, may be developed. In this case, an operation of installing and removing the devices (the cut-line forming device, the softened-layer forming device, the extraction device and the transfer device) can be quickly performed to achieve high mobility.

While the first to sixth embodiments of the present invention have been described as above, it is understood that the present invention is not limited to the embodiments, but the first to sixth embodiments may be implemented in combination or various changes and modifications may be made therein without departing from the sprit and scope of the present invention.

EXAMPLE

FIGS. 28 and 29 are a result of a heating test on an asphalt pavement (test sample 326) as shown in FIG. 30.

As shown in a side view of FIG. 30, the test sample comprises an asphalt base layer 324 formed to have a thickness of 38 mm and provided on a steel plate 322 having a thickness of 12 mm, an asphalt upper layer 328 formed to have a thickness of 38 mm and provided on the asphalt base layer 324. That is, the asphalt pavement has a thickness of 76 mm (=38 mm×2).

Each of the asphalt base layer 324 and the asphalt upper layer 328 is made of a hot asphalt mixture using modified asphalt (hereinafter referred to as "hot asphalt mixture") which has a softening point of 67.5° C.

The steel plate 322 has a two-dimensional size of 90 cm×180 cm, and the asphalt base layer 324 is provided to fully cover an upper surface of the steel plate 322. The asphalt upper layer 328 is provided to fully cover an upper surface of the asphalt base layer 324. That is, each of the asphalt base layer 324 and the asphalt upper layer 328 also has a two-dimensional size of 90 cm×180 cm.

An electromagnetic induction coil 330 is placed on an approximately central region of an upper surface of the asphalt upper layer 328 to heat the steel plate 322 by means of electromagnetic induction. The electromagnetic induction coil 330 has the following heating characteristics: high-frequency current=213 HFA; input power=14.0 kw; and output power=70%.

Five thermocouples 332, 334, 336, 338, 340 each serving as a temperature sensor are installed in the asphalt base layer 324 and the asphalt upper layer 328 at a position immediately below an approximately center of the electromagnetic induction coil 330, and arranged along an upward direction from the upper surface in this order, so that a temperature of an installation position of each of the thermocouples is measured.

The thermocouple 332 is installed on the upper surface of the steel plate 322, and distances between the upper surface of the steel plate 322 and respective ones of the thermocouples 334, 336, 338, 340 are 9.5 mm, 19 mm, 38 mm and 76 mm. That is, the thermocouple 338 is installed on the upper surface of the asphalt base layer 324, and the thermocouple 340 is installed on the upper surface of the asphalt upper layer 328.

FIGS. 28(A) to 28(D) and FIGS. 29(E) to 29(I) show a relationship between a temperature (horizontal axis) and a depth of the asphalt base layer 324 and the asphalt upper layer 328 (vertical axis), which is measured by the thermocouples 332, 334, 336, 338, 340.

The points 332A, 334A, 336A, 338A, 340A in FIGS. 28(A) to 28(D) and FIGS. 29(E) to 29(I) correspond to respective measured values of the thermocouples 332, 334, 336, 338, 340.

FIGS. 28(A) to 28(D) show respective values measured when an elapsed time from start of heating by the electromagnetic induction coil 330 is 15 (s), 30 (s), 60 (s) and 90 (s), and FIGS. 29(E) to 29(I) show respective values measured when the elapsed time from start of heating by the electromagnetic induction coil 330 is 120 (s), 150 (s), 210 (s), 270 (s) and 360 (s).

In the test, it was verified that a melted layer being in contact with the steel plate 322 and having a thickness of about 5 mm is formed in the asphalt base layer 324 at a time when the elapsed time from start of heating by the electromagnetic induction coil 330 reaches 210 (s), i.e., in the state of FIG. 29(G). It was also verified that the asphalt base layer 324 is softened by a thickness of about 5 mm from an upper surface of the above melted layer in an upward direction (a depth of 66 mm from the upper surface of the asphalt upper layer 328). That is, a softened layer being in contact with the steel plate 322 and having a thickness of about 10 mm is formed in the asphalt base layer 324, and a lower surface of the softened layer is melted by a thickness of about 5 mm.

The thickness of the asphalt pavement is 76 mm, as described above. Thus, in FIG. 29(G), about ⅛ (=10 mm/76 mm) of the thickness of the asphalt pavement is formed as a softened layer, and the remaining about ⅞ is in a solid state.

In FIGS. 29(H) and (I) showing a state after further continuing the heating, a position having a temperature of 55° C. becomes shallower along with a heating time. That is, the thickness of the softened layer is increased to 10 mm or more.

Further, it was verified that a wedge-shaped member can be manually inserted into the softened layer. In view of this result, it was proven that the softened layer has a softness which allows the asphalt pavement to be adequately peeled off from the steel plate, through the method according to each of the first to sixth embodiments of the present invention. Specifically, it is able to form a softened layer having a softness which allows the asphalt pavement to be peeled off from the steel plate even at a temperature of a softening point (67.5° C.) or less.

As above, through the heating test on the test sample 326, it was proven that a softened layer and a melted layer in contact with the steel plate 322 are formed in the asphalt pavement (the asphalt base layer 324) by subjecting the steel plate 322 to electromagnetic induction heating using the electromagnetic induction coil 330.

As shown in FIG. 29(G), a temperature at a position on an upward side relative to the upper surface of the steel plate 322 by about 10 mm (a position where a depth from the upper surface of the asphalt upper layer 328 is 66 mm) is about 55° C. Thus, a softened layer 302 having a viscosity suitable for peeling off the asphalt pavement 22 from the steel plate 12 and a thickness of about 10 mm or more can be formed in the asphalt pavement 22 by setting a temperature of asphalt at 55° C. or more.

As seen in FIGS. 28 and 29, a temperature of the upper surface of the steel plate 322 becomes higher along with an increase in the heating time by the electromagnetic induction coil 330.

As seen in FIGS. 29(G) to 29(I), even when the steel plate 322 is heated for 210 (s), and the lower surface of the asphalt base layer 324 (the position of the thermocouple 332) reaches a high temperature of 80° C., a temperature at a depth up to about 60 mm from the upper surface of the asphalt pavement (asphalt upper layer 328) is maintained at 50° C. or less, and therefore the asphalt pavement is not softened in the range from the upper surface of the asphalt pavement (asphalt upper layer 328) to a depth of about 60 mm.

That is, the softened layer is formed only at about 16 mm (=76 mm−60 mm) when measured upwardly from the upper surface of the steel plate 12, and most of the asphalt pavement (the asphalt base layer 324 and the asphalt upper layer 328) is in the solid state. Thus, the asphalt pavement can be fragmented and extracted in the form of an asphalt block, specifically a plate-shaped rectangular block.

In this Example, each of the asphalt base layer 324 and the asphalt upper layer 328 was made of a hot asphalt mixture having a softening point of 67.5° C. Even when the asphalt base layer 324 is made of a hard asphalt mixture using gussasphalt (hereinafter referred to as "hard asphalt mixture", and the asphalt upper layer 328 is made of a hot asphalt mixture, a tendency of thermal conduction is substantially the same.

As seen in FIGS. 29(G) to 29(I), when the heating using the electromagnetic induction coil 330 is continuously performed for 210 (s) or more, the position (thermocouple 334) on the upward side relative to the upper surface of the steel plate 322 by about 10 mm is increase to 55° C. or more. Thus, a softened layer can be formed in the asphalt pavement by continuously performing the heating using the electromagnetic induction coil 330 for 210 (s) or more.

In a hot asphalt mixture and a hard asphalt mixture which are typical asphalt for roads, the hot asphalt mixture has a softening point ranging from 55 to 75° C., and the hard asphalt mixture has a softening point ranging from 50 to 65° C.

Thus, a softened layer having a viscosity suitable for peeling off an asphalt pavement from a steel plate can be formed in the asphalt pavement by adjusting a high-frequency power to be supplied an electromagnetic induction coil in such a manner that a temperature of the softened layer to be formed in the asphalt pavement is set at 55° C. or more.

If the softened layer is formed to have a thickness of 10 mm, the asphalt-pavement extracting operation can be facilitated. Thus, a temperature of a softened layer is preferably set at 55° C. or more while forming the softened layer at a thickness of 10 mm or more.

In case of the hot asphalt mixture, through the heating test on the test sample 326, it has been verified that a softened layer having a viscosity suitable for peeling off an asphalt pavement from a steel plate can be formed in the asphalt pavement by adjusting a high-frequency power to be supplied to an electromagnetic induction coil in such a manner that a temperature of the softened layer to be formed in the asphalt pavement is set at 55° C. or more.

Further, through the heating test on the test sample 326, it was verified that the hot asphalt mixture is melted at 80° C. Based on a temperature-viscosity characteristic of the hot asphalt mixture, a viscosity at a temperature of 80° C. is calculated as 137 P (poise). Then, based on a temperature-viscosity characteristic of the hard asphalt mixture, a temperature giving a viscosity of 137 P (poise) is calculated as 96° C. That is, the hard asphalt mixture is melted at 96° C.

Thus, preferably, a high-frequency power to be supplied to the electromagnetic induction coils 36 is adjusted in such a manner that a temperature of a softened layer to be formed in the asphalt pavement 22 is set at 80° C. or more for the hot asphalt mixture and at 96° C. or more for the hard asphalt mixture, so that a melted layer can be formed in a lower surface of the softened layer to facilitate peel-off of the asphalt pavement 22 from the steel plate 12.

EXPLANATION OF CODES

Figure 1:
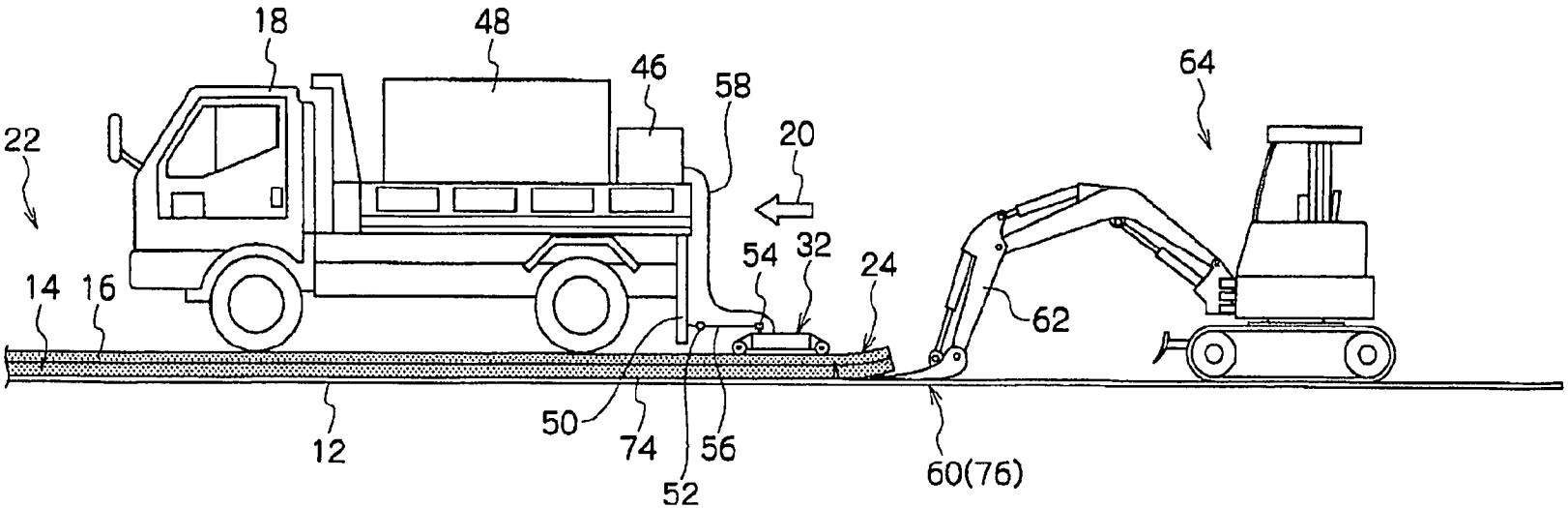
FIG. 1 An explanatory diagram showing an asphalt pavement peeling method according to a first embodiment of the present invention.
Figure 2:
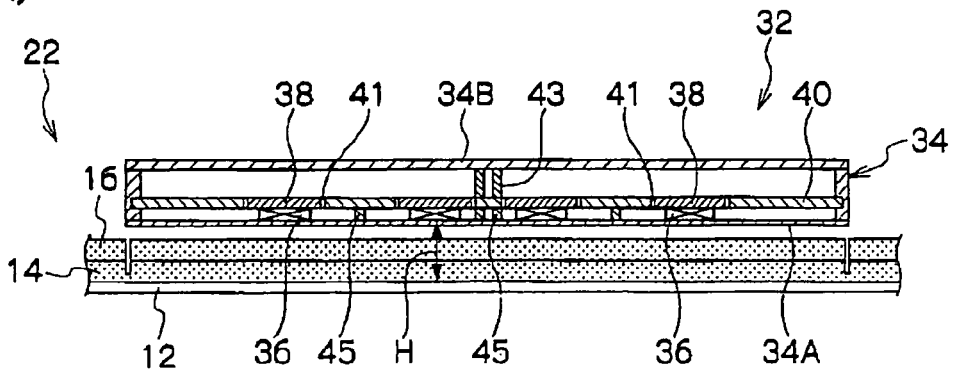
FIG. 2 A sectional view and a top plan view showing a coil unit for used in the asphalt pavement peeling method according to the first embodiment.
Figure 2:
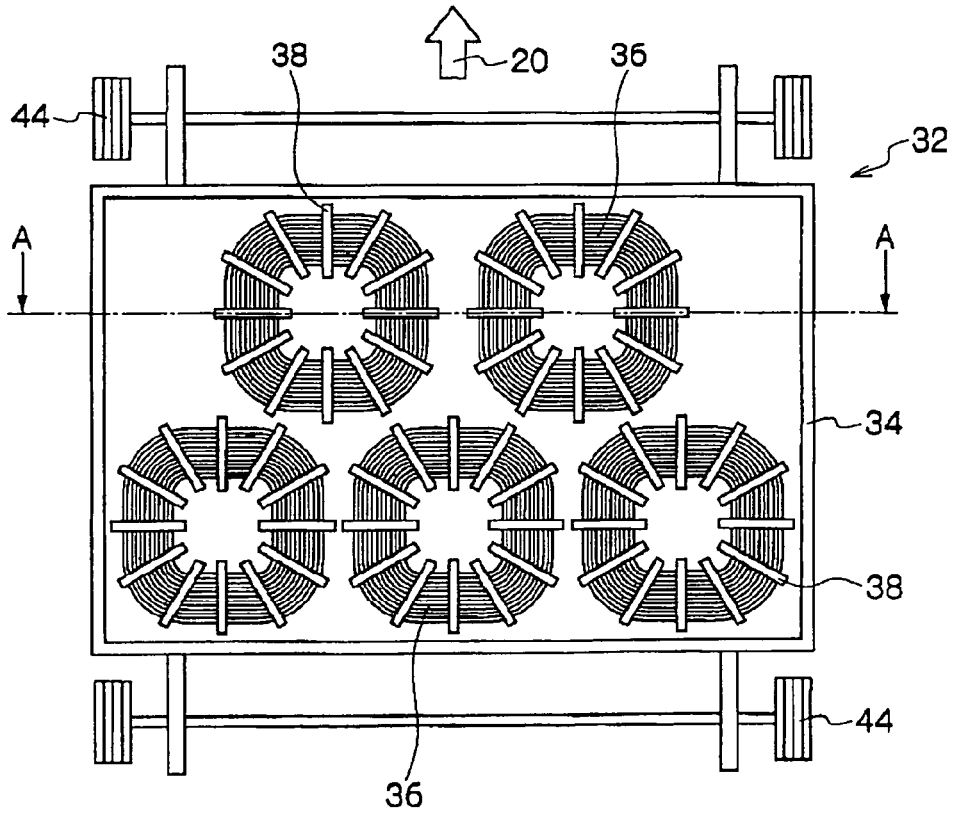
Figure 3:
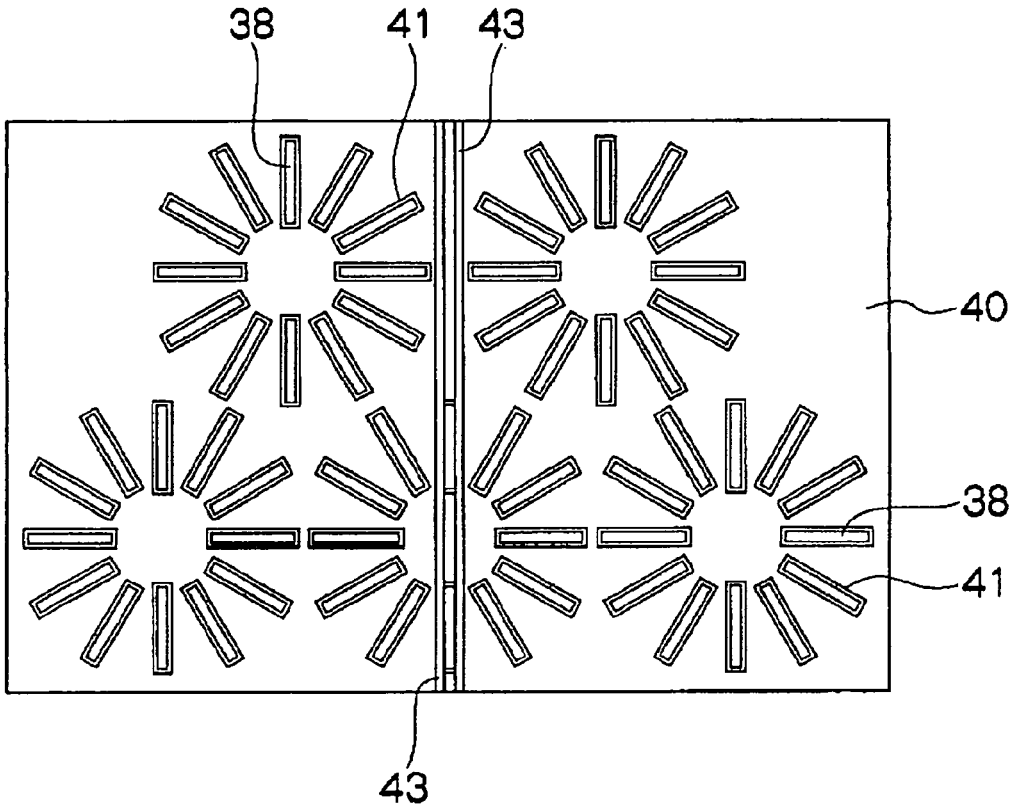
FIG. 3 A top plan view showing a plate member of the coil unit.
Figure 4:
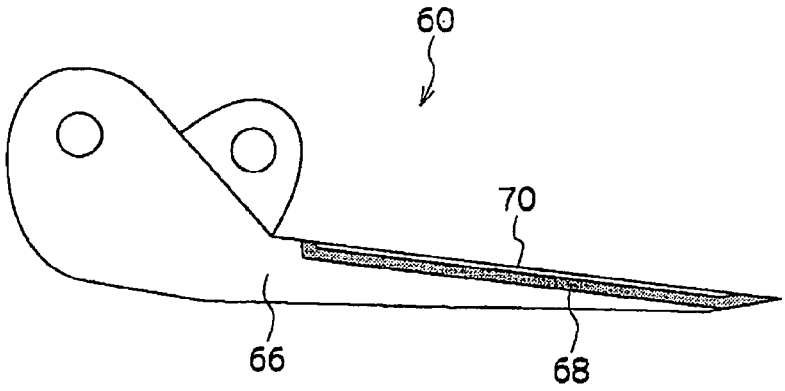
FIG. 4 A side view showing a ripper for used in the asphalt pavement peeling method according to the first embodiment.
Figure 5:
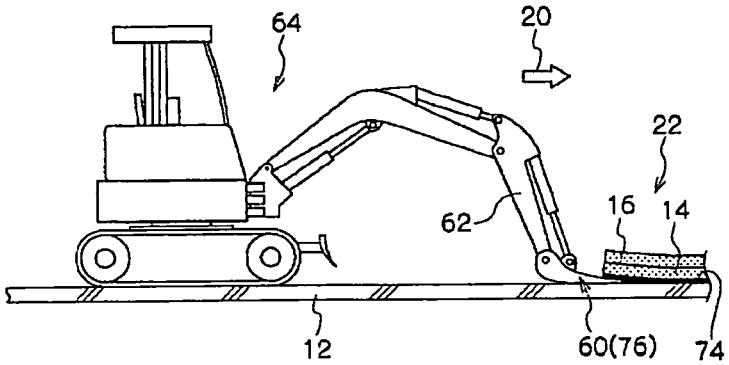
FIG. 5 An explanatory diagram showing an operation process in the asphalt pavement peeling method according to the first embodiment.
Figure 5:
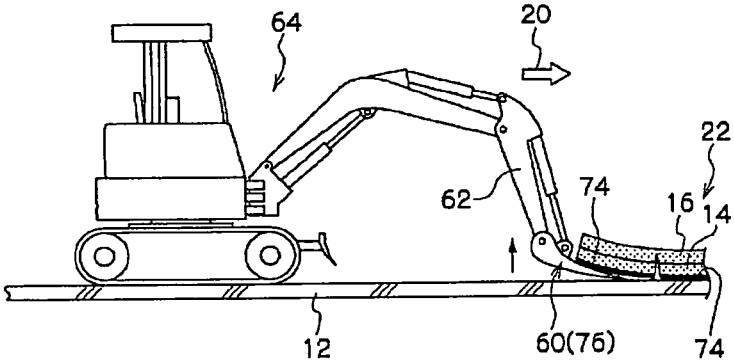
Figure 5:
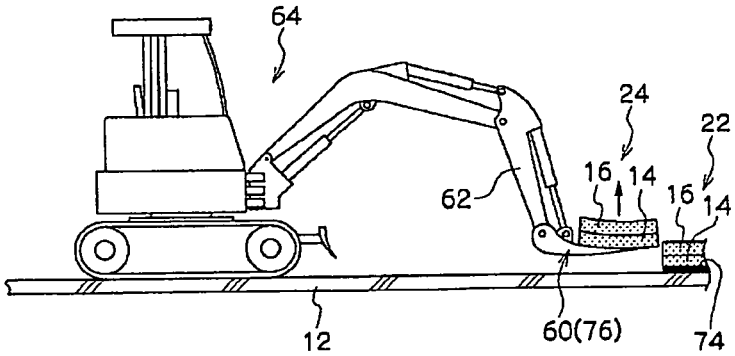
Figure 6:
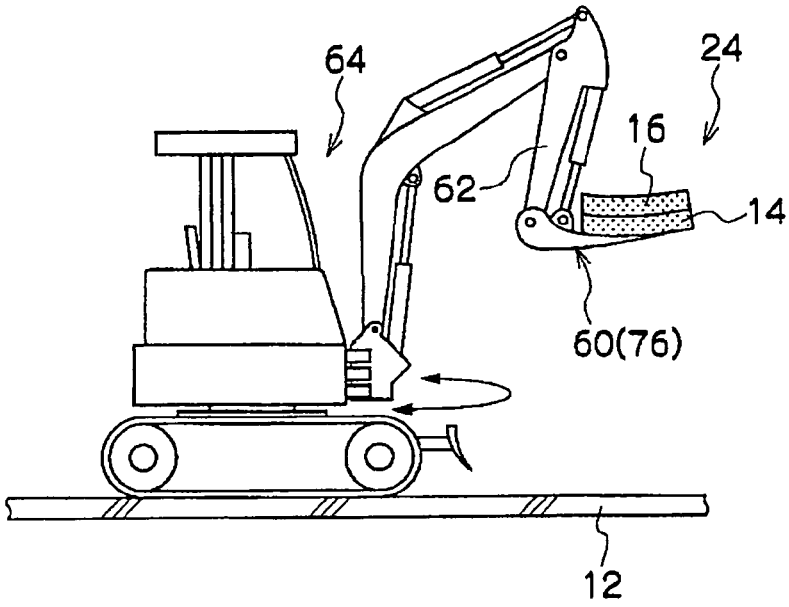
FIG. 6 An explanatory diagram showing an operation process in the asphalt pavement peeling method according to the first embodiment.
Figure 6:
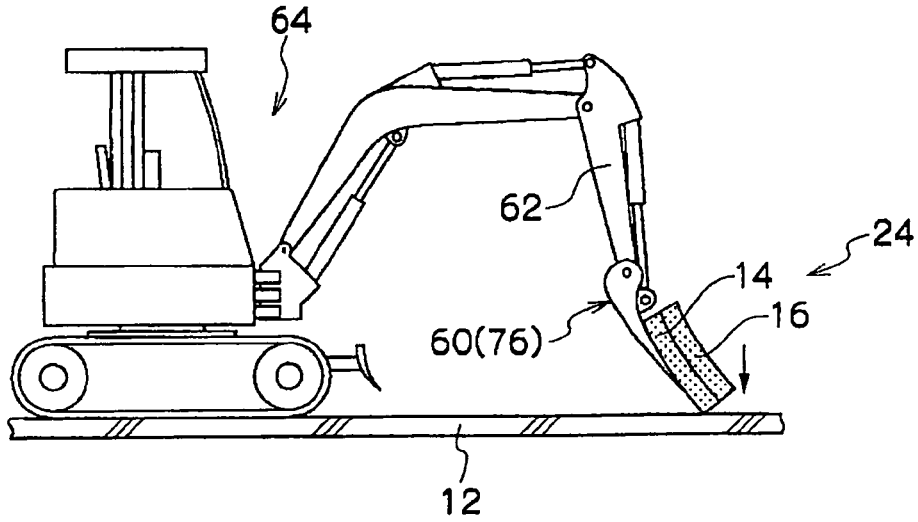
Figure 7:
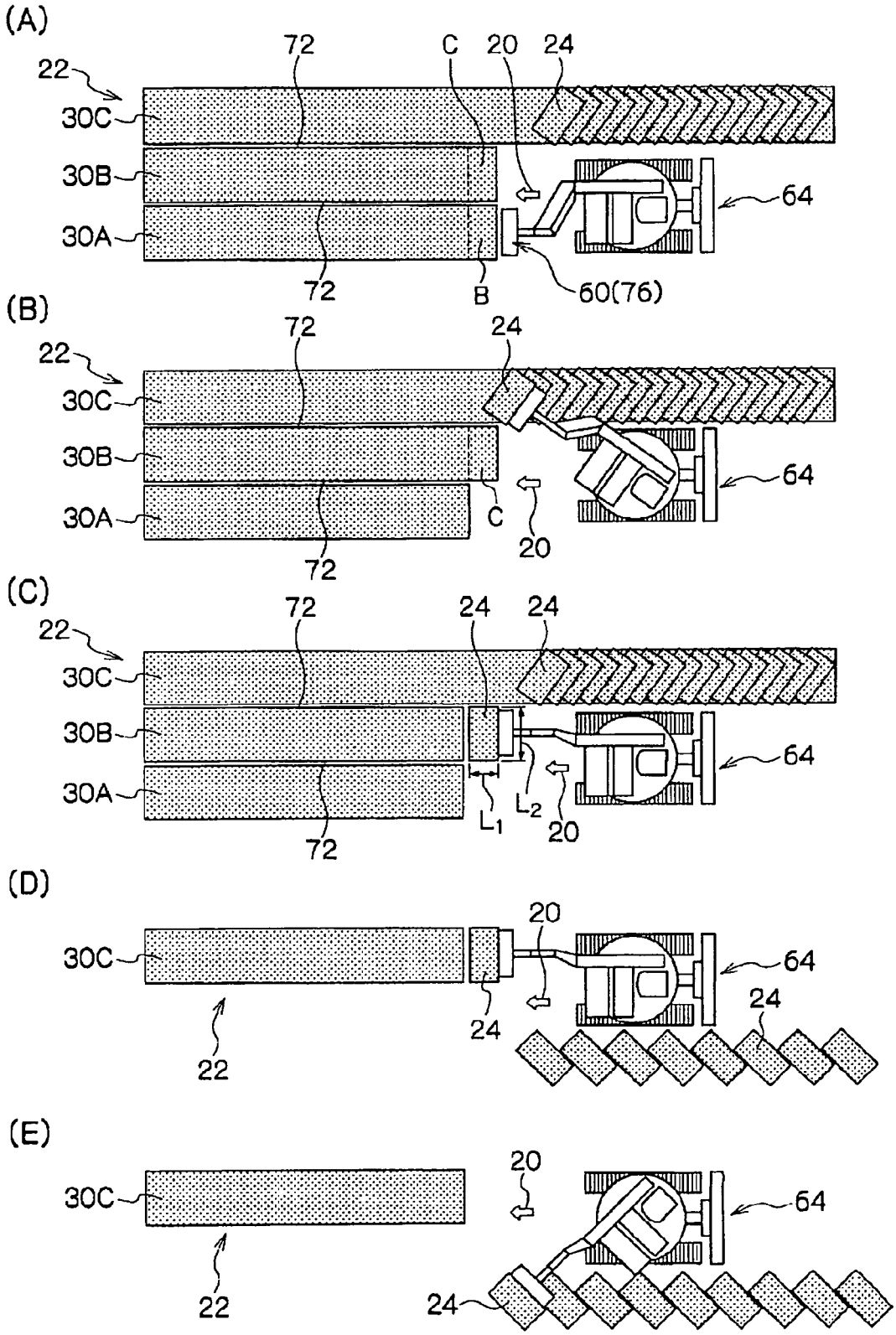
FIG. 7 An explanatory diagram showing an operation process in the asphalt pavement peeling method according to the first embodiment.
Figure 8:
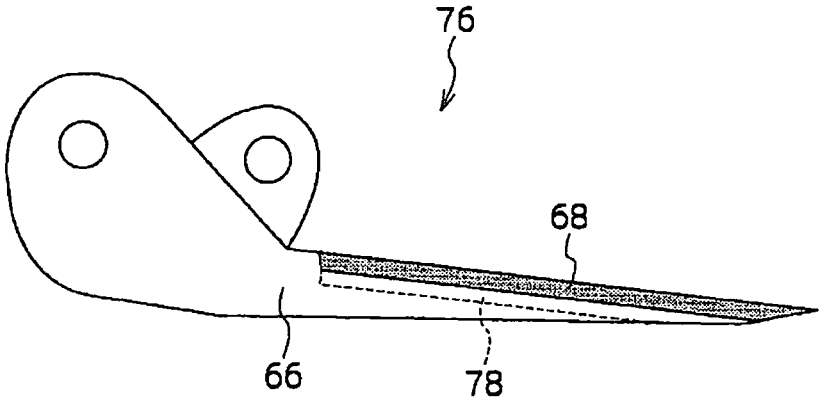
FIG. 8 A side view showing a ripper for use in an asphalt pavement peeling method according to a second embodiment of the present invention.
Figure 9:
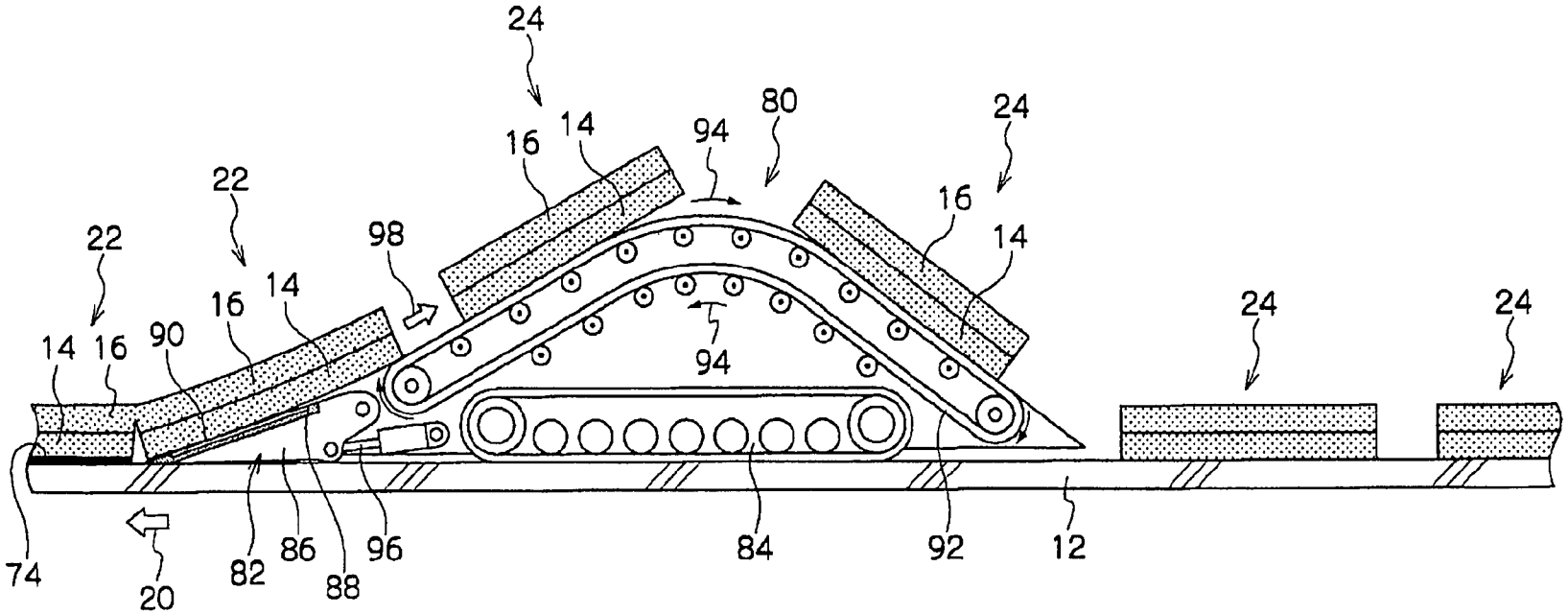
FIG. 9 An explanatory diagram showing an asphalt pavement peeling method according to a third embodiment of the present invention.
Figure 10:
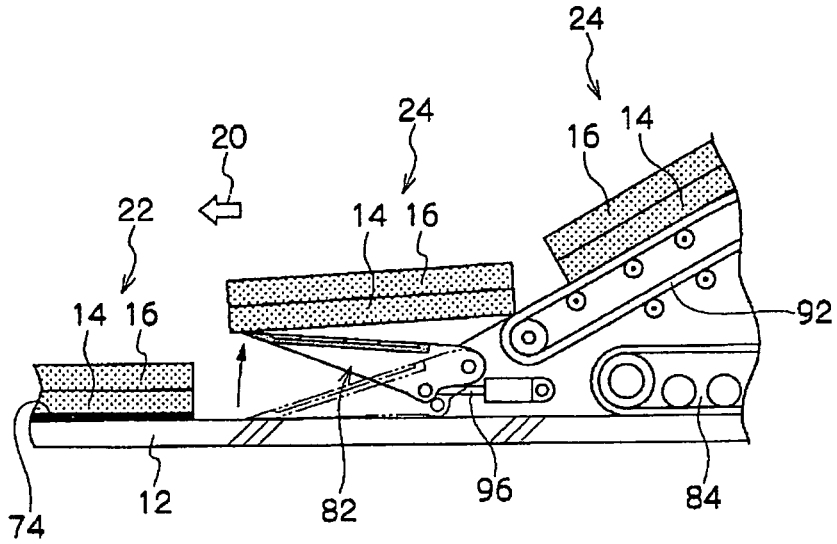
FIG. 10 An explanatory diagram showing the asphalt pavement peeling method according to the third first embodiment FIG. 11 An explanatory diagram showing an asphalt pavement peeling method according to a fourth embodiment of the present invention.
Figure 11:
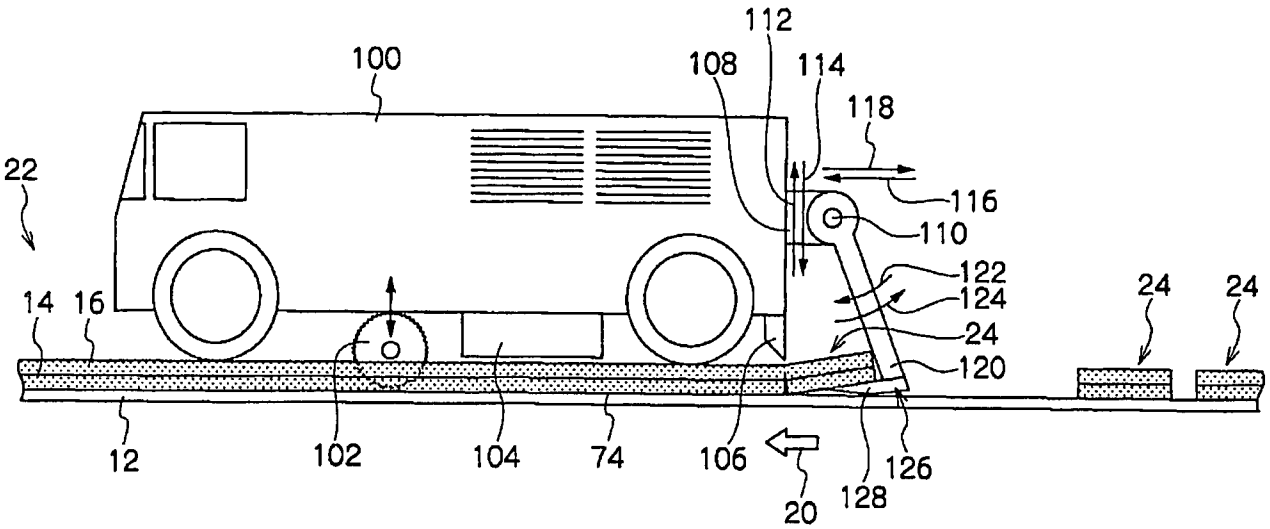
Figure 12:
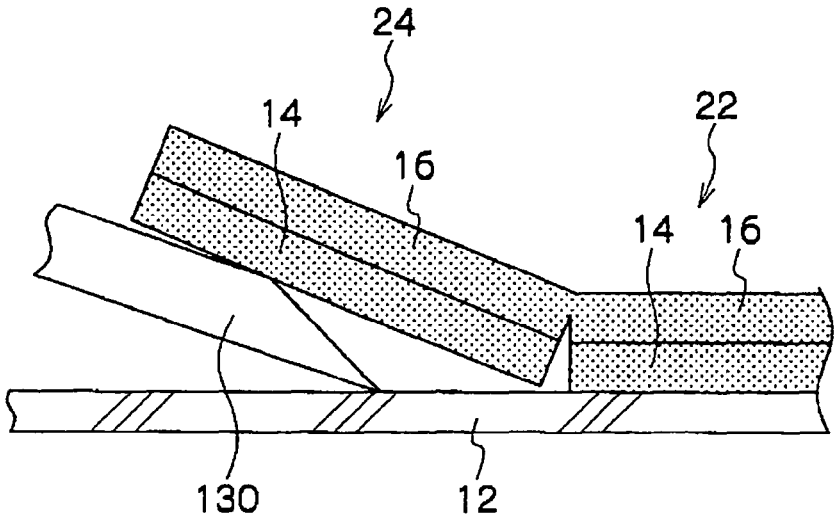
FIG. 12 An explanatory diagram showing one example of modification of the ripper.
Figure 13:
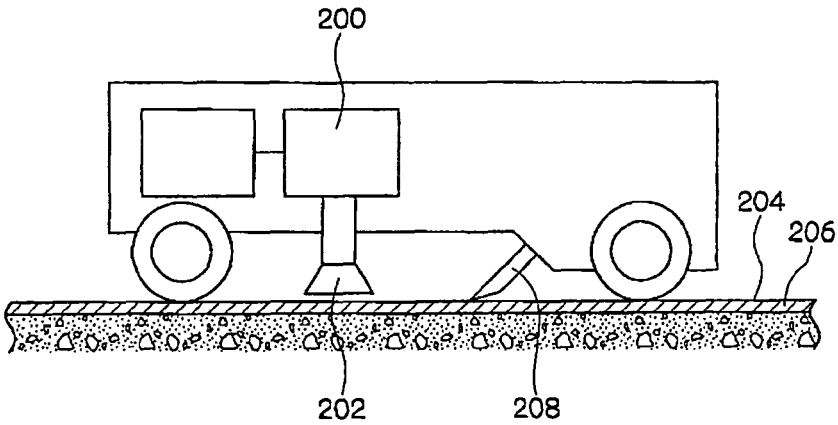
FIG. 13 A conceptual diagram showing a conventional asphalt pavement peeling technique.
Figure 14:
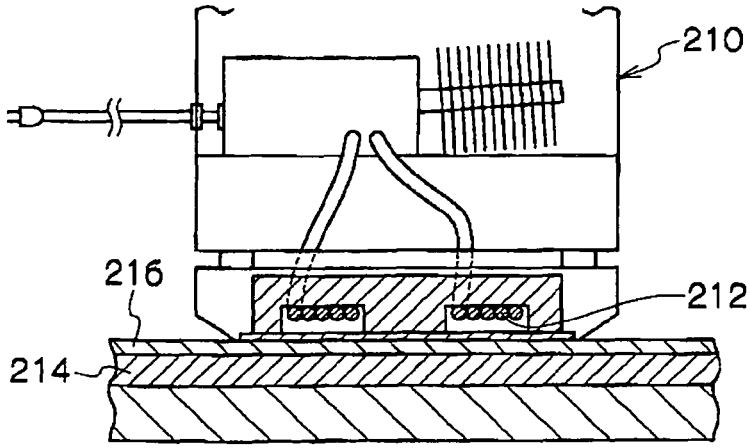
FIG. 14 A schematic diagram showing a conventional hot peeling apparatus.
Figure 15:
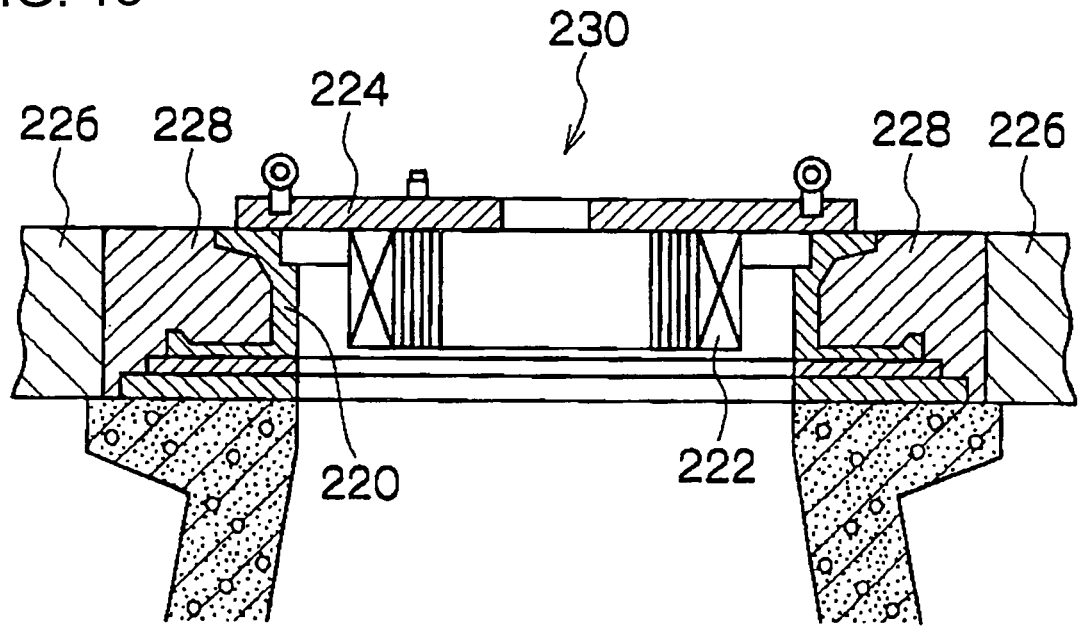
FIG. 15 A schematic diagram showing a conventional induction heating apparatus.
Figure 16:
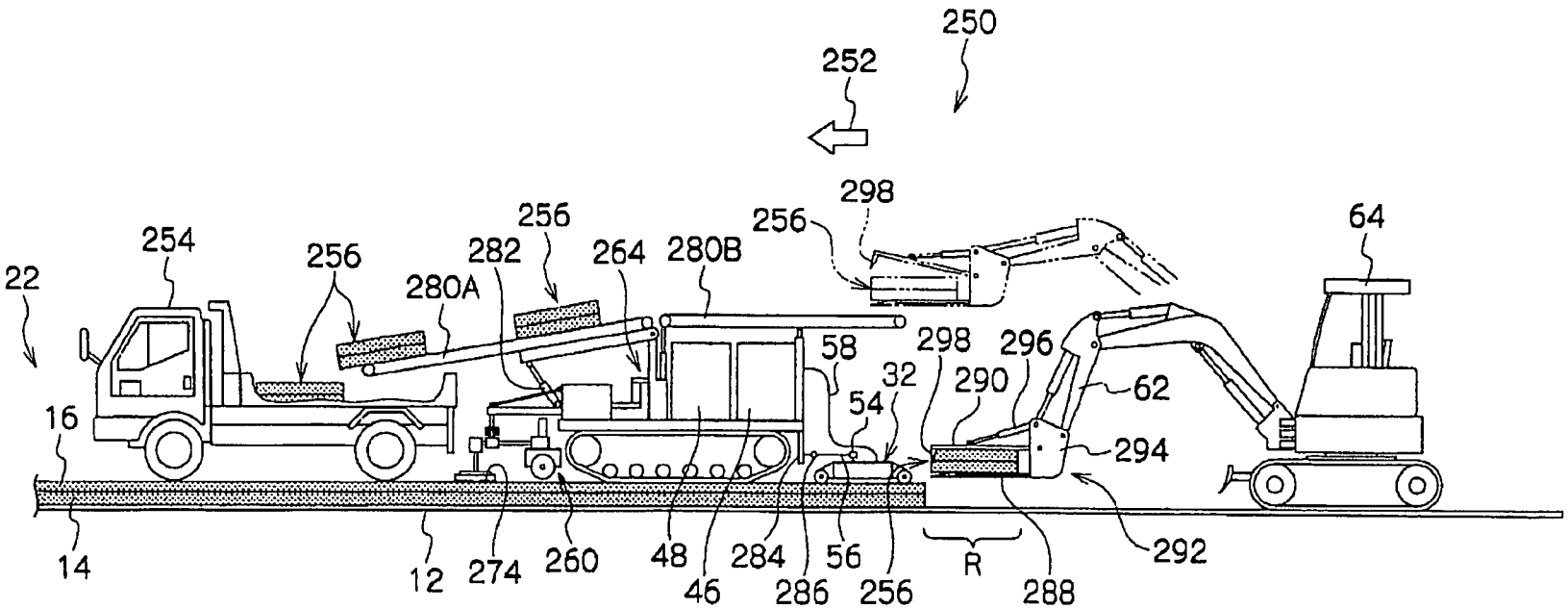
FIG. 16 An explanatory diagram showing an asphalt pavement removing system according to a fifth embodiment of the present invention.
Figure 17:
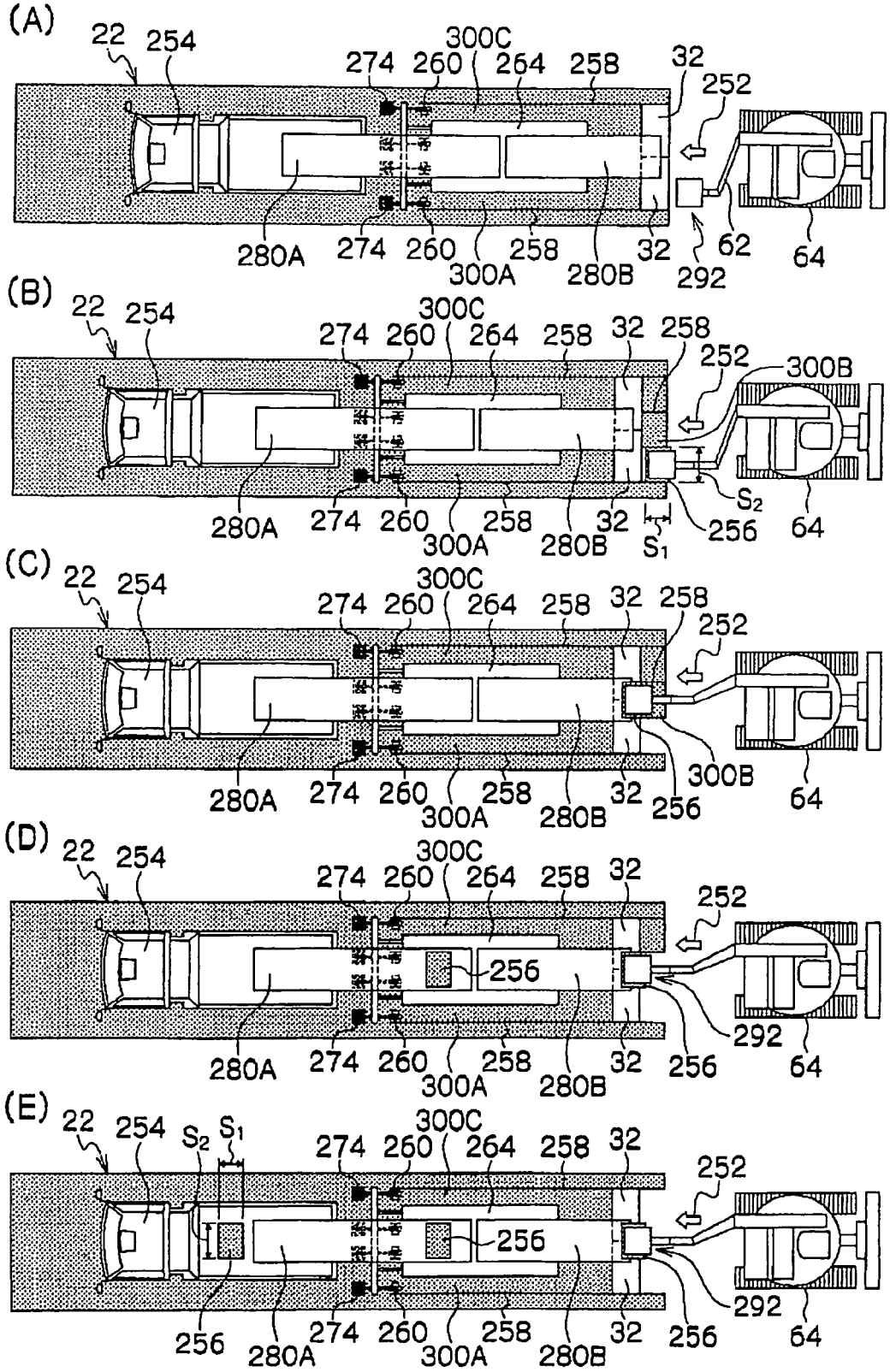
FIG. 17 An explanatory diagram showing an operation process in the asphalt pavement removing system according to the fifth embodiment.
Figure 18:
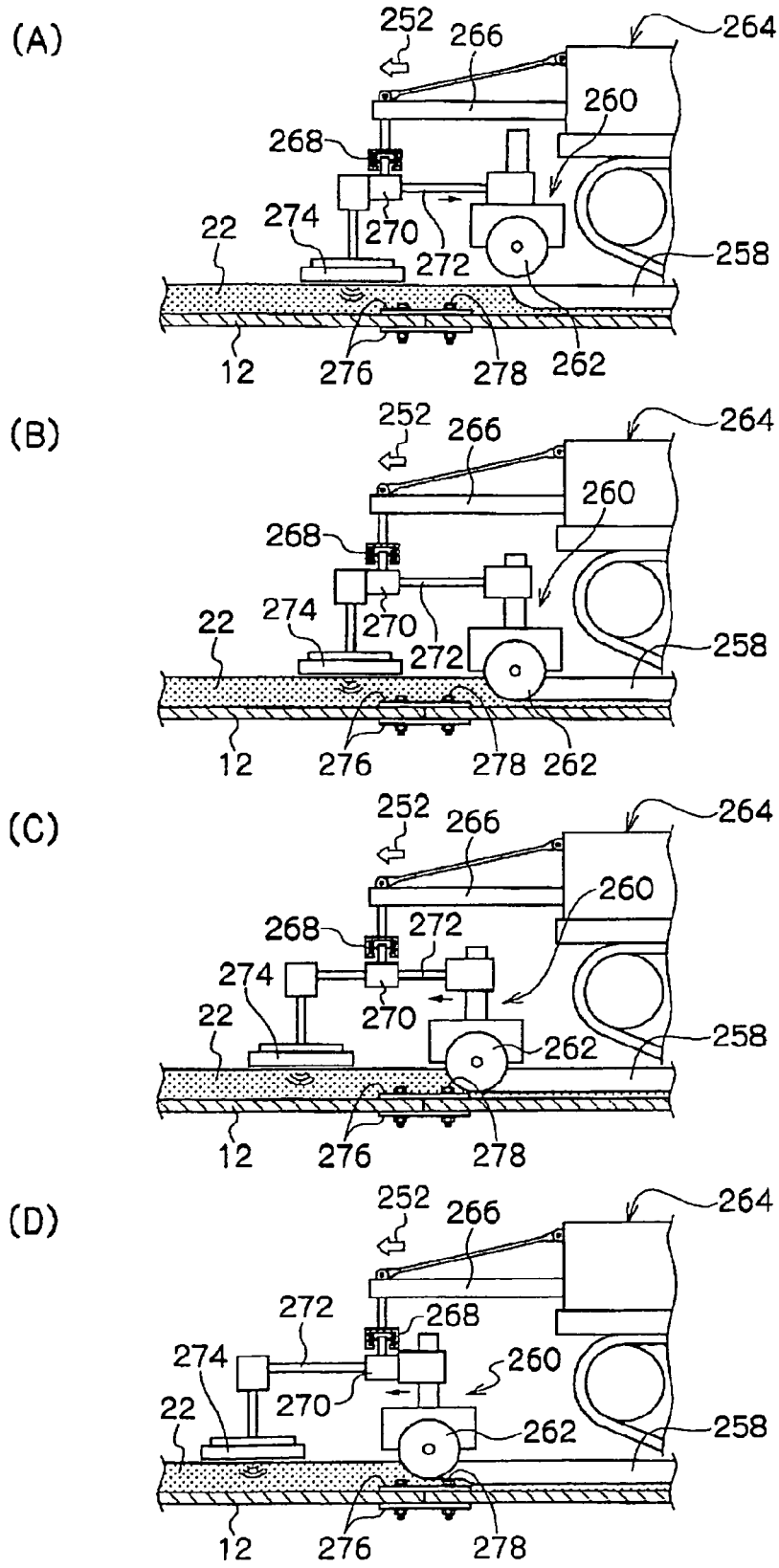
FIG. 18 An explanatory diagram showing a process of forming a first cut line in an asphalt pavement in the asphalt pavement removing system according to the fifth embodiment.
Figure 19:
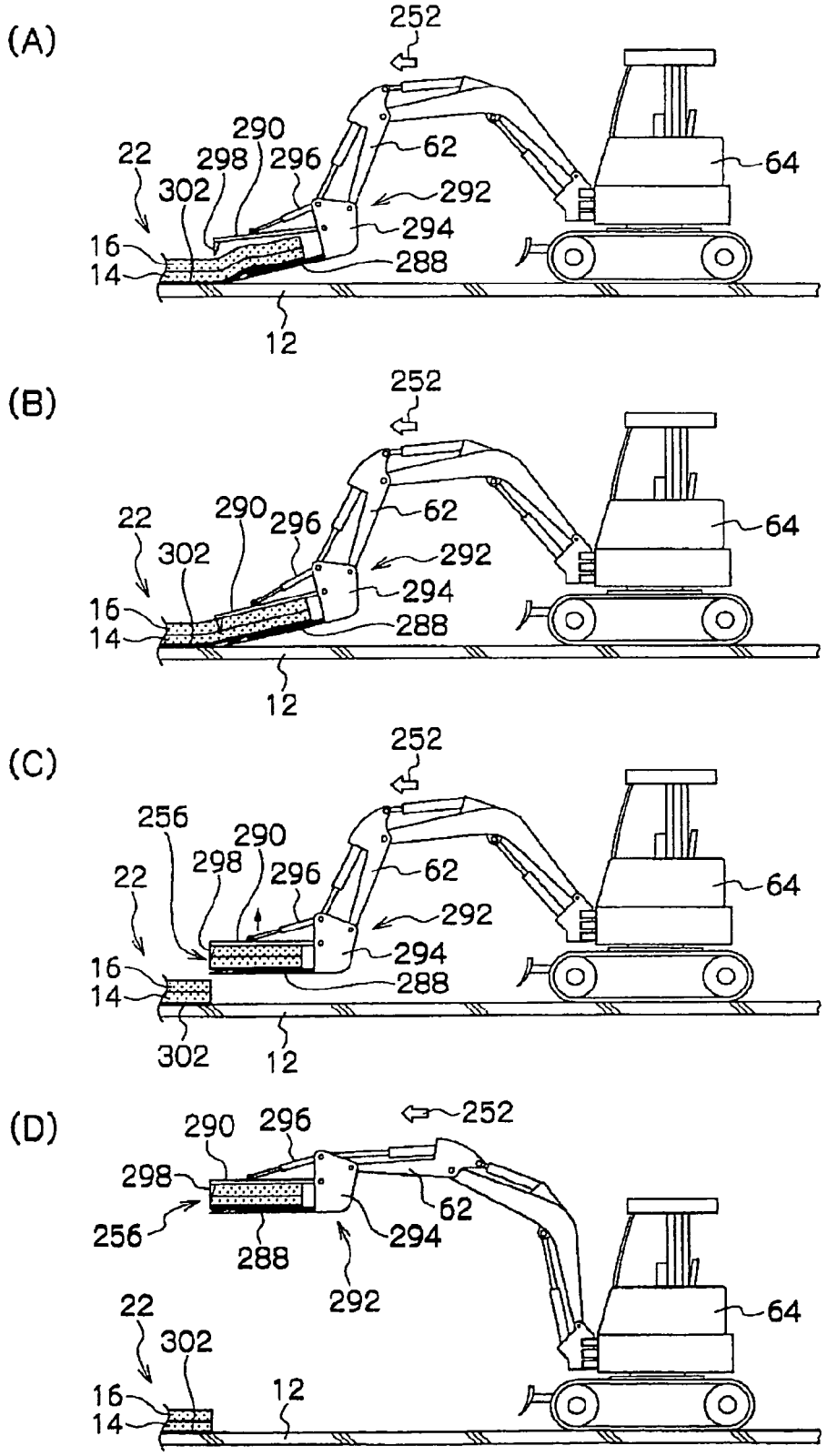
FIG. 19 An explanatory diagram showing an operation process in an asphalt pavement removing method according to the fifth embodiment.
Figure 20:
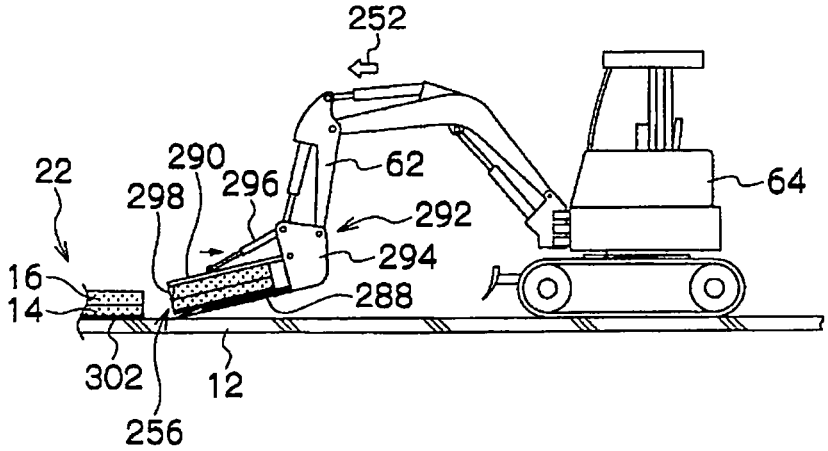
FIG. 20 An explanatory diagram showing the asphalt pavement removing method according to the fifth embodiment.
Figure 21:
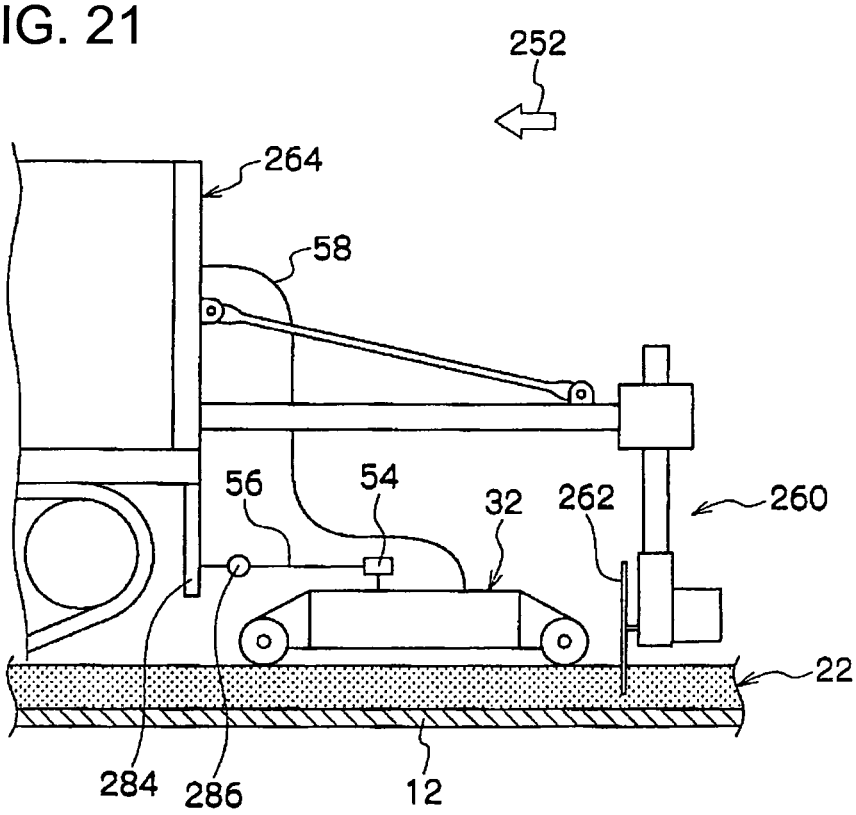
FIG. 21 An explanatory diagram showing a process of forming a second cut line in an asphalt pavement in the asphalt pavement removing system according to the fifth embodiment.
Figure 22:
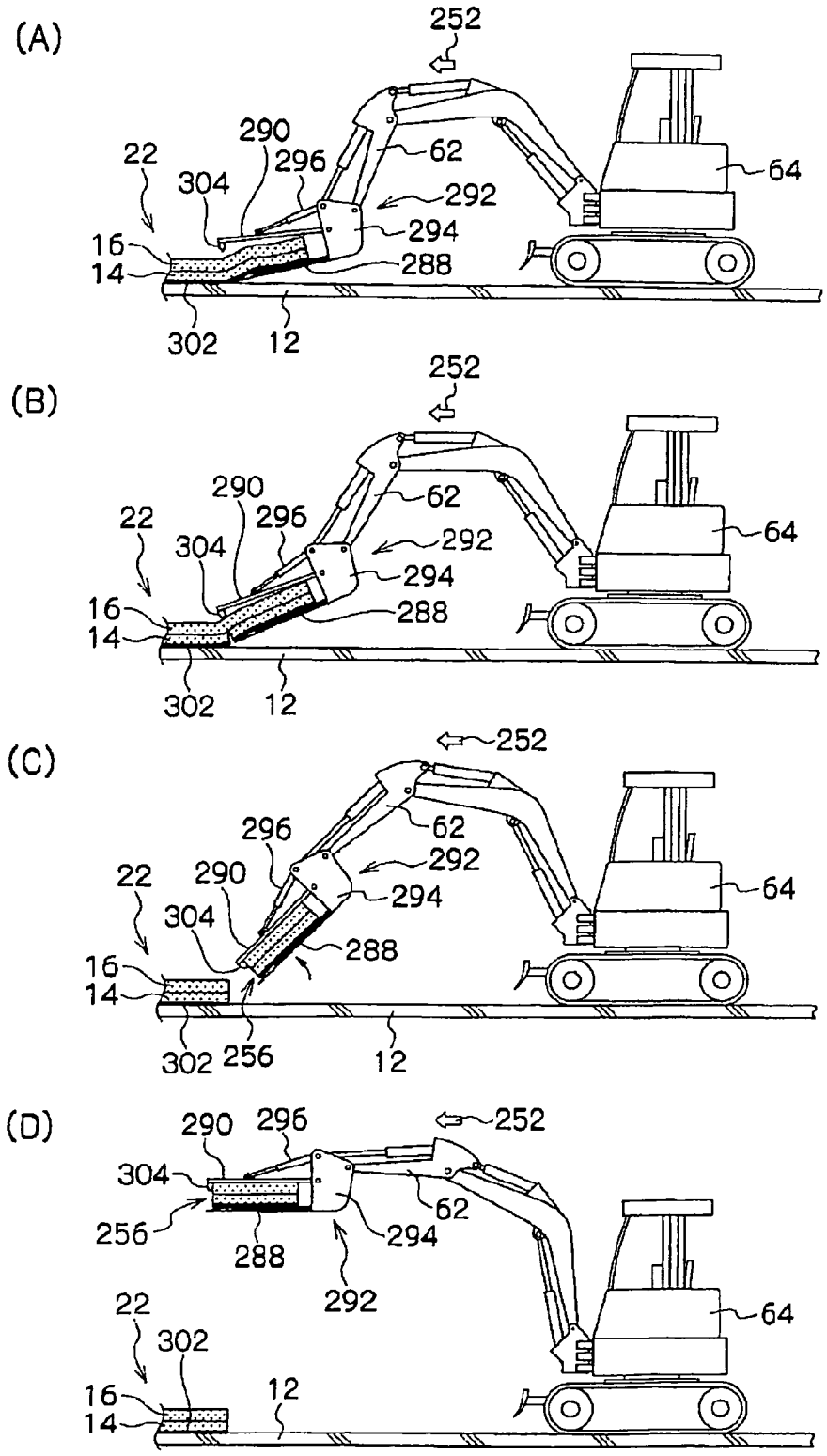
FIG. 22 An explanatory diagram showing an operation process in an asphalt pavement removing method according to a sixth embodiment of the present invention.
Figure 23:
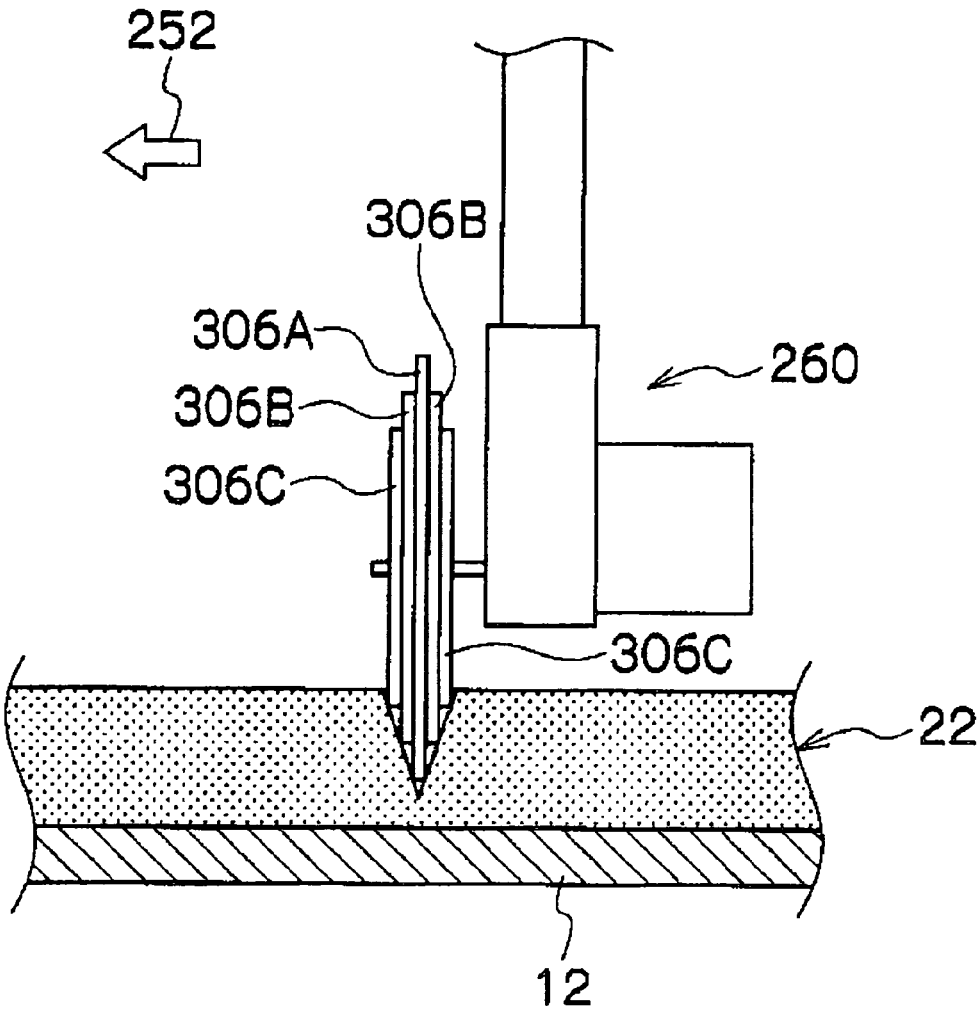
FIG. 23 An explanatory diagram showing another example of a technique of forming the second cut line in the asphalt pavement.
Figure 24:
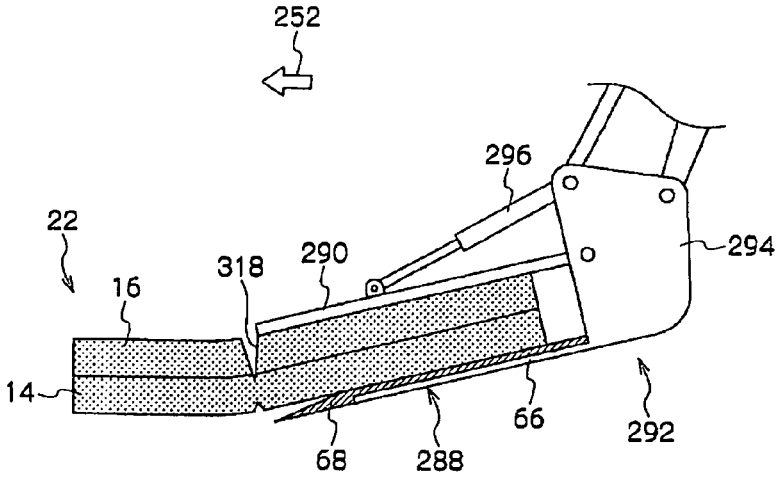
FIG. 24 An explanatory diagram showing the asphalt pavement removing method according to the sixth embodiment.
Figure 25:
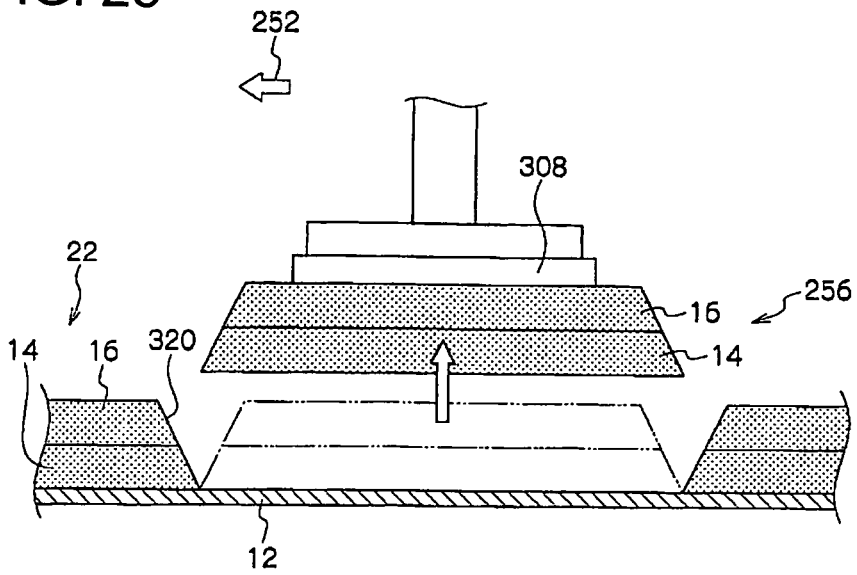
FIG. 25 An explanatory diagram showing one example of holding means.
Figure 26:
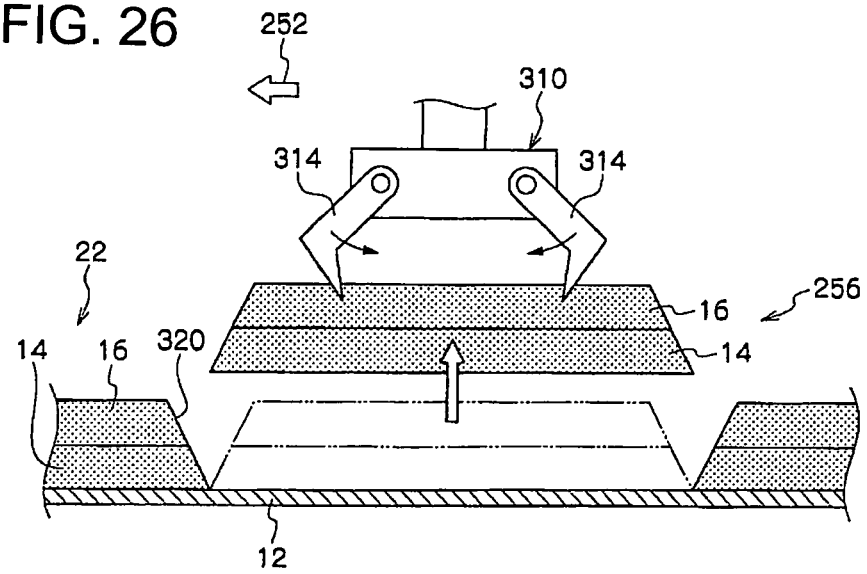
FIG. 26 An explanatory diagram showing another example of the holding means.
Figure 27:
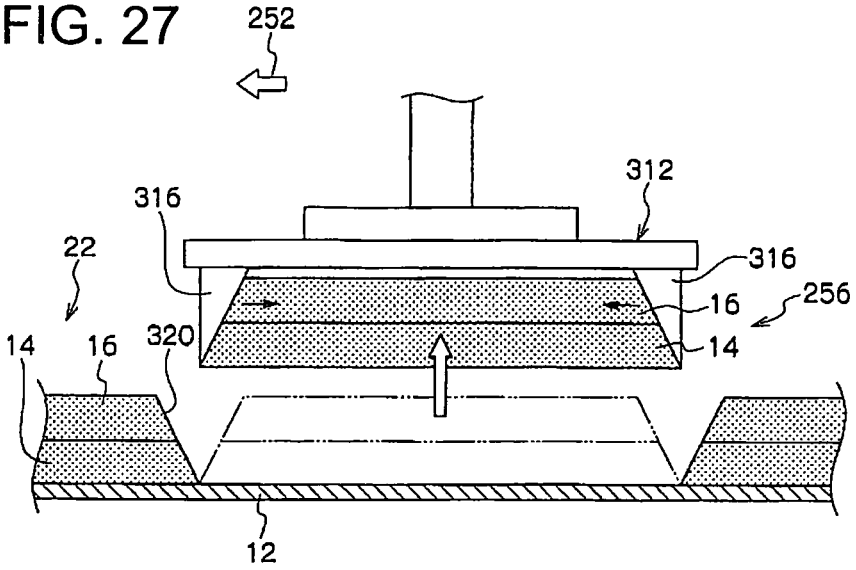
FIG. 27 An explanatory diagram showing yet another example of the holding means.
Figure 28:
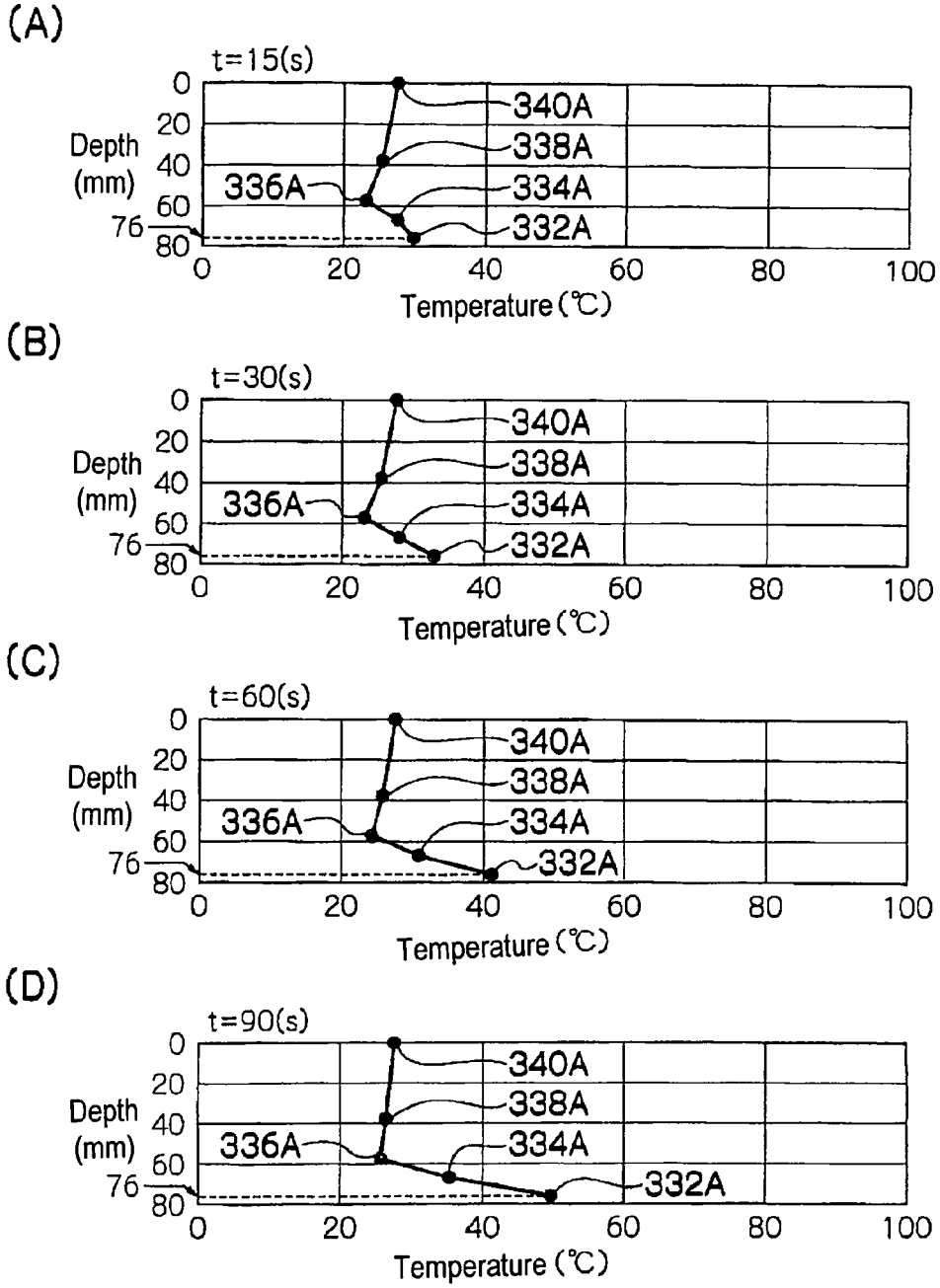
FIG. 28 A graph showing a relationship between a temperature and a depth of an asphalt pavement in Example of the present invention.
Figure 29:
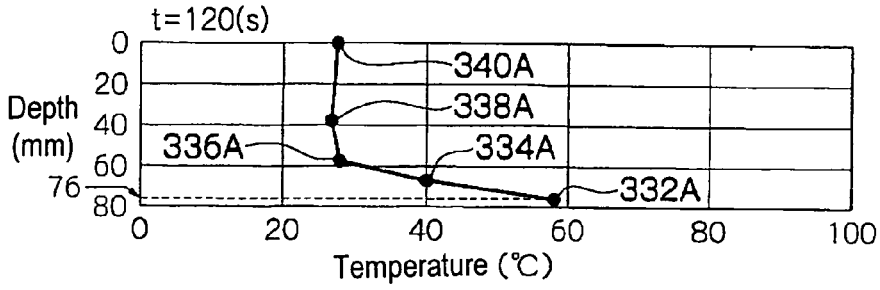
FIG. 29 A graph showing a relationship between a temperature and a depth of an asphalt pavement in Example of the present invention.
Figure 29:
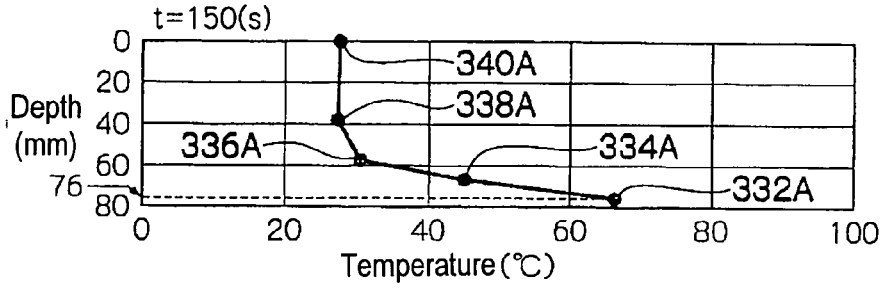
Figure 29:
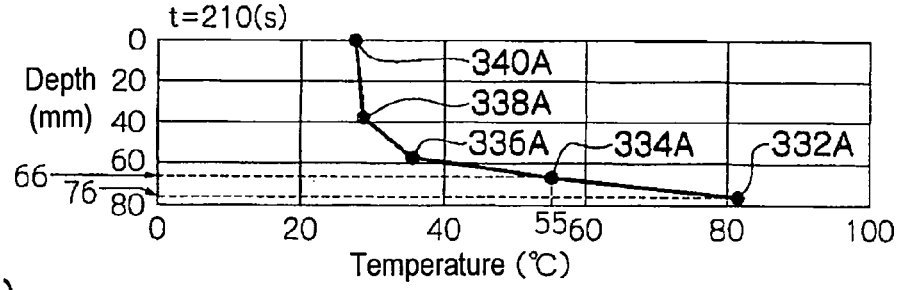
Figure 29:
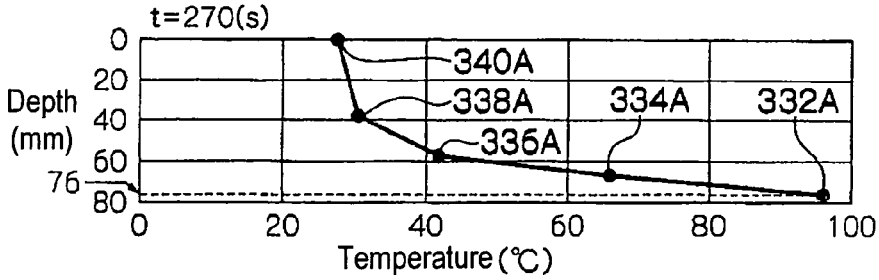
Figure 29:
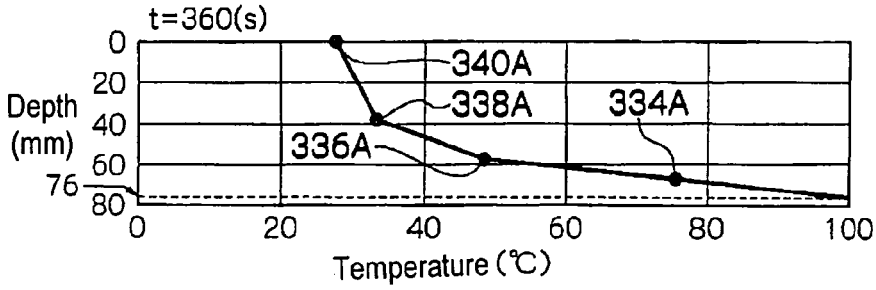
Figure 30:
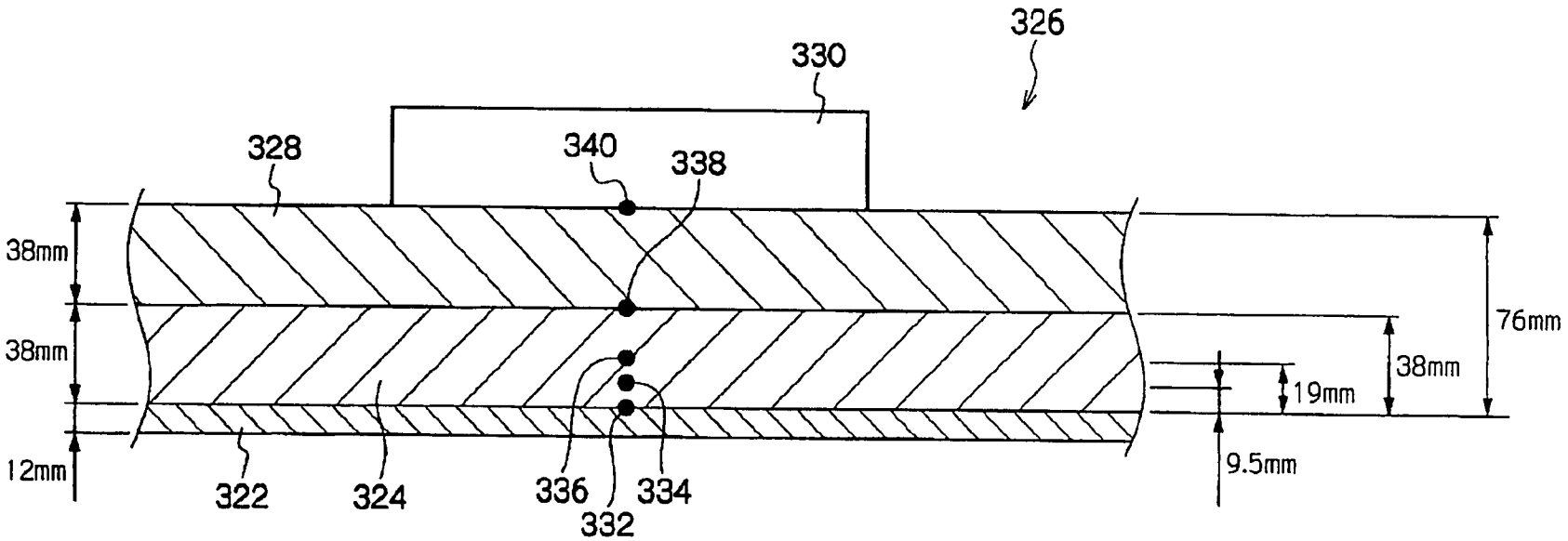
FIG. 30 A side view of a test sample in Example of the present invention.

12: steel plate
22: asphalt pavement
32: coil unit (electromagnetic induction coil unit)
36: electromagnetic induction coil
60: ripper (peeling member)
64: backhoe (extraction device)
70: Teflon™ coating (fluororesin, peeling layer)
72: cut line
74: melted layer (melt layer)
76: ripper (peeling member)
78: heater (heating means, separating means)
82: ripper (peeling member)
90: Teflon™ coating (fluororesin, peeling layer)
126: ripper (peeling member)
130: ripper (peeling member)
250: asphalt pavement removing system
252: progress direction
256: asphalt block
258: first cut line
260: cut-line forming device (first-cut-line forming device, second-cut-line forming device)
274: measurement device
276: splice plate (appendage)
278: bolt (appendage)
280A, 280B: belt conveyer (transfer device)
290: clamping member (second-cut-line forming device)
292: upper/lower-surface clamping device (holding means, extraction device)
296: actuator (second-cut-line forming device)
298: cutting blade (second-cut-line forming device)
302: softened layer
304: presser member
308: suction device (holding means, extraction device)
310: gripping device (holding means, extraction device)
312: side-surface clamping device (holding means, extraction device)
314: claw member
318: second cut line
320: second cut line

The invention claimed is:

1. An asphalt pavement removing method for allowing hardened asphalt pavement provided on a steel plate to be peeled off from said steel plate and removed in the form of an asphalt block having a given planar size and thickness, comprising:

a softened-layer forming step of subjecting said steel plate to electromagnetic induction heating to form, in said hardened asphalt pavement, a softened layer commencing at a lower surface of said hardened asphalt pavement in contact with said steel plate and extending partially thereinto in a thickness direction thereby defining the softened layer in contact with and between a hardened layer of said hardened asphalt pavement and said steel plate, wherein a first range of temperatures of the hardened asphalt pavement decreases substantially linearly from the lower surface in the thickness direction for approximately 19 mm, a second range of temperatures above the approximately 19 mm does not significantly change up to a top surface of the hardened asphalt;

an extraction step of peeling off said softened layer formed in said softened-layer forming step, from said steel plate in contact with said softened layer, and fragmenting and extracting said asphalt pavement in the form of said asphalt block, the extraction step occurring while the asphalt pavement in the form of said asphalt block is in the first and second ranges of temperatures; and a moving step of moving said asphalt block extracted in said extraction step.

2. The asphalt pavement removing method as defined in claim 1, wherein a temperature of said softened layer is set at 55° C. or more.

3. The asphalt pavement removing method as defined in claim 1 or 2, which further includes a first-cut-line forming step of forming, in said asphalt pavement, one or more first cut lines which segment a width of said asphalt pavement into two or more segmental widths and each of which has a depth failing to reach said steel plate or an appendage provided on said steel plate, wherein said asphalt block is extracted as a plate-shaped rectangular block.

4. The asphalt pavement removing method as defined in claim 3, which further includes a second-cut-line forming step of forming, in said segmental asphalt pavement, a plurality of second cut lines each of which intersects said one or more first cut lines, and has a depth failing to reach said steel plate or said appendage provided on said steel plate.

5. The asphalt pavement removing method as defined in claim 3, wherein said extraction step is the step of lifting up said segmental asphalt pavement, or pulling said segmental asphalt pavements in a trailing direction, while holding said segmental asphalt pavement by holding means, so as to fragment and extract said segmental asphalt pavement in the form of said asphalt block.

6. The asphalt pavement removing method as defined in claim 3, wherein said extraction step is the step of bringing a presser member into contact with said segmental asphalt pavement while arranging said presser member to extend in a direction intersecting said one or more first cut lines, and bending said segmental asphalt pavement while holding said segmental asphalt pavement by holding means, so as to fragment and extract said segmental asphalt pavement in the form of said asphalt block.

7. The asphalt pavement removing method as defined in claim 4, wherein said extraction step is the step of bending said segmental asphalt pavement while holding said segmental asphalt pavement by holding means, so as to fragment and extract said segmental asphalt pavement in the form of said asphalt block.

8. The asphalt pavement removing method as defined in claim 5, wherein said holding means is an upper/lower-surface clamping device operable to clamp said segmental asphalt pavement from respective sides of upper and lower surfaces thereof, said upper/lower-surface clamping device including a peeling member adapted to be inserted between said steel plate and said softened layer or inserted into said softened layer.

9. The asphalt pavement removing method as defined in claim 5, wherein said holding means is a suction device operable to suckingly hold said segmental asphalt pavement.

10. The asphalt pavement removing method as defined in claim 5, wherein said holding means is a side-surface clamping device operable to clamp said segmental asphalt pavement from respective sides of opposite side surfaces thereof each defined by said second cut line.

11. The asphalt pavement removing method as defined in claim 5, wherein said holding means is a gripping device having a claw member adapted to grip a surface of said segmental asphalt pavement.

12. The asphalt pavement removing method as defined in claim 3, which further includes a measurement step of measuring a thickness of said asphalt pavement, wherein at least one of each of said one or more first cut lines and each of said second cut lines is formed based on a thickness of said asphalt pavement measured in said measurement step to have a depth less than said measured thickness of said asphalt pavement.

13. The asphalt pavement removing method as defined in claim 1, which further includes a transfer step of transferring said asphalt block extracted in said extraction step, to one or more of three positions on leading, lateral and trailing sides relative to a position where said asphalt block is extracted.

14. An asphalt pavement removing system for allowing a hardened asphalt pavement provided on a steel plate to be peeled off from said steel plate and removed in the form of an asphalt block having a given planar size and thickness, comprising:

a softened-layer forming device operable to subject said steel plate to electromagnetic induction heating to form, in said hardened asphalt pavement, a softened layer commencing at a lower surface of said hardened asphalt pavement in contact with said steel plate and extending partially thereinto in a thickness direction thereby defining the softened layer in contact with and between a hardened layer of said hardened asphalt pavement and said steel plate, wherein a first range of temperatures of the hardened asphalt pavement decreases substantially linearly from the lower surface in the thickness direction for approximately 19 mm, a second range of temperatures above the approximately 19 mm does not significantly change up to a top surface of the hardened asphalt;

an extraction device operable to peel off said softened layer formed by said softened-layer forming device, from said steel plate in contact with said softened layer, and fragment and extract said asphalt pavement in the form of said asphalt block; the extraction device extracting said asphalt pavement in the form of said asphalt block while said asphalt pavement in the form of said asphalt block is in the first and second ranges of temperatures; and a transfer device operable to transfer said asphalt block extracted by said extraction device, to one or more of three positions on leading, lateral and trailing sides relative to a position where said asphalt block is extracted.

15. The asphalt pavement removing system as defined in claim 14, which further includes a first-cut-line forming device operable to form, in said asphalt pavement, one or more first cut lines which segment a width of said asphalt pavement into two or more segmental widths and each of which has a depth failing to reach said steel plate or an appendage provided on said steel plate, wherein said asphalt block is extracted as a plate-shaped rectangular block.

16. The asphalt pavement removing system as defined in claim 15, which further includes a second-cut-line forming device operable to form, in said segmental asphalt pavement, a plurality of second cut lines each of which intersects said one or more first cut lines, and has a depth failing to reach said steel plate or said appendage provided on said steel plate.

17. The asphalt pavement removing system as defined in claim 15 or 16, which further includes a measurement device operable to measure a thickness of said asphalt pavement, wherein at least one of each of said one or more first cut lines and each of said second cut lines is formed based on a thickness of said asphalt pavement measured by said measurement device to have a depth less than said measured thickness of said asphalt pavement.

* * * * *